US006781046B2

(12) United States Patent
Meisel

(10) Patent No.: US 6,781,046 B2
(45) Date of Patent: Aug. 24, 2004

(54) KEY ACTUATION SYSTEMS FOR KEYBOARD INSTRUMENTS

(76) Inventor: David Meisel, 7271 Kingswood Dr., Bloomfield Township, MI (US) 48301

( * ) Notice: Subject to any disclaimer, the term of this patent is extended or adjusted under 35 U.S.C. 154(b) by 167 days.

(21) Appl. No.: 09/772,736

(22) Filed: Jan. 30, 2001

(65) Prior Publication Data

US 2001/0017075 A1 Aug. 30, 2001

Related U.S. Application Data

(63) Continuation-in-part of application No. 09/387,395, filed on Sep. 2, 1999, now Pat. No. 6,194,643.

(60) Provisional application No. 60/179,319, filed on Jan. 31, 2000, provisional application No. 60/205,723, filed on May 19, 2000, provisional application No. 60/246,228, filed on Nov. 6, 2000, provisional application No. 60/099,081, filed on Sep. 4, 1998, provisional application No. 60/104,920, filed on Oct. 20, 1998, provisional application No. 60/109,169, filed on Nov. 20, 1998, provisional application No. 60/116,746, filed on Jan. 22, 1999, provisional application No. 60/136,188, filed on May 27, 1999, and provisional application No. 60/144,969, filed on Jul. 21, 1999.

(51) Int. Cl.[7] ..... G10F 1/02

(52) U.S. Cl. ..... 84/20

(58) Field of Search ..... 84/16–20

(56) References Cited

U.S. PATENT DOCUMENTS

| | | | |
|---|---|---|---|
| 412,657 | A | 10/1889 | Pain |
| 417,680 | A | 12/1889 | Pain |
| 507,703 | A | 10/1893 | Zimmerman |
| 546,582 | A | 9/1895 | Davis |
| 547,071 | A | 10/1895 | Hedgeland |
| 570,911 | A | 11/1896 | Davis |
| 575,072 | A | 1/1897 | Simpkins |
| 576,342 | A | 2/1897 | Davis |
| 674,904 | A | 5/1901 | Cellerier |
| 681,261 | A | 8/1901 | Powers |
| 730,098 | A | 6/1903 | Davis |
| 739,396 | A | 9/1903 | Davis |
| 778,908 | A | 1/1905 | Shonnard |
| 784,457 | A | 3/1905 | Weber |
| 822,881 | A | 6/1906 | Brown |
| 824,315 | A | 6/1906 | Shonnard |
| 889,685 | A | 6/1908 | Hochman |
| 964,274 | A | 7/1910 | Kelly |
| 1,003,201 | A | 9/1911 | Phillips |
| 1,027,257 | A | 5/1912 | Kruck |
| 1,045,710 | A | 11/1912 | Kruck |
| 1,104,282 | A | 7/1914 | Severy et al. |
| 1,133,370 | A | 3/1915 | Dreher |
| 1,148,719 | A | 8/1915 | Sandell |
| 1,170,750 | A | 2/1916 | Huass |
| 1,181,486 | A | 5/1916 | Severy et al. |
| 1,183,685 | A | 5/1916 | Sinclair et al. |
| 1,198,070 | A | 9/1916 | Severy et al. |
| 1,245,518 | A | 11/1917 | Severy et al. |
| 1,398,469 | A | 11/1921 | Schwartz et al. |

(List continued on next page.)

*Primary Examiner*—Jeffrey W Donels
(74) *Attorney, Agent, or Firm*—Gifford, Krass, Groh, Sprinkle, Anderson & Citkowski, PC

(57) ABSTRACT

The key actuation system is designed for use with a keyboard instrument of the type having multiple keys. Each of the keys has an upper and lower surface and is pivotally supported above a key bed. A front end of a key may be depressed by a player to play a note. The key bed extends under and is spaced from the lower surface of the key. The actuation system includes an underlever in the space between the lower surface of the key and the key bed, and between the front end of the key in the pivotal support. The underlever has one end that is supported in a stationary position relative to the key bed and another end that is movable towards and away from the key bed. The movable end of the underlever is in mechanical communication with the key such that movement of the movable end of the underlever towards the key bed causes the key to move as if depressed by a player. An actuator is in mechanical communication with the underlever and operable to move the second end of the underlever towards the key bed.

27 Claims, 32 Drawing Sheets

U.S. PATENT DOCUMENTS

| | | | | |
|---|---|---|---|---|
| 1,494,811 | A | 5/1924 | Sandell | |
| 1,603,871 | A | 10/1926 | Sandell | |
| 1,712,638 | A | 5/1929 | Stoddard | |
| 1,979,633 | A | 11/1934 | Miessner | 84/259 |
| 2,919,619 | A | 1/1960 | Munzfeld | 84/443 |
| 3,117,481 | A | 1/1964 | Cushing | 84/19 |
| 3,126,783 | A | 3/1964 | Von Gunten | 84/246 |
| 3,160,052 | A | 12/1964 | Von Gunten | 84/433 |
| 3,186,285 | A | 6/1965 | Von Gunten | 84/20 |
| 3,405,584 | A | 10/1968 | Von Gunten | 84/147 |
| 3,634,877 | A | 1/1972 | Cannon | 335/255 |
| 3,787,603 | A | 1/1974 | Ghere | 84/19 |
| 4,031,796 | A | 6/1977 | Wilkes | 84/20 |
| 4,338,847 | A | 7/1982 | Brennan | 84/20 |
| 4,383,464 | A | 5/1983 | Brennan | 84/21 |
| 4,592,262 | A | 6/1986 | Yang | 84/115 |
| 4,873,905 | A | 10/1989 | Murakami et al. | 84/20 |
| 4,913,026 | A | 4/1990 | Kaneko et al. | 84/21 |
| 4,970,928 | A | 11/1990 | Tamaki | 84/21 |
| 5,042,353 | A | 8/1991 | Stahnke | 84/21 |
| 5,081,893 | A | 1/1992 | Broadmoore | 84/19 |
| 5,107,262 | A | 4/1992 | Cadoz et al. | 341/22 |
| 5,107,739 | A | 4/1992 | Muramatsu et al. | 84/20 |
| 5,237,123 | A | 8/1993 | Miller | 84/21 |
| 5,557,052 | A | 9/1996 | Hayashida et al. | 84/243 |
| 5,612,502 | A | 3/1997 | Ura | 84/687 |
| 5,648,621 | A | 7/1997 | Sasaki | 84/171 |
| 5,739,450 | A | 4/1998 | Fujiwara et al. | 84/462 |
| 5,796,023 | A | 8/1998 | Kumano et al. | 84/433 |
| 5,861,566 | A | 1/1999 | Kaneko et al. | 84/13 |
| 5,994,632 | A | 11/1999 | Muramatsu et al. | 84/18 |

FIG-1
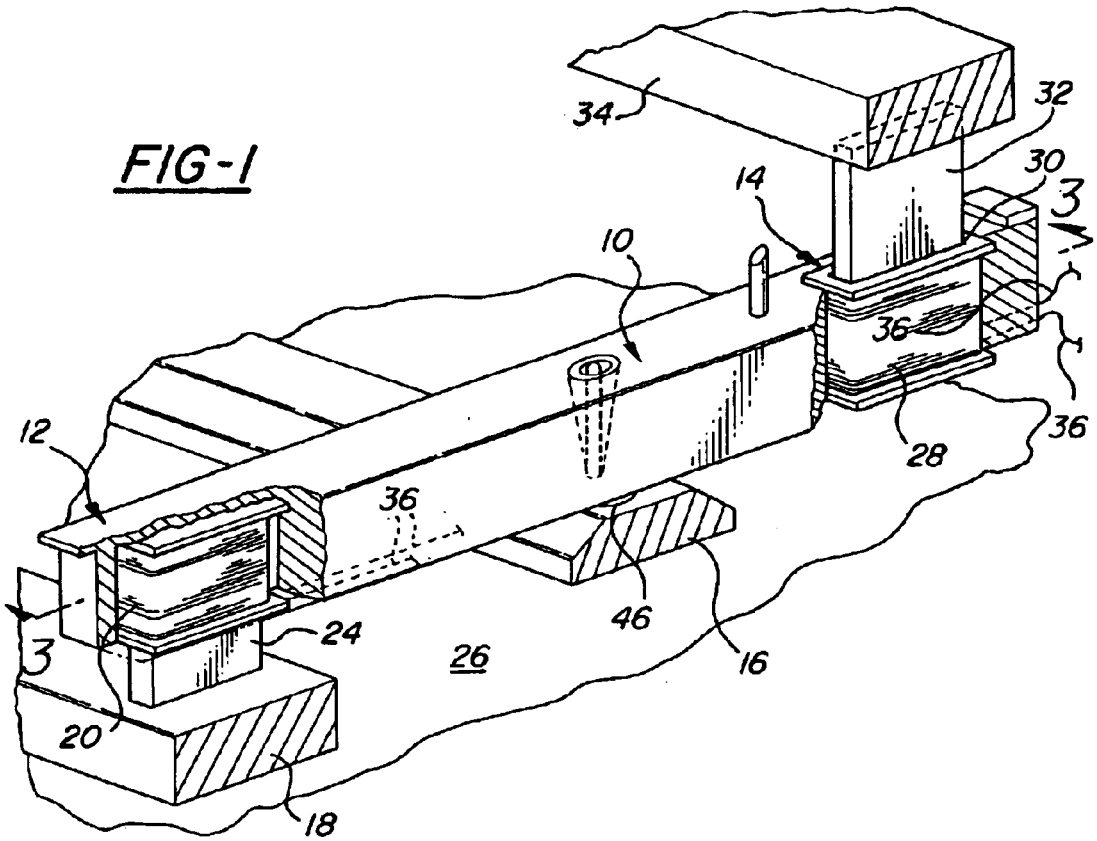
FIG-2
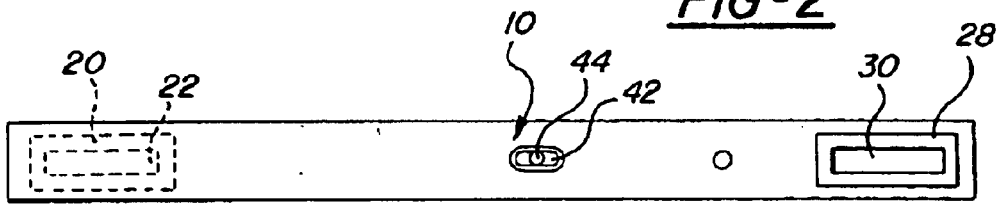
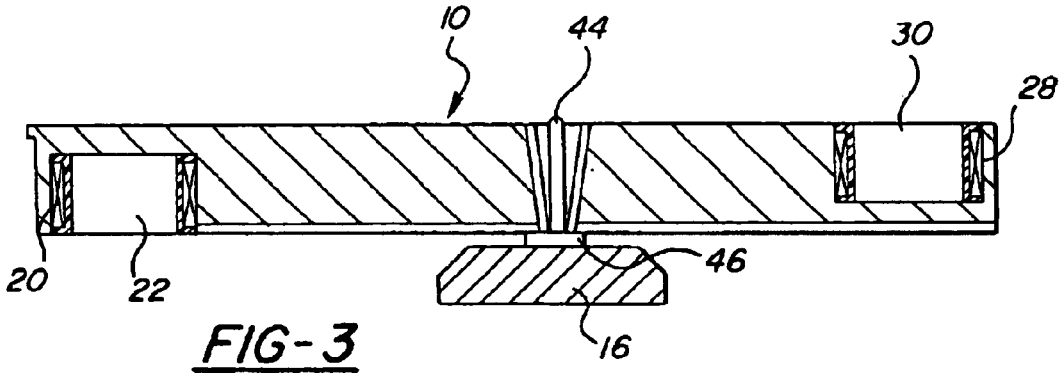
FIG-3

FIG-4
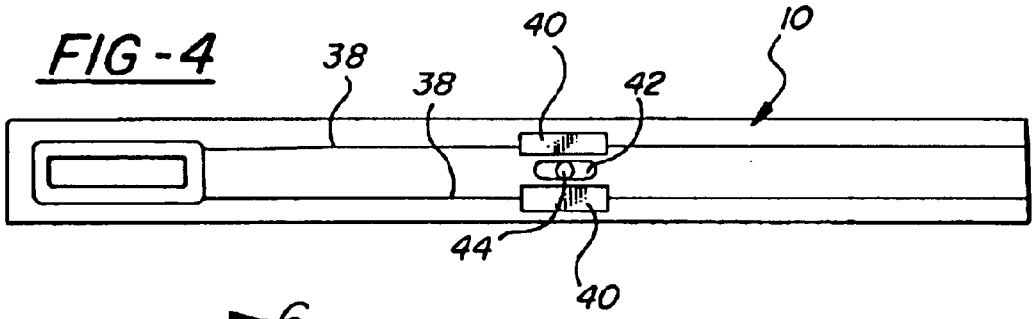
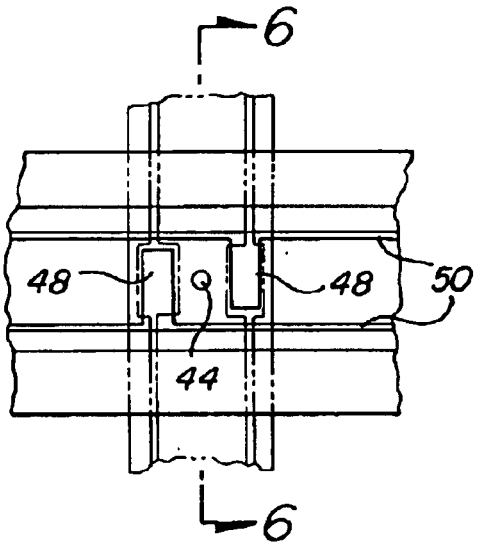
FIG-5
FIG-6
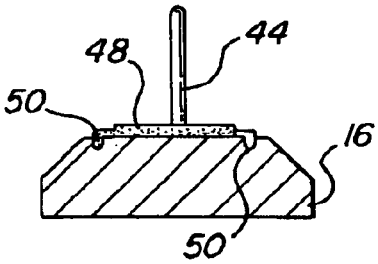
FIG-7
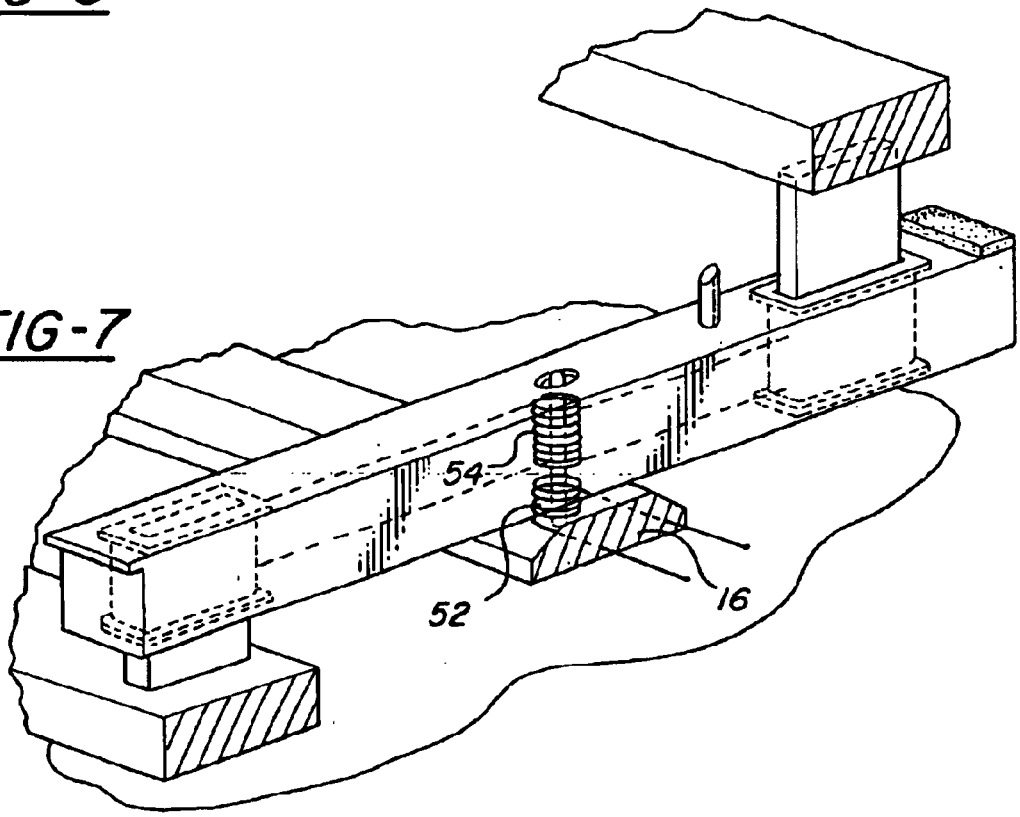

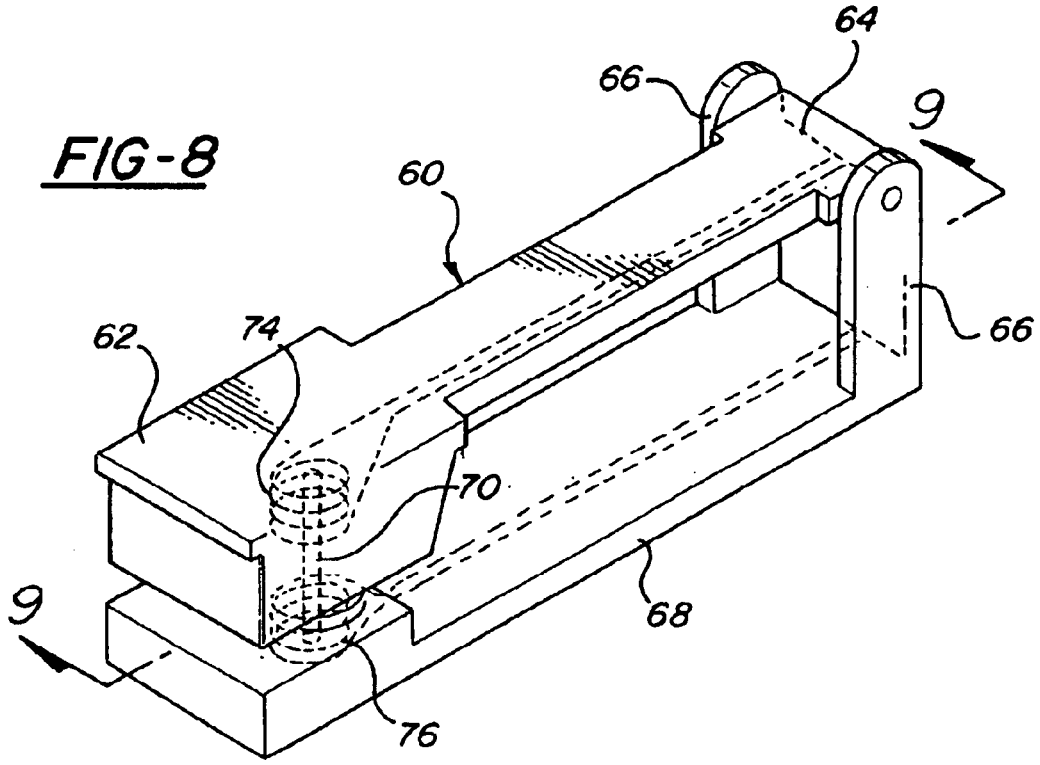
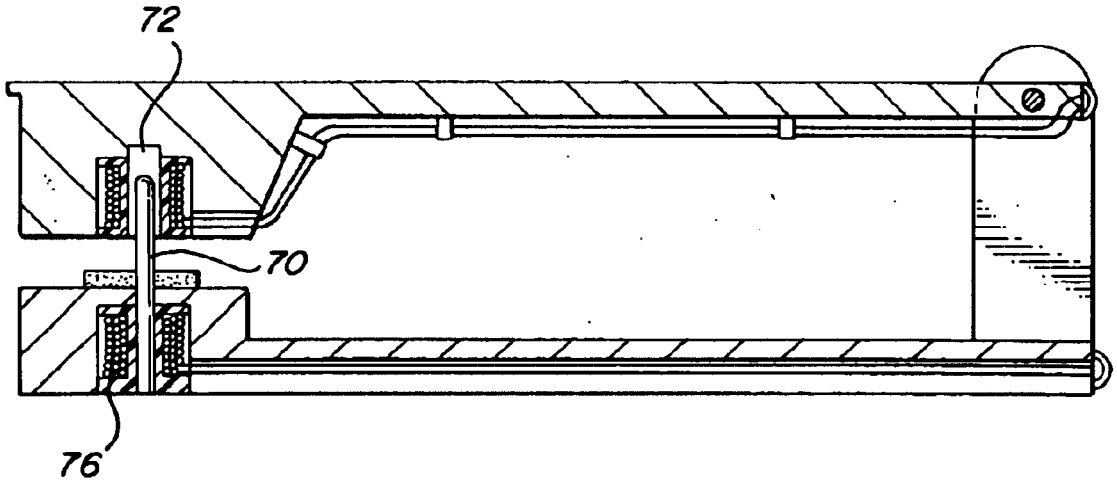
FIG-9

FIG-58
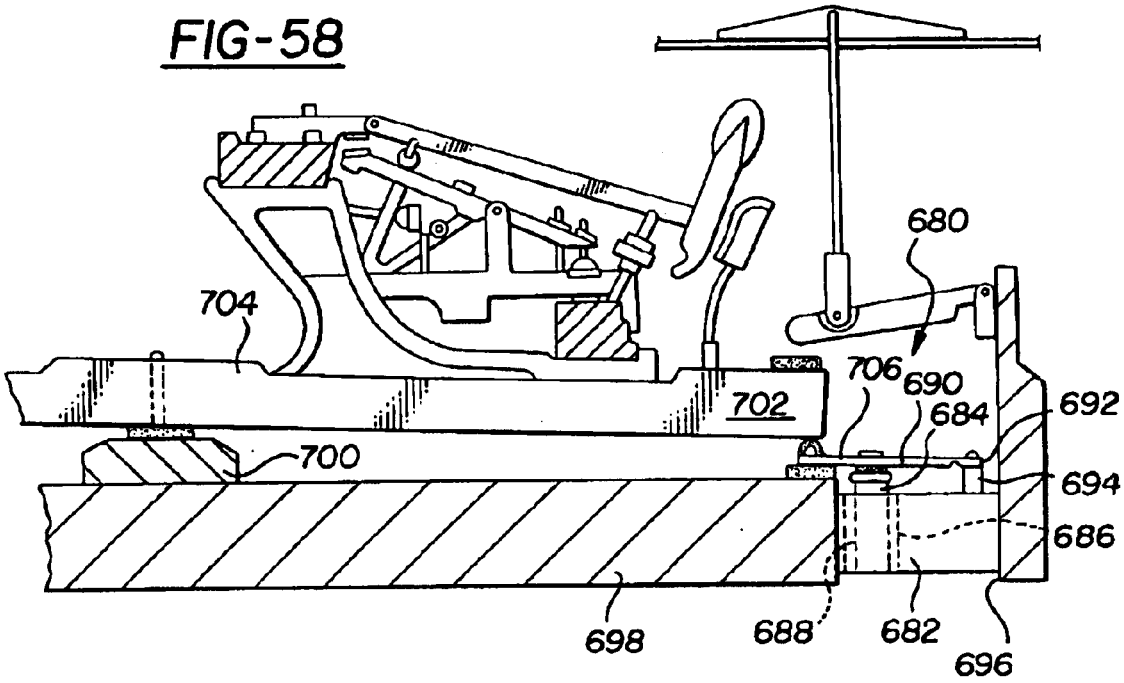
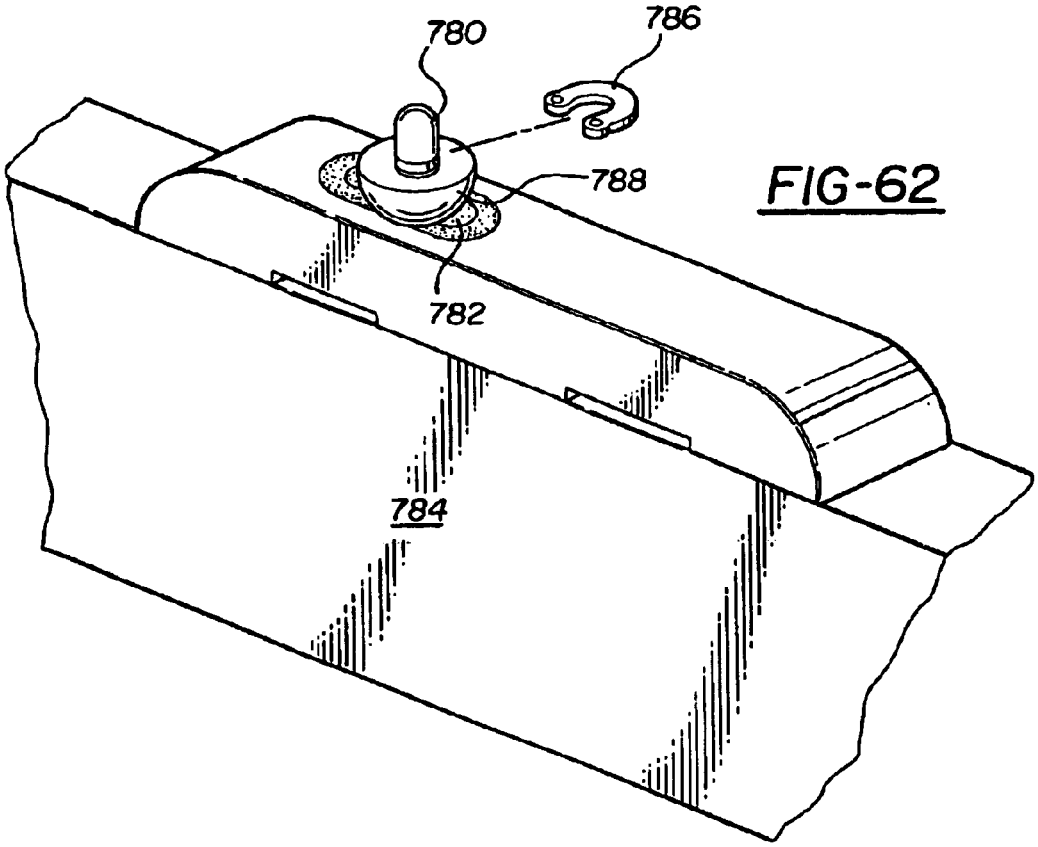
FIG-62

KEY ACTUATION SYSTEMS FOR KEYBOARD INSTRUMENTS

CROSS-REFERENCE TO RELATED APPLICATIONS

This application is a continuation-in-part of U.S. patent application Ser. No. 09/387,395, filed Sep. 2, 1999, now U.S. Pat. No. 6,194,643. This application also claims priority of U.S. provisional patent application Ser. No. 60/179,319, filed Jan. 31, 2000; No. 60/205,723, filed May 19, 2000; and No. 60/246,228, filed Nov. 6, 2000.

U.S. patent application Ser. No. 09/397,395. filed Sep. 2, 1999, in turn, claims priority of U.S. provisional patent application Serial No. 60/099,081, filed Sep. 4, 1998; No. 60/104,920. filed Oct. 20, 1998; No. 60/109,169, filed Nov. 20, 1998; No. 60/116,146, filed Jan. 22, 1999; No. 60/136,188, filed May 27, 1999; and No. 60/144,969, filed Jul. 21, 1999.

FIELD OF THE INVENTION

The present invention relates generally to devices for the actuation of keys for acoustic and electronic keyboards.

BACKGROUND OF THE INVENTION

The piano is a stringed keyboard musical instrument which was derived from the harpsichord and the clavichord. Its primary differences from its predecessors is the hammer and lever action which allows the player to modify the intensity of the sound emanating from the piano depending upon the force employed by the person playing the piano.

The modern piano has six major parts: (1) the frame, which is usually made of iron; (2) the sound board, a thin piece of fine grain spruce which is placed under the strings; (3) the strings made of steel wire which increase in length and thickness from the treble to the bass; (4) the action, which is the mechanism required for propelling the hammers against the string; (5) the pedals, one of which actuates a damper allowing the strings to continue to vibrate even after the keys are released, another known as a soft pedal which either throws all the hammers nearer to the strings so that the striking distance is diminished or shifts the hammers a little to one side so that only a single string instead of two or three strings is struck, and, in some pianos, a third or sustaining pedal that keeps raised only those dampers already raised by the keys at the moment the pedal is applied; and finally (6) the case. The piano's action functions primarily as follows: a key is pressed down, its tail pivots upward, lifting a lever that throws a hammer against the strings for that key's note. At the same time a damper is raised from the strings, allowing them to vibrate more freely. When the key is even partially released, the damper falls back onto the strings and silences the note. When the key is fully released, all parts of the mechanism return to their original positions.

The player piano is an evolution of the standard piano which includes a system for automatically actuating the piano keys. There are numerous types of apparatuses available for actuating the piano keys.

Credit for the mechanically operated (or player) piano is generally given to Claude Felix Seytre of Leon, France. His patent was issued in 1842 for a playing piano system that used stiff cardboard sheets. An Englishman named Alex Bain improved the patent in 1848 with a roll operated piano. In 1863 the first pneumatically operated piano was patented and achieved commercial success.

Originally, player pianos operated by means of suction which was created by pumping bellows at the bottom of the piano. This in turn caused the keys to go down, the music roll to turn and other various accessories to operate, such as the sustain pedal and hammer rail. When suction is applied to a pneumatic actuator, it collapses and performs a mechanical function such as playing a note, lifting the dampers, or pushing on the hammer rails. To perform an action each pneumatic actuator must have a valve associated with it for turning each actuator on and off. Pneumatically operated player pianos tended to be extremely complicated machines.

More recently, to overcome the problems associated with using paper rolls and pneumatic controls, electronically operated player pianos have been developed. In these, CD-ROMs, cassette tapes and other electronic storage means replace the paper rolls and electromagnetic actuators such as solenoids control key movement. These electromagnetic actuators generally offer greater control over the movement of the keys, which allows for finer control of the sounds emanating from the player piano.

The size of the player piano mechanisms has also been greatly reduced with the use of electromagnetic actuators. In many cases, electromagnetic actuators were substituted directly for the corresponding pneumatic actuators and were placed beneath the rear of the keys to push the keys up. These push type solenoids were first used in the early 1960s and continue to be used today. Locating the actuators under the rear of the key makes installation problematic. Installation requires cutting a slot along the entire lower side of the piano case, thus permanently disfiguring the piano. Another disadvantage is that the solenoids are mounted separately from the key frame and therefore cannot be removed and serviced with the key frame.

One potential improvement was offered in U.S. Pat. No. 4,383,464 to Brennan which issued in 1983. It discloses an electromagnetic device for actuating piano keys. In this invention, electromagnets were located above the key and behind the fulcrum of the key and operated to pull a piece of magnetic material in the rear of the key upwardly. The electromagnets were positioned forward of the structure that holds the hammer mechanism, known as the tower. Also, the electromagnets did not engage the key itself. Rather, they relied on a magnetic field. The patent was never successful in commercial application. The location of the electromagnetic device was problematic in that there is little room between the rear of the key pivot or fulcrum and in front of the tower. The electromagnetic devices used in the '464 patent had additional problems in that they charged much slower and thereby consumed excess power and were slow to start up. They generated additional heat and consumed far more power than a solenoid or servomechanism. Additionally, the location of the electromagnetic devices in the '464 patent would be extremely sensitive to any maintenance work which is performed upon the action due to the fact that if the action is removed and worked upon, the alignment of the electromagnetic devices would require adjustment after the action was reinstalled.

Many other approaches to the actuation of the keys of the piano have been attempted, but all suffer from various shortcomings. It is desirable that an actuation system provide a combination of playing power, key control, and quiet operation. It is also desirable that an actuation system be easily installed into an existing piano without requiring extensive modification to the piano. Presently available systems generally fail to meet this combination of requirements. Therefore, there remains a need for improved player systems.

In many player pianos, it is desirable to sense the movement of the piano keys. This allows the player piano to "record" the playing of a user. Key movement sensing may also be beneficial in the control of playback by allowing the player piano to use some type of a feedback control loop.

Currently, player pianos include some type of actuator mechanism that moves individual piano keys, thereby "playing" the piano. Where key movement sensing is desired, an entirely separate system of key movement sensors is added. Currently available key movement sensing systems have several drawbacks. First, they typically require the addition of a piece of metal to each key which may affect the weight of the key and alter the playing characteristics of the piano. Secondly, because the sensing system is entirely separate from the actuation mechanism, additional wiring and installation is required. This also adversely affects the cost of such a system. Therefore, there remains a need for improved key sensing systems.

Non-acoustical keyboard instruments, such as electronic keyboards, typically include a plurality of keys with some type of sensor located so as to sense movement of each key. When a sensor determines that a key has been moved, a sound is electronically created by the instrument. This differs from a piano wherein sound is created by a mechanical system. A drawback to non-acoustical keyboard instruments is that most lack the "feel" associated with traditional acoustic keyboard instruments. That is, there is a certain feel associated with operating the keys on a traditional acoustic keyboard instrument, such as a piano. This feel results from the mechanical design of the string striking mechanism, the weight of the keys, and other factors. Non-acoustical keyboards lack the mechanical structure of a piano and usually have keys which are significantly less massive. Consequently, the keys feel entirely different when operated. Some musicians consider this a drawback as they would prefer that non-acoustical keyboards have a feel similar to acoustical keyboards such as a piano.

Another drawback to non-acoustical keyboard instruments is that it is typically prohibitively expensive to provide a "player" version. Purchasers and owners of non-acoustical keyboard instruments sometimes desire, as do owners of pianos, that the keyboard instrument be able to play itself. Systems used to turn pianos into player pianos may be adapted for use with some non-acoustical keyboard instruments, but the cost and complexity is often high. For example, the player system may cost as much or more than the non-acoustical keyboard instrument, thereby doubling its purchase cost. Player systems typically provide both for operation of the keys and for sensing of key movement so that the playing of a musician may be "recorded." One or both of these features is often desired by purchasers of non-acoustical instruments. In light of the above limitations of non-acoustical keyboard instruments, there is a need for improving the feel of these keyboards as well as for player systems designed for use with non-acoustical keyboard instruments.

SUMMARY OF THE INVENTION

There is disclosed herein a plurality of solutions to the shortcomings of the prior art. For example, according to one aspect of the present invention, a key actuation system is provided for a keyboard instrument. The keyboard instrument is of the type having a plurality of keys with each key having an upper surface and a lower surface and being pivotally supported above a key bed. Each key has a front end that can be depressed by a player to play a note. The key bed extends under and is spaced from the lower surface of the key. The actuation system includes an underlever positioned in the space between the lower surface of the key and the key bed, and between the front end of the key and the pivotal support. The underlever has a first end that is supported in the stationary position relative to the key bed and the second end that is movable towards and away from the key bed. The second end of the underlever is in mechanical communication with the key such that movement of the second end of the underlever towards the key bed causes the key to move as if it is depressed by a player. An actuator is in mechanical communication with the underlever and is operable to move the second end of the underlever towards the key bed. Numerous other embodiments of the present invention are also disclosed and described herein.

BRIEF DESCRIPTION OF THE DRAWINGS

A better understanding of the present invention will be had upon reference to the following detailed description when read in conjunction with the accompanying drawings in which:

FIG. 1 is a perspective view of a single key for a keyboard instrument with portions cutaway to show integral actuators disposed therein;

FIG. 2 is a top view of the key of FIG. 1;

FIG. 3 is a cross-sectional side view of the key of FIG. 1 taken along lines 3—3;

FIG. 4 is a bottom view of the key of FIG. 1 showing one approach to wiring the actuators;

FIG. 5 is a detailed view of a portion of a balance rail for use with the embodiment of FIG. 1 with a portion of a key superimposed thereon in phantom lines;

FIG. 6 is a cross-sectional side view of the balance rail of FIG. 5 taken along lines 6—6;

FIG. 7 is a perspective view of a key similar to FIG. 1 showing an alternative approach to providing power to the actuators;

FIG. 8 is a perspective view of a single key from the keyboard instrument with an actuator system disposed partially in the key and partially in the key frame;

FIG. 9 is a cross-sectional side view of the key of FIG. 8 taken along lines 9—9;

FIG. 58 is a side view of a portion of a key in key action along with another embodiment of an actuator according to the present invention;

FIG. 62 is a detailed view of a portion of a key along with a key hold down clip according to the present invention;

DETAILED DESCRIPTION OF THE INVENTION

Figure 10:
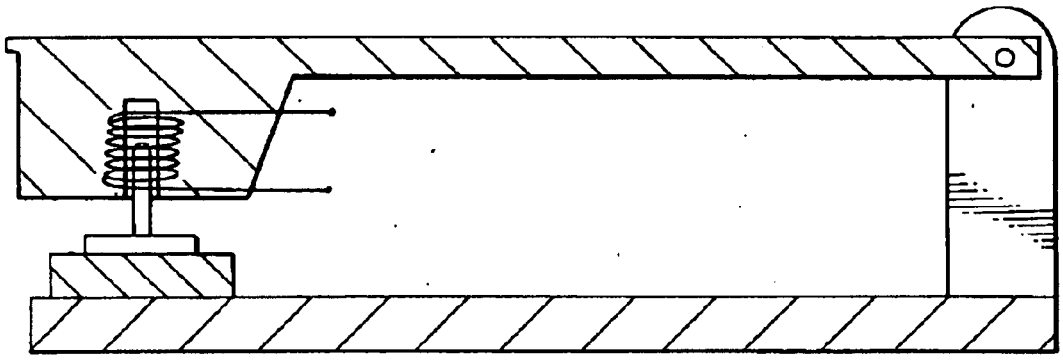
FIG. 10 is a cross-sectional side view of a key similar to FIG. 8 with a single coil actuator disposed in the key.

A common goal in the design of player systems for both acoustic and non-acoustic keyboard instruments is to move the keys of the instrument. This may actually "play" the instrument or, in some electronic keyboards, may merely mimic the movement of the keys that would be associated with the sound being internally produced by other means. In accordance with the first aspect of the present invention, a system for moving the keys of either an acoustic or a non-acoustic instrument will be described.

Referring now to FIGS. 1–3, a twin coil actuator system according to the present invention is shown. The system is installed in a key 10 which has a front end or playing end 12 and a rear end 14. The key 10 is supported midway along its length by a balance rail or fulcrum 16. A front rail 18 is positioned under the front end 12 of the key. Normally, a guide pin would extend upwardly from the front rail 18 into a hole in the underside of the front end 12 of the key for guiding the key during movement. When a keyboard instrument is played, a player presses downwardly on the front end 12 of the key 10 causing the rear end 14 to pivot upwardly. In an acoustic keyboard instrument, such as a piano, the upward movement of the rear end 14 of the key 10 sets a mechanism in motion which mechanically produces a sound. In a piano, this occurs when a hammer is flicked upwardly such that it hits a string, producing a note. In a non-acoustic instrument, movement of the key 10 triggers a sensor which causes the instrument to electronically produce a sound. The actuation system will now be described. A first coil 20 is embedded in the front end 12 of the key 10. A generally rectangular hole or recess 22 is defined in the center of the coil. This recess 22 extends upwardly from the underside of the key 10 part way to the top of the key 10. A stationary ferromagnetic guide pin 24 is mounted to the front rail 18 of the key frame 26 and is aligned so as to extend partially into the recess 22 in the first coil 20. When electrical power is applied to the first coil 20, the front end 12 of the key 10 is drawn downwardly so that the coil 20 can surround the guide pin 24. As shown, the recess or hole 22 and the guide pin 24 are generally rectangular. Likewise, a second coil 28 is embedded in the rear end 14 of the key 10 with a rectangular recess 30 in the top side of the key 10. A second stationary ferromagnetic guide pin 32 extends downwardly from a support member 34 and is aligned so as to extend into the recess 30. Once again, by energizing the second coil 28, the rear end 14 of the key 10 is lifted upwardly so that the guide pin 32 extends into the recess 30 in the coil 28. It should be noted that while the use of both the first coil 20 and the second coil 28 is preferred for some applications, the use of only a single coil is sufficient for other applications.

In FIG. 1, electrical leads 36 are shown extending from the coils 20 and 28. Obviously, it is preferable to configure the wiring such that it does not interfere with the movement of the key 10. One approach to providing a more convenient wiring system is shown in FIGS. 4–6. As shown in FIG. 4, the bottom side of the key 10 may have wiring traces 38 defined thereon. A pair of electrical contacts 40 are provided adjacent the pivot hole 42 in the key 10. As shown in FIG. 4, a key 10 normally rests on a balance rail 16 with a fulcrum pin 44 extending upwardly therefrom. The hole 42 is generally elongated so that the fulcrum pin 44 can rock forwardly and backwardly in the hole 42. As shown in FIGS. 1 and 3, a bushing 46 is normally provided atop the balance rail 16 with the bushing 46 surrounding the fulcrum pin 44. As shown in FIGS. 5 and 6, this bushing 46 may include positive and negative electrical contacts 48 aligned so as to make contact with the contacts 40 on the underside of the key 10 when the key 10 is placed in its normal position on the bushing 46. Wiring traces 50 may run along the top of the balance rail 16 to power supplies. The wiring traces 50 provide a convenient method for providing power to the bushing 46 and from the contacts 40 to the coils 20 and 28. The key wiring traces 38 may be deposited directly on the underside of the key 10, thus avoiding the labor intensive process of running individual wires.

The embodiment disclosed in FIGS. 1–6 provides a simple way to provide automatic actuation of the keys. New keys with wiring traces and coils may be substituted for existing keys. A new front rail 18 with the guide pins 24 may be substituted for the existing one and a new support member 34 with guide pins 32 may also be substituted for the existing one. Then, the wiring traces on the balance rail 16 are connected to a power supply. Obviously, it is necessary to individually control the various keys 14. Therefore, individual control circuits may also be provided in close proximity to the keys. The system of FIGS. 1–6 also provides several other advantages over the prior art. First, by placing the coils in the keys, heating concerns are reduced. If an arrangement were such that the guide pins were part of the keys and the coils were embedded in the front rail and support member, multiple coils would be located side by side in the rail and support member. This may create concentrated heat loads as the coils are energized, which may in turn cause changes in the dimensions of the front rail and support member. Also, the guide pins 24 and 32 weigh substantially more than their corresponding coils 20 and 28. Keys, on the other hand, have spaces between them so expansion of individual keys by a small amount should not affect their action. Also, more air is able to circulate around the key than would be able to circulate about the front rail or support member, thereby increasing cooling of the coils. Therefore, positioning the coils in the keys has less of an effect on the weight of the keys than would mounting the guide pins thereto. This in turn reduces any affects on the "feel" of the keys. It should also be noted that the illustrated shape of the guide pins 24 and 32 are preferred but not required. The rectangular cross-section of the pins and the corresponding coils allows for heavy magnetic saturation. The rectangular shape also allows the guide pins to be of substantial size, thereby increasing the magnetic saturation. The guide pins also serve to replace the function of a normal small oval guide pin that would be located at the front 12 of the key 10. Therefore, the guide pins, especially the front guide pin 24, acts to stabilize the key during its motion in the same way that a traditional guide pin would.

FIG. 7 illustrates an alternate approach to energizing a twin coil actuator system, such as was shown and discussed with respect to FIGS. 1–6. In the embodiment of FIGS. 1–6, power was provided to the twin coils 20 and 28 via contacts provided between the underside of the key 10 and the balance rail 16 on the key frame 26. In the embodiment of FIG. 7, a primary coil 52 is provided in the balance rail 16. A secondary coil 54 is disposed inside the key 10 and is wired to the twin coils 20 and 28. In use, the primary coil 52 is pulse energized which inductively charges the secondary coil 54. The secondary coil 54 converts this energy to a voltage and current to drive the twin coils 20 and 28. This system provides the advantage that no electrical contact is required between the key 10 and the balance rail 16.

In some non-acoustical keyboard instruments, full size keys, such as key 10 in FIG. 1, are not used. Instead, half size keys, such as shown in FIGS. 8–11, are used. Referring to FIG. 8, a half size key 60 has a front or playing end 62, which a player depresses in order to play a note. Instead of having a rear end and a mid portion that is supported by a fulcrum, the other end of the half size key 60 is a pivot end 64. This pivot end 64 is supported by pivotal support 66 which extends upwardly from the key frame 68. The front end 62 of the half size key 60 is typically thickened with the remainder of the key being thinned out, as shown, to save weight and cost. A guide pin 70 extends upwardly from the front of the key frame 68 into a recess 72 in the under side of the front end 62 of the half size key 60. A plurality of these half size keys 60 are used to assemble a complete keyboard instrument. As discussed previously, purchasers of these instruments also often desire player systems that move the keys 60. FIGS. 8–11 illustrate systems for accomplishing this goal.

In the embodiment of FIGS. 8 and 9, a solenoid coil 74 is embedded in the thickened front end 62 of the key 60 surrounding the recess 72. As discussed earlier, a guide pin 70 extends upwardly from the key frame 68 into the recess 72 and acts to guide the key 60 as it moves downwardly. In this embodiment, the pin 70 is made at least partially of a magnetic material. As will be clear to those of skill in the art of electromechanics, energizing the coil 74 causes it to act as an electromagnet. Therefore, when the coil 74 is energized, magnetic force will be created between the pin 70 and the key 60. This may be used to pull the key 60 downwardly thereby playing a note. The coil 74 may also be used in other ways, as will be described with respect to other aspects of the present invention.

FIGS. 8 and 9 also show a second coil 76 embedded in the key frame 68 so as to surround the base of the pin 70. The second coil 76 may be used to assist the first coil 74 or may be used in other ways, as will be described with respect to other aspects of the present invention.

Figure 11:
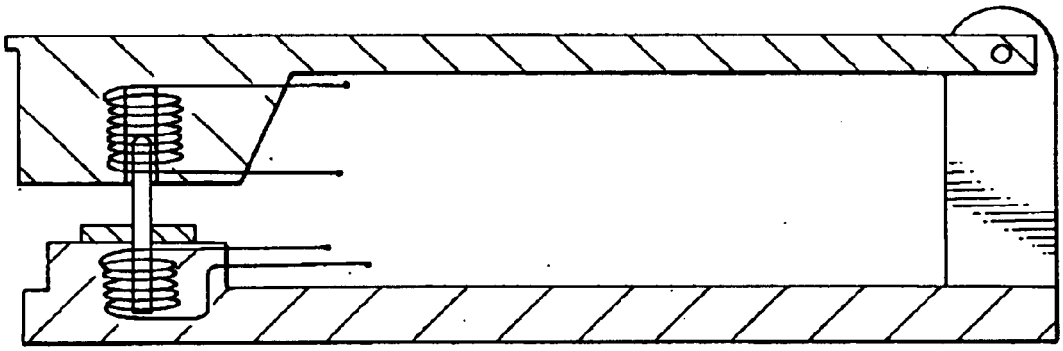
FIG. 11 is a cross-sectional side view of a key similar to FIG. 10 with a second coil added.

FIG. 10 shows a view of a key similar to FIGS. 8 and 9 but with only a single coil embedded in the key. FIG. 11 is similar to FIG. 10 but adds a second coil.

Figure 12:
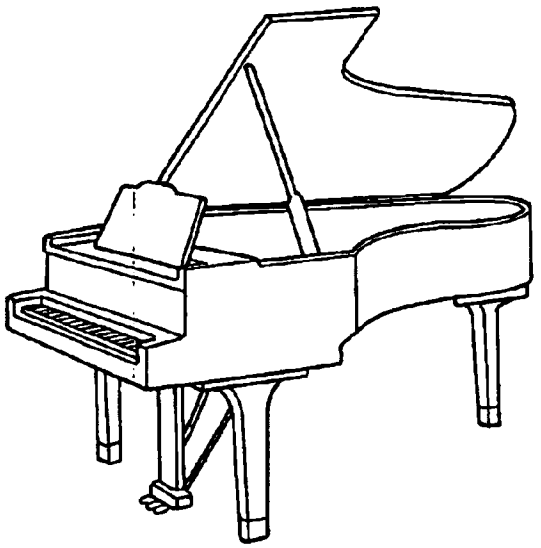
FIG. 12 is a perspective view of a typical grand piano.
Figure 13:
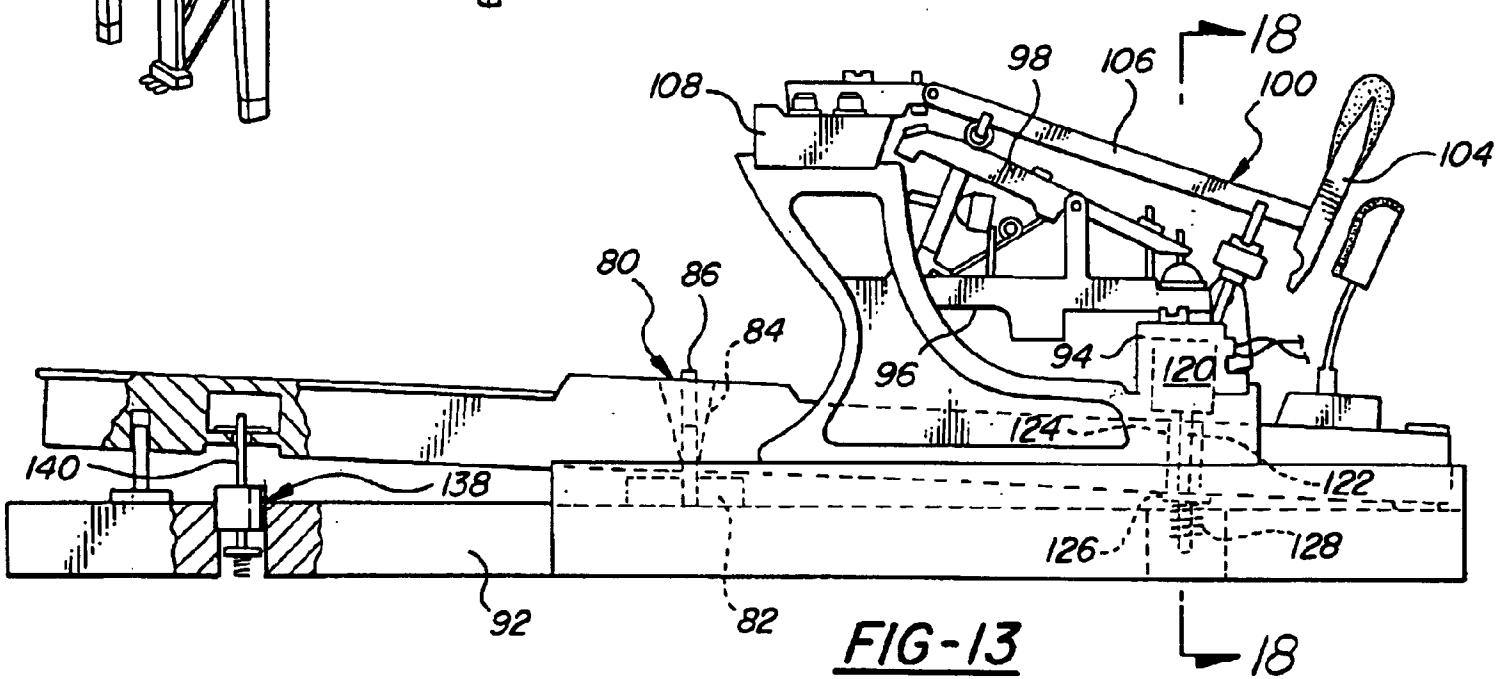
FIG. 13 is a side elevational view of a single key and key action from a typical grand piano with an actuator disposed in the wippen flange rail and an optional secondary actuator disposed in the front of the key bed.
Figure 16:
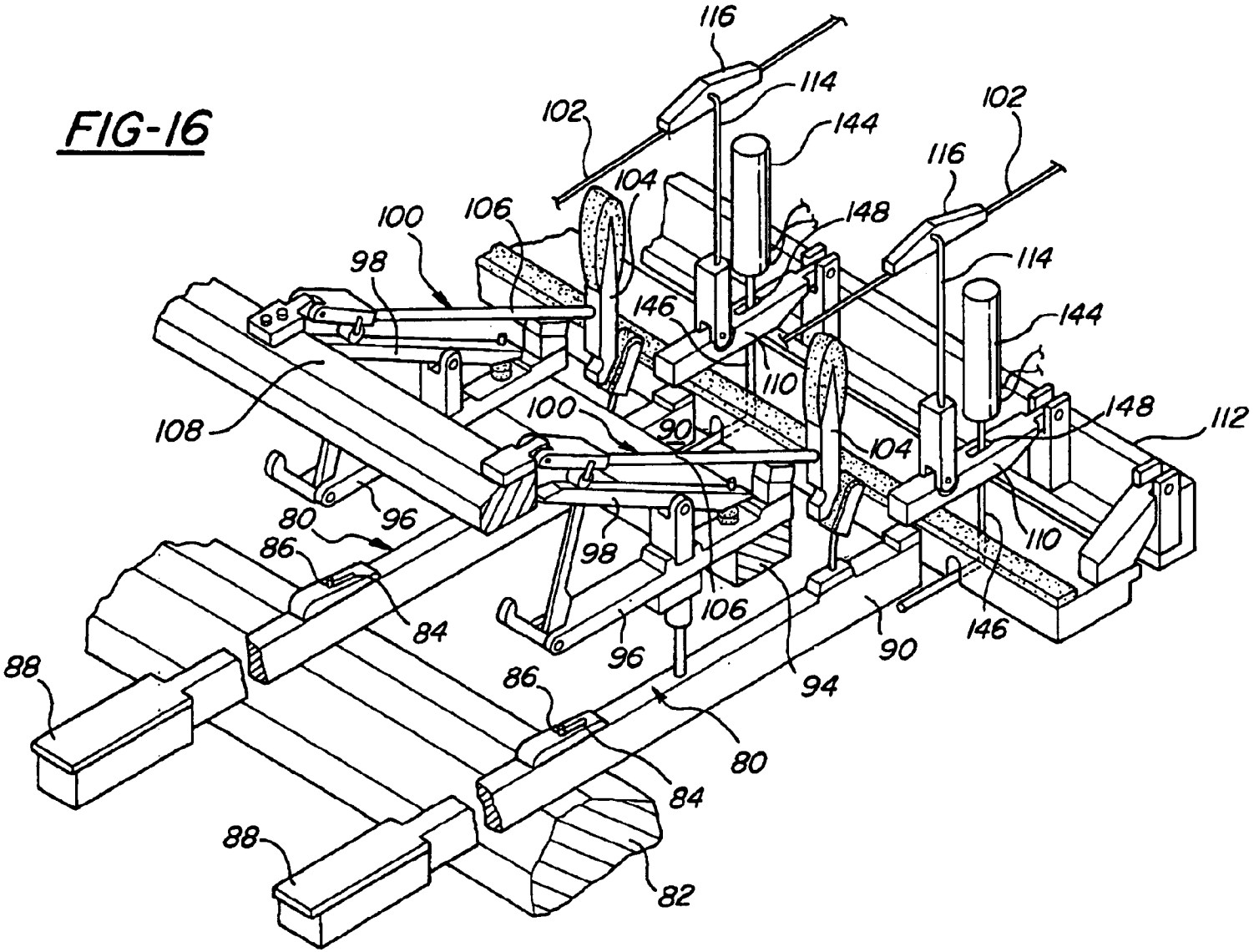
FIG. 16 is a perspective view of two keys from a typical grand piano along with their corresponding key actions and back or damper actions, showing pull solenoids installed in the back actions and designed to lift the rear portion of the keys.

As discussed above, grand pianos are those pianos in which the strings are arranged horizontally. A typical grand piano is shown in FIG. 12. FIGS. 13 and 16 show two views of a typical key action, which controls striking of the strings, and a back action, which controls damping of the strings, for a grand piano. FIGS. 13 and 16 also show key actuation systems, the workings of which will be later described. FIG. 13 shows an elevational side view of a single key and key action while FIG. 16 shows a perspective view of two keys in their associated key actions and back actions. Reference will be made commonly to both of these drawings during the following discussion of the internal workings of a grand piano. The key action includes an elongated key 80 which is pivotally supported near its center by a balance rail 82 where the key 80 has a pivot or fulcrum hole 84 surrounding a fulcrum pin 86 that extends upwardly from the balance rail 82. The fulcrum hole 84 is elongated so as to allow the key 80 to tip front to back on the balance rail 82. Key 80 has a front or playing end 88 and a back or action end 90. Key 80 and balance rail 82 are in turn supported by a generally horizontal key frame 92 as shown in FIG. 13. When the piano is played in its normal mode, an operator pushes down on the playing end 88 of the key 80 causing the key 80 to pivot or tip on the balance rail 82 so that the action end 90 of the key 80 moves upwardly. The key action portion of the piano also includes a wippen flange rail 94 which extends side to side in the piano a short distance above the action end 90 of all of the keys 80. The wippen flange rail 94 is a structural piece designed to support portions of the key action. The wippen flange rail 94 may be made out of metal or out of wood. The wippen flange rail 94 remains stationary as the key 80 and key action are manipulated. A wippen 96, also called a grand lever, is pivotally attached to the wippen flange rail 94 and extends generally horizontally over the action end 90 of the key 80 toward the fulcrum pin 86. When a user plays the piano, depressing the front end 88 and causing the action end 90 of the key 80 to move upwardly, the key 80 pushes on the wippen 96 causing it to pivot upwardly. The wippen 96 in turn pushes on a repetition lever 98 which in turn flicks a hammer 100 upwardly so that it impacts a horizontally positioned string 102. The hammer 100 includes a head 104 and a shaft 106 which is pivotally supported by a hammer rail 108. The hammer rail 108, like the wippen flange rail 94, is a stationary structural piece designed to support a portion of the key action. The hammer rail 108 may be made out of metal or out of wood.

Because of the configuration of the key action, the hammer 100 is flicked upwardly very rapidly enabling the piano to create loud sounds. The details of the key action vary from piano to piano but generally include the components as discussed above.

Also shown in FIG. 16 is the back action portion of a grand piano. The back action, also called a damper action, includes a damper underlever 110 which is pivotally supported by a damper rail 112 positioned at the back of the piano case. The damper underlever 110 extends forwardly from the damper rail 112 so that its other end is positioned above the very rear portion of the action end 90 of the key 80. Therefore, as the key 80 is pivoted, the action end 90 of the key 80 lifts upwardly on the damper underlever 110. A damper rod 114 extends upwardly from the damper underlever 110 to a damper 116 which in its normal position rests atop the string 102. When the key 80 is struck, the damper 116 is lifted off of the string 102 by the movement of the damper underlever 110, thereby allowing the string 102 to resonate. As the key 80 is released, the damper 116 falls back into contact with the string 102, thereby dampening the vibration of the string 102.

Referring now to FIG. 13, an embodiment of an actuator for a player piano key action is shown. In this embodiment, a solenoid body or coil 120 is embedded in the wippen flange rail 94 and a corresponding solenoid core or piston 122 extends downwardly from the coil and engages the action end 90 of the key 80. When the solenoid coil 120 is energized, the core or piston 122 is drawn upwardly into the coil thereby actuating the key action and producing a sound.

It should be noted that the word "solenoid" is used throughout this application to refer to an electromechanical actuator. The term is to be interpreted broadly to refer to any type of electromechanical actuator including solenoids, servos, and other devices wherein application of electrical power causes pieces of the device to move relative to one another. The two pieces are referred to herein as a coil and a piston or core. These terms should also be interpreted broadly. Also, more sophisticated electromechanical devices such as dual coil solenoids may be used wherein each of the two moving pieces may be energized thereby increasing the mechanical output of the device.

Figure 18:
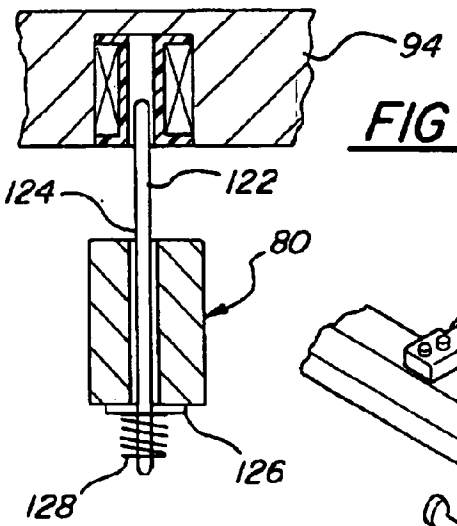
FIG. 18 is a cross-sectional view of a key, the wippen flange rail, and the actuator illustrating the interconnection between the piston and the key.

FIG. 18 shows a cross section of the key 80 and wippen flange rail 94 in the actuator to better illustrate the interconnection between the piston 122 and the action end 90 of the key 80. Referring to both FIGS. 18 and 13, this inner connection will now be described. The piston 122 extends through a hole 124 in the key 80 and extends out the bottom of the key and terminates. A washer 126 and a spring 128 is positioned between the bottom of the key and the key frame. When the coil 120 is energized, the piston 122 is pulled upwardly thereby pulling the key 80 upwardly with it. The washer 126 and spring 128 serve to take up play and prevent noise. The washer 126 may be made of any of a number of materials to optimize this reduction in noise.

Figure 14:
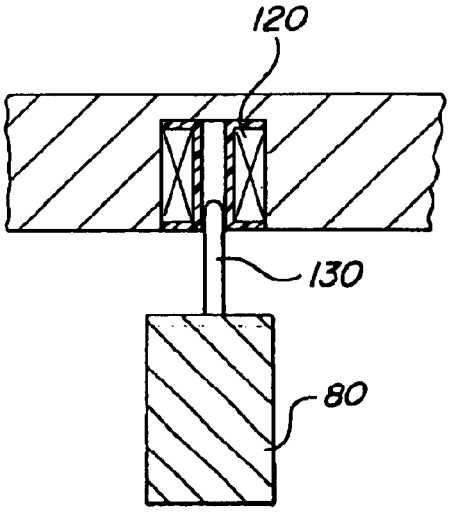
FIG. 14 is a cross-sectional view of a key and actuator for use with the embodiment of FIG. 13, showing an alternative engagement between the key and piston.
Figure 15:
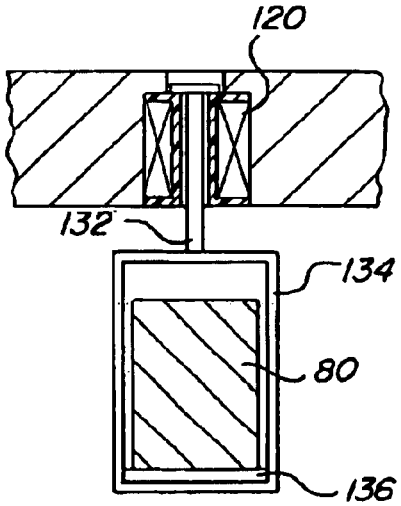
FIG. 15 is a cross-sectional view of a key and actuator similar to FIG. 13 showing an alternative engagement between the piston and the key.

Referring now to FIG. 14, an alternate approach to interconnecting the piston with the key is shown. In this alternative, a piston 130 is embedded directly into the key 80, extending upwardly therefrom into the coil 120. The embodiment of FIG. 13 has the advantage that movement of the key does not necessarily move the piston 122. Therefore, that embodiment minimizes any re-weighting of the key or alteration to the "feel" of the key. The alternative of FIG. 14, on the other hand, slightly weights the key by making the piston 130 a portion thereof. However, for some applications, as will be discussed later, it is desirable to have the piston 130 move with the key 80. This alternative accomplishes this objective. Referring now to FIG. 15, a variation on the embodiments of FIGS. 14 and 18 is shown. In this variation, a piston 132 includes a loop 134 which surrounds the key 80. When the coil 120 is energized, the piston 132 is pulled upwardly thereby pulling the loop 134 and the key 80 upwardly. An optional pad, cushion, or spring 136 may be placed between the underside of the key 80 and the loop 134 to prevent noise. The variation of FIG. 15 has an advantage over the embodiment of FIGS. 14 and 18 in that the key 80 is not modified and therefore the weight of the key 80 is not changed.

In practice, a method for installing an above discussed embodiment of the invention involves the removal of the key action from the piano and then removing all 88 wippens from the key action. The solenoid coil or body 120 is installed in the wippen flange rail 94 by milling a hole perpendicular to the wippen screw hole (used for attaching the wippen). There is one wippen screw hole for each of the keys in the piano. This procedure is done for all 88 wippen screw holes.

Preferably, there is a technique for aligning each solenoid piston 122 with the proper location on each key 80. In one approach, a transfer punch is inserted into the central hole of each of the 88 solenoid bodies to mark the key. This alignment process is executed after the wippen flange rail 94, with the solenoid bodies installed, has been reinstalled.

Referring again to FIG. 13, an additional actuator 138 may be placed in the front of the key frame 92 with the piston 140 extending upwardly into the underside of the key 80. As will be clear to those of skill in the art, one of the actuators may be used without the other to actuate the key 80. However, using both actuators allows for greater dynamic range and for cooler running actuators. The design illustrated in FIG. 13 also incorporates a limited contact with the key 80. As best shown with the additional actuator 138, the piston 140 terminates inside of an empty space inside of the key 80. As the key 80 is depressed, the key 80 may move without moving the piston 140. The actuator 120 in the wippen flange rail 94 is likewise configured. This arrangement allows the player to actuate the key 80 without moving the pistons of the actuators, thereby avoiding a "weighted" feel to the key.

Referring now to FIG. 16, another embodiment of an actuator mechanism for a player grand piano is shown. In this embodiment, a solenoid 144 is mounted in the back action of the piano with an L-shaped piston 146 extending downwardly and forwardly therefrom such that the piston 146 terminates under the very rear of the action end 90 of the key 80. The L-shaped piston 146 extends through a hole 148 in the damper underlever 110. This embodiment takes advantage of the fact that there is room for a larger solenoid when it is positioned in the back action of the piano. Use of larger solenoids potentially increases the dynamic range of the player piano and also allows the use of less expensive materials and designs for the solenoid 144. A solenoid positioned in this location may be mounted either to the rear of the piano case (not shown) or to the damper rail 112. As discussed earlier, the damper rail 112 is the stationary structural piece on which the damper underlever 110 is pivotally supported.

Figure 19:
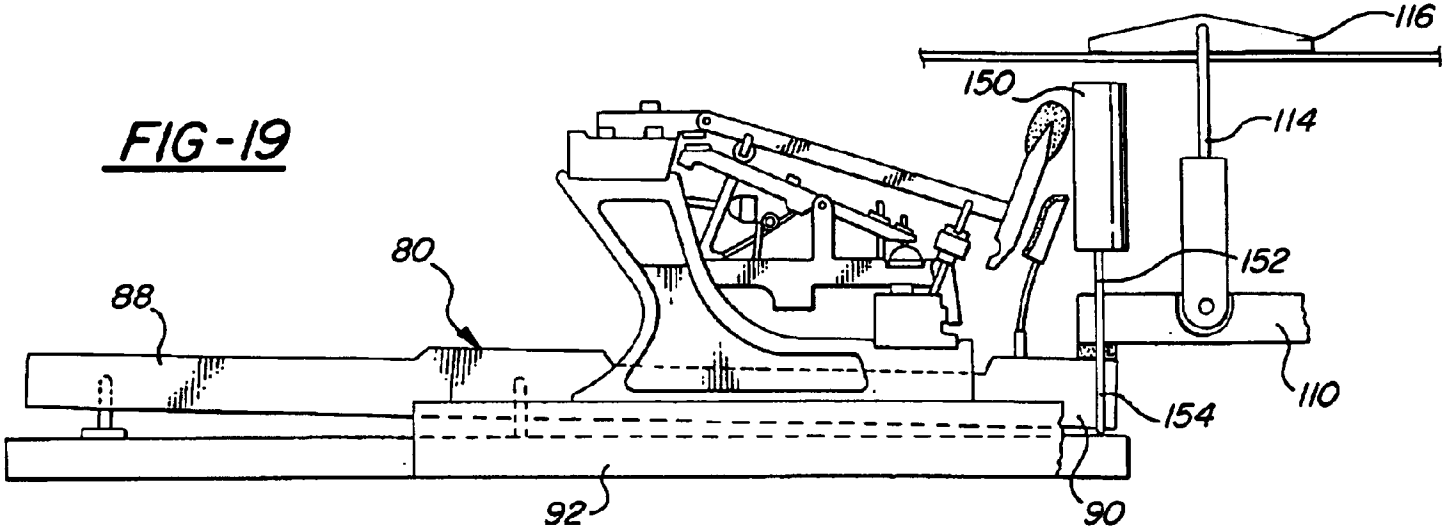
FIG. 19 is a side elevational view of a key, key action, and back action from a typical grand piano with an actuator disposed above the area where the key and the damper underlever overlap.

Referring now to FIG. 19, another embodiment of the present invention for use with grand pianos is shown. In this embodiment, a solenoid 150 is mounted in the back action of the grand piano forward of the damper rod 114. Preferably, the solenoid is positioned directly above where the damper underlever 110 and the key 80 overlap. Piston 152 of the solenoid 150 extends downwardly from the solenoid 150 and terminates in a loop 154 which surrounds both the action end 90 of the key 80 and the end of the damper underlever 110. In this way, actuation of the solenoid coil 150 lifts the key 80 and the damper underlever 110 which sits on top of the key 80. As discussed in an earlier embodiment, a pad or spring may be located between the underside of the key 80 and the loop 154 to help prevent play and noise. A spring (not shown) may also be positioned between the underside of the loop and the key frame to preload the piston. Also, the loop 154 may be taller than shown to allow the key to be played without moving the piston. The coil 150 may be mounted either to the rear of the piano case or to the damper rail 112 by means of an offset rail. Such an offset rail would run end to end in the piano and be solidly interconnected with either the damper rail 112 or the piano case. It is most preferred that the solenoid coil 150 be mounted to damper rail 112 by means of an offset rail. In this way, the player piano actuating mechanism can be removed from the piano case along with the damper or back action.

Figure 17:
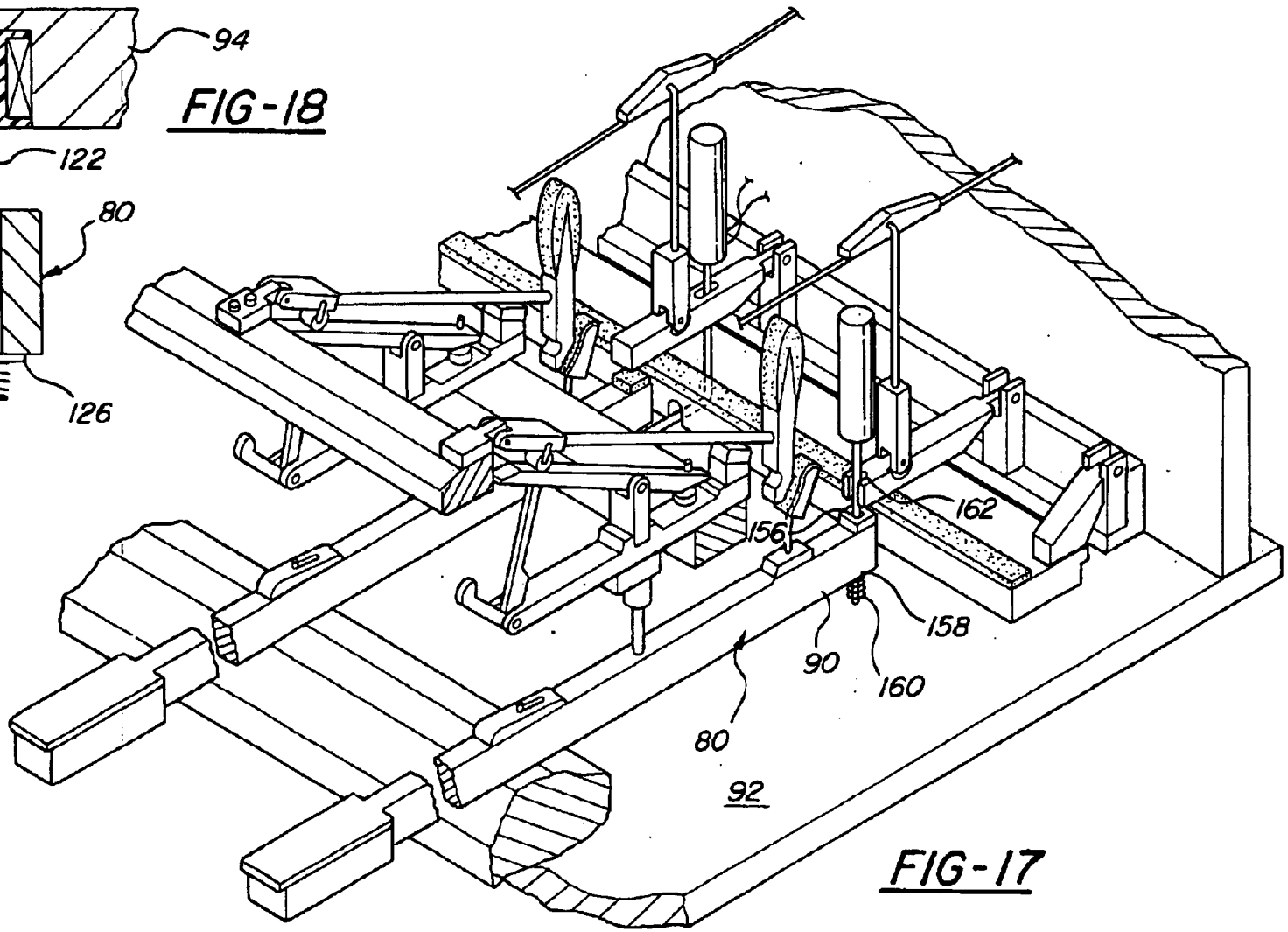
FIG. 17 is a perspective view similar to FIG. 16 showing an alternative arrangement of a pull type solenoid mounted in the back action of the piano.

As will be clear to one of skill in the art, the solenoid configuration shown in FIG. 19 may be interconnected to the key 80 in several ways. For example, as shown in FIG. 17, a hole may be drilled through the rear end 90 of the key 80 with an elongated piston 156 passing therethrough with a fixed washer 158 and spring 160 between the key 80 and the key frame 92. A hole or slot 162 is also provided through the end of the damper underlever 110.

As will be clear to one of skill in the art, a solenoid can be mounted farther forward to a position just ahead of where the damper underlever 110 ends, thereby preventing the need to drill a hole through the damper underlever 110. In this configuration, if a loop were used, as shown in FIG. 19, the loop could be made smaller since it no longer needs to surround the end of the damper underlever 110. This configuration of the actuator mechanism allows a large amount of room for the solenoid, thereby allowing the use of less sophisticated and/or more powerful solenoids.

Figure 20:
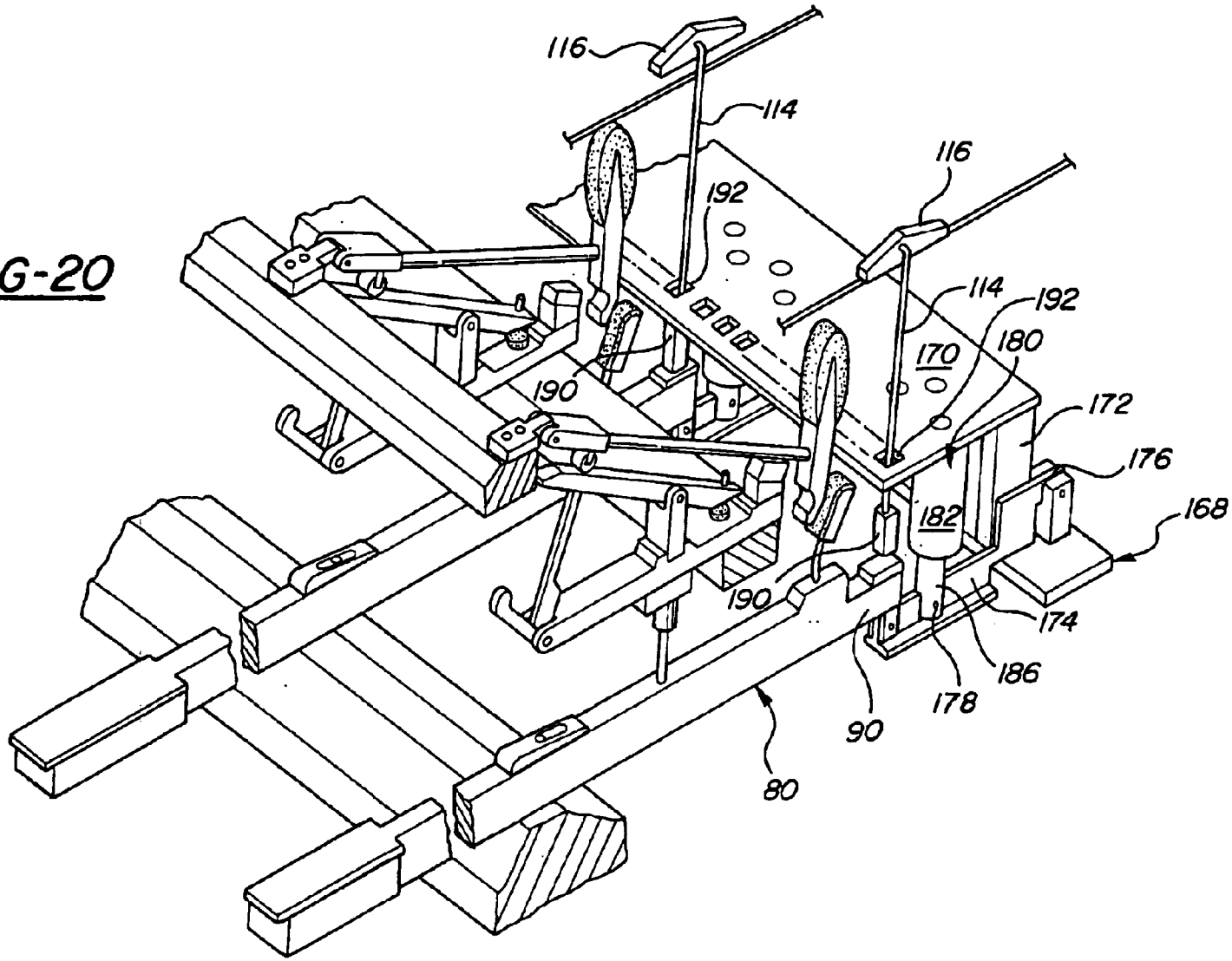
FIG. 20 is a perspective view of a pair of keys from a typical grand piano along with their corresponding key actions, showing an actuator system installed to the rear of the keys and lifting the keys via actuator underlevers.
Figure 21:
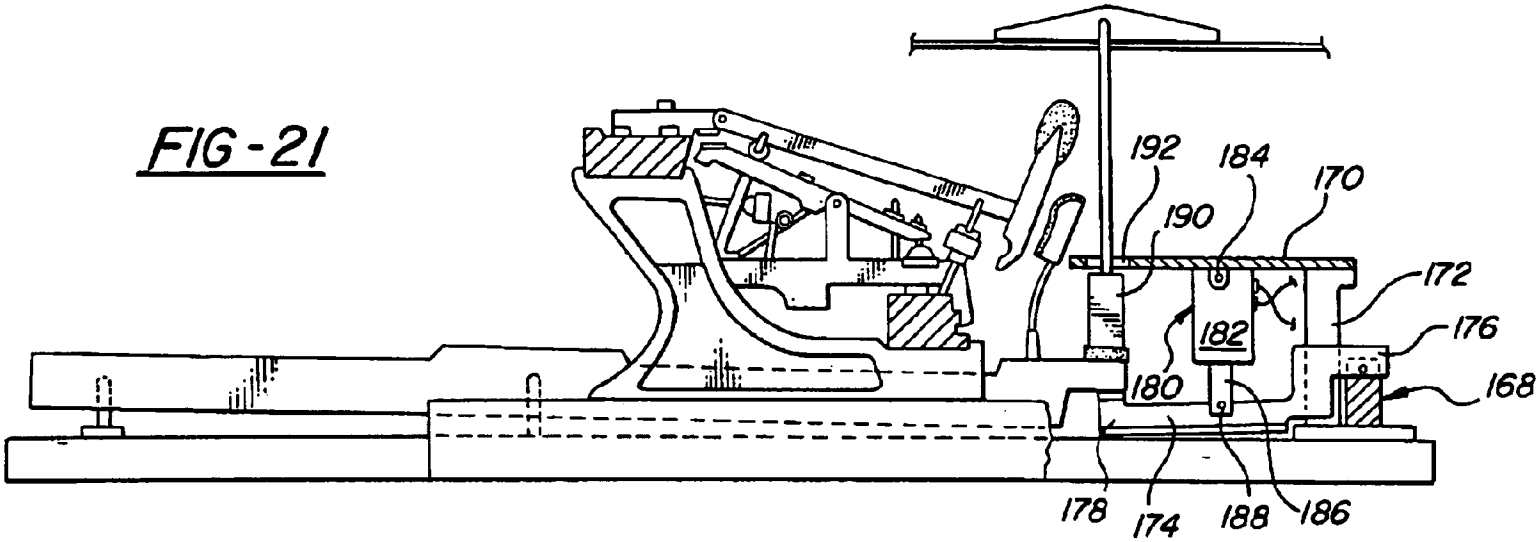
FIG. 21 is a side elevational view of a single key and key action from a typical grand piano with an actuator system installed to the rear of the key and lifting the key using an actuator underlever.

Referring now to FIGS. 20 and 21, another embodiment of an actuation system according to the present invention is shown. In this actuator system, a bracket 168 is mounted in the back action of the piano below the traditional position for damper under levers. The bracket 168 includes a generally horizontal roof 170 that is supported above the base of the key frame 92 by roof support columns 172. The roof 170 is a generally continuous member and the support columns 172 may be either a plurality of individual columns or a continuous support. An actuator under lever 174 is pivotally supported at its rear end 176 by the bracket 168 and extends forwardly with its forward end 178 positioned under the rear end 90 of the key 80. An electromechanical actuator 180 hangs downwardly from the roof 170 of the bracket 168 so that the coil or body 182 is supported just below the roof 170. The coil or body 182 is supported in this position by a support 184 that allows slight pivotal movement of the actuator 180. The actuator 180 is preferably a pull-type actuator with the piston 186 extending downwardly out of the bottom of the coil 182 where it attaches to a mid portion of the actuator under lever 174 with a pivotal connection 188. When the actuator 180 is energized, the piston 186 is drawn upwardly into the coil 182 thereby pivoting the actuator under lever 174 upwardly. This lifts the forward end 178 of the actuator under lever 174 upwardly causing the back end 90 of the key 80 to move upwardly as if it were struck by a human player.

Alternating actuators may be positioned forwardly or rearwardly of their adjacent actuator to allow room for wider actuators. As shown in FIGS. 20 and 21, this embodiment of the present invention requires an actuator that is very compact vertically so as to allow the actuator to be packaged in the limited space below the existing damper under lever. However, this approach avoids unnecessary modifications to the case of the piano as it takes advantage of an area of unused space in the back action of the piano.

As shown, the actuator system takes the place of the typical damper under lever as was shown in earlier figures and therefore other provisions for lifting the damper 116 from the string 102 must be made. One approach to relocation of the damper system is shown in FIGS. 20 and 21. In this approach, a damper lift foot 190 is positioned atop the rear end 90 of the key 80 and is housed in a guide hole 192 cut into the roof 170 of the bracket 168. The damper rod 114 extends upwardly from the foot 190 to the damper 116 so that upward movement of the rear end of the key 80 causes the damper 116 to be lifted from the string 102. The position of the damper 116 on the string is important for proper performance of the damper. Therefore, it may be necessary to reshape the damper 116 so as to position it rearwardly of where shown so that it is in the same position as with a traditional damper under lever. It is preferred that the foot 190 have a felt and/or delrin® bottom portion so as to cushion and allow sliding movement between the foot 190 and the key 80. This is also desirable between the front ends of the under levers and the bottom side of the keys so as to reduce noise and friction in the system.

Figure 22:
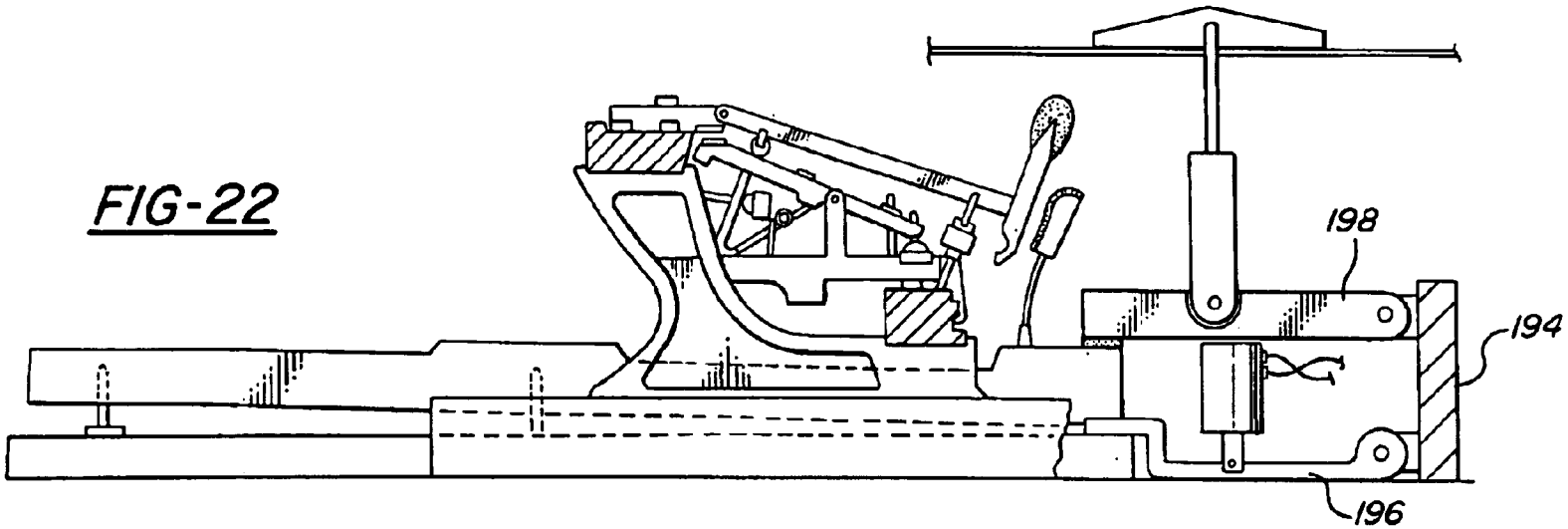
FIG. 22 is a side elevational view similar to FIG. 21 showing an alternative actuator using an actuator underlever.

An alternative approach to relocating the damper system is shown in FIG. 22. In this embodiment, a different bracket 194 is used which supports both an actuator under lever 196 and a damper under lever 198, as shown. This embodiment has the advantage of retaining the traditional damper under lever arrangement but requires an even shorter actuator.

Figure 23:
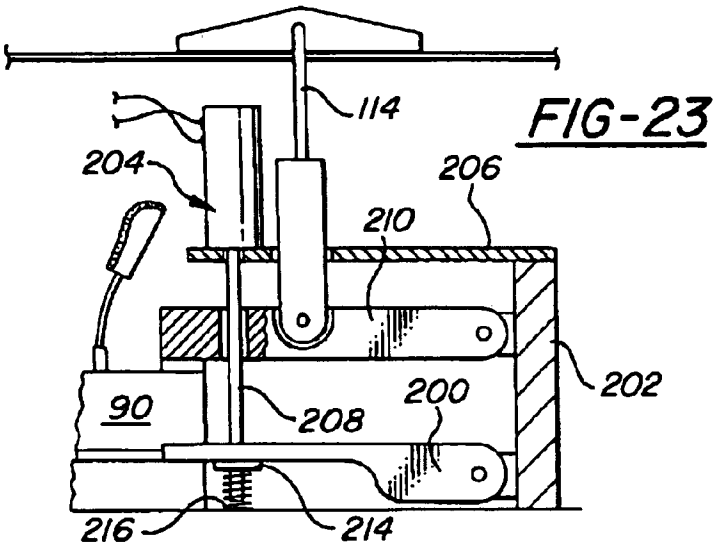
FIG. 23 is a detailed view of an actuator system for installation to the rear of a key that uses an actuator underlever to lift the rear of the key.

Referring now to FIG. 23, another alternative approach to lifting an actuator under lever is shown. As in the previous embodiments, an actuator under lever 200 is pivotally supported by its rear end by a bracket 202 and extends forwardly so that its forward end is positioned underneath the rear end 90 of a key. Rather than the approach taken in FIGS. 21 and 22, an actuator body 204 is positioned above the roof 206 of the bracket 202 with its piston 208 extending downwardly through a damper under lever 210 and the actuator under lever 200, both pivotally supported by the bracket 202. Alternatively, the piston may pass around the levers 210 and 200 rather than through holes in them. As shown, the piston 208 is terminated in a fixed washer 214 with a spring 216 positioned below the front end of the actuator under lever 200 so that energizing the actuator 204 causes the actuator under lever 200 to be drawn upwardly as the piston 208 is drawn into the actuator 204.

Figure 24:
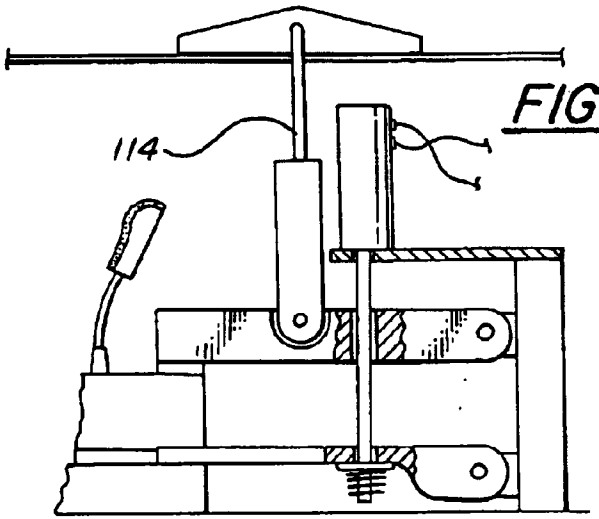
FIG. 24 is a detailed view of a system similar to FIG. 23 with the actuator moved rearwardly.

FIG. 24 illustrates how the arrangement of FIG. 23 may be modified by moving the actuator rearwardly to a position behind the damper rod 114. Otherwise, it operates similarly to the embodiment of FIG. 23.

Figure 25:
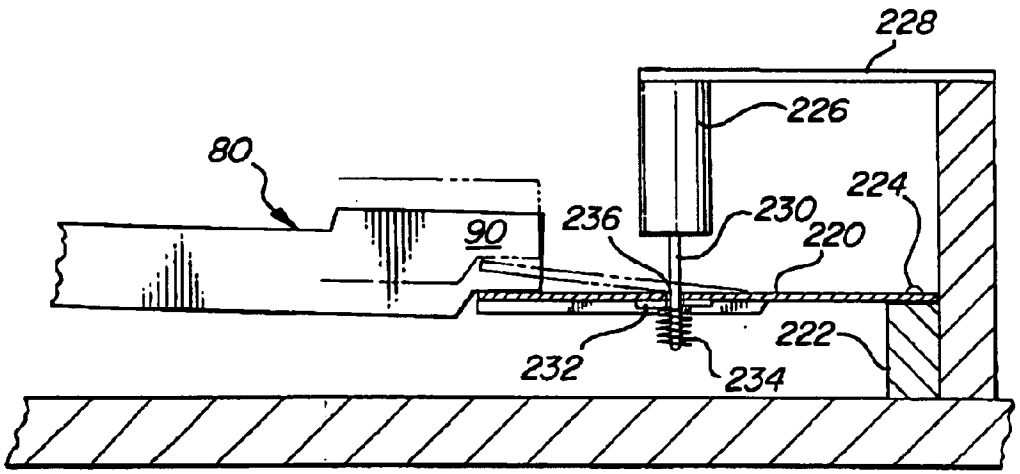
FIG. 25 is a side elevational view of the rear of a key and an actuator system using a flexible actuator underlever to lift the rear of a key.

Referring now to FIG. 25, another embodiment of an actuator system according to the present invention is shown installed in the back action of a grand piano. This embodiment is similar to the embodiments in FIGS. 21–24 except in the following respects. First, the embodiment of FIG. 25 uses a flexible lift lever 220 which extends forwardly from a lift lever mounting block 222 to a position under the rear end 90 of the key 80. The flexible lift lever 220 is shown in solid lines in its natural unflexed position and in phantom lines in its flexed position. Because the lift lever 220 is flexible, a pivot is not required at its rear end, thereby simplifying the actuator system. The flexibility of the member may vary along its length. For example, it may be more flexible near the mounting block 222 and more rigid further from the block. The flexible lift lever may be made from any of a number of flexible materials including plastics and other synthetic materials, as well as spring steel. The flexible lift lever 220 may be connected to the mounting block 222 using a mounting screw 224, or may be attached in other ways. The embodiment of FIG. 25 also differs from the embodiment of FIG. 20 in that the solenoid body 226 is rigidly mounted to the roof 228 rather than being pivotably attached. This simplifies the mounting of the solenoid body 226 and reduces the opportunity for noise and wear. A solenoid piston 230 extends downwardly from the solenoid body 226 and extends through the flexible lift lever 220 to a lower end that has a lifting washer 232 and a spring 234 disposed thereon. Obviously, the flexible lift lever 220 has a hole 236 therein for the piston 230 to pass through. Preferably, this hole 236 is elongated to allow some relative movement side to side and front to rear as the piston 230 draws the flexible lift lever 220 upwardly. The flexible lift lever 220 has the added advantage that it downwardly loads the piston 230 to assist in lowering the actuator system back to a starting position. This allows more precise control of the key 80. As an additional aspect of the present invention, the flexible actuator underlever 220 described in FIG. 25 has additional applications. For example, the traditional damper underlever, such as shown in FIGS. 23 and 24, may be replaced with a flexible damper underlever design similar to the actuator underlever 220. That is, the lever will be flexible and mounted at its back side to a bracket, to extend forwardly to a position above the back of the key. The damper rod would be connected to a midportion of this flexible damper under lever and extend upwardly to a damper. Once again, any of a variety of materials may be used and the flexibility of the flexible damper under lever may be tuned for particular applications. For example, it may be desirable to have the damper under lever exert a slight downward force on the back of the key to assist return of the damper and key to the rest positions.

Figure 26:
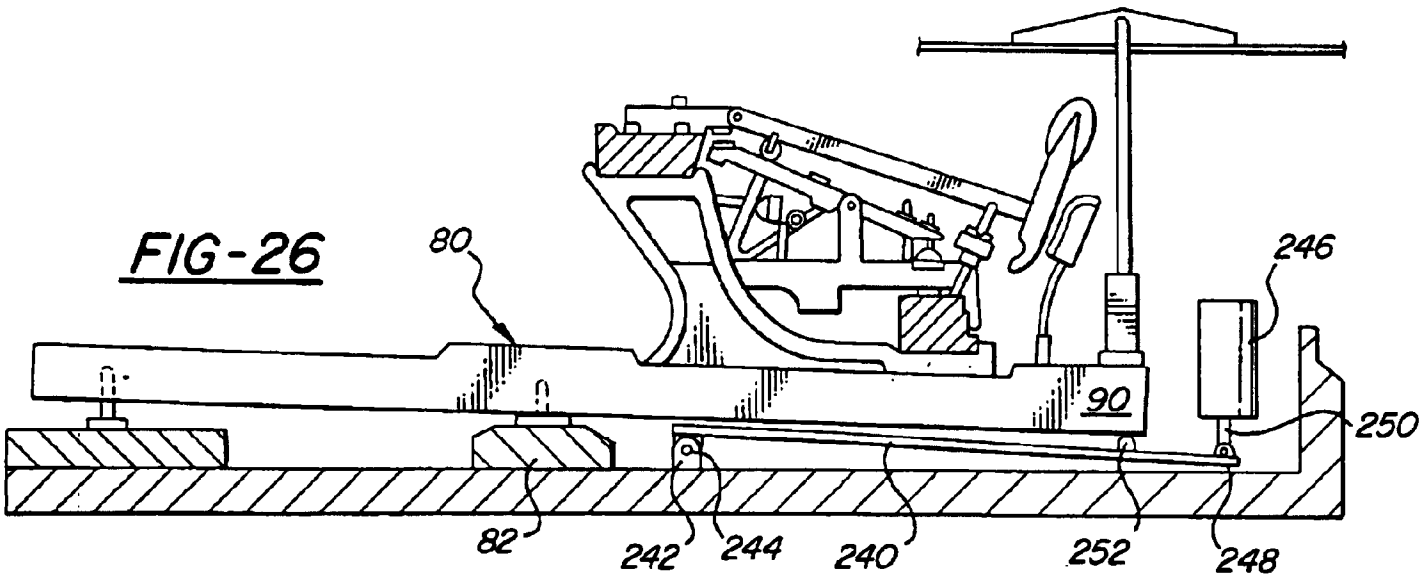
FIG. 26 is a side elevational view of a single key and key action from a typical grand piano with an actuator system installed to the rear of the key and lifting the rear of the key via a lever which is pivotally attached to the key frame forward of the rear end of the key.

Referring now to FIG. 26, yet another embodiment of an actuator system is shown installed in the back action of a grand piano. In this embodiment, a lift lever 240 is positioned below the rear end 90 of the key 80 such that a midportion of the lift lever 240 is directly below the rearmost portion of the key 80. One end of the lift lever 240 is pivotally supported by a fulcrum pillow block 242 with a pivot point 244. This pillow block 242 is positioned between the rear end 90 of the key 80 and the fulcrum 82 and mounted to the key frame 92. From the pillow block 242, the lift lever 240 extends rearwardly to a position behind the rear end 90 of the key 80. An electromechanical actuator 246 is supported above the rear end 248 of the lift lever 240 with the piston 250 of the actuator 246 extending downwardly and connecting to the rear end 248 of the lift lever 240. Therefore, energizing actuator 246 causes the rear end 248 of the lift lever 240 to be pulled upwardly. A lift lever damping pad 252 is disposed atop the midportion of the lift lever 240 immediately below the rear end 90 of the key 80 so that the pad 252 pushes upwardly on the underside of the rear end 90 of the key 80 when the actuator 246 is energized. This embodiment allows for flexibility in mounting the actuator 246 and also allows the lift lever to be reconfigured so as to change the power versus stroke requirements of the actuator 246. Though not shown, the actuator 246 may be mounted to the key frame by a bracket or in other ways. As an alternative preferred embodiment, the piston 250 of the actuator 246 may have an eyelet or loop at its end which surrounds the rear end 248 of the lift lever 240. Then, the actuator 246 may be mounted to the body of the piano while the remaining portions of the lift lever 240 are mounted to the key frame 92. The rear end 248 of the lift lever 240 would engage the eyelet or loop portion of the piston 250 when the key frame was installed in the piano. This would reduce the weight of the key frame making it somewhat easier to install. FIG. 26 shows the damper being actuated in a manner similar to that discussed with respect to FIGS. 20 and 21. However, other approaches to actuating the damper may also be used.

Figure 27:
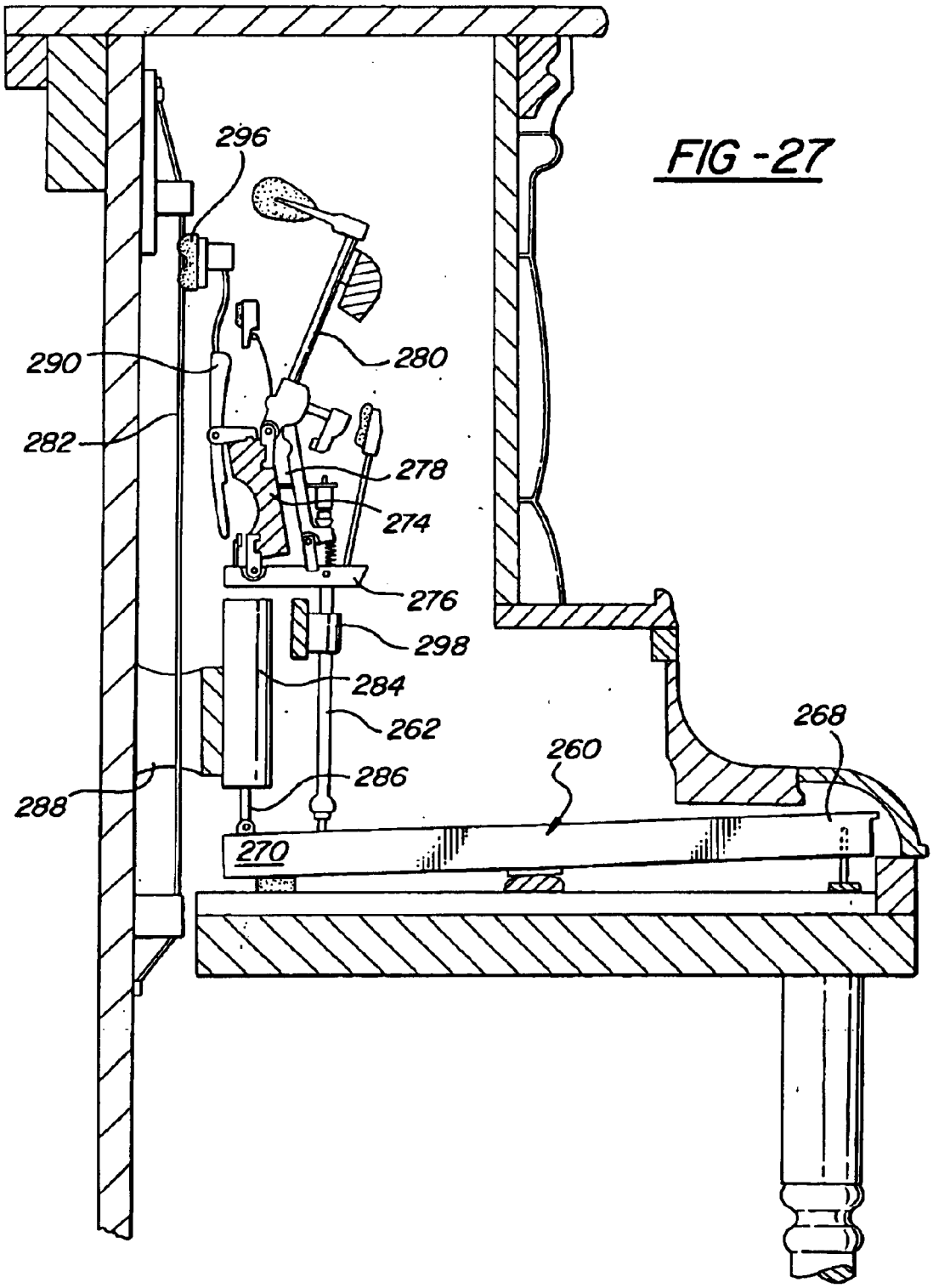
FIG. 27 is a cross-sectional side elevational view of a typical upright piano with a standard tall key action showing two variations on actuators mounted above the rear portion of the key.

We will now turn our attention to upright pianos. As discussed earlier, upright pianos are those pianos in which the strings run vertically. An example of a standard upright piano is shown in FIG. 27. As defined herein, this piano is considered to have a tall key action. Actually, the key action shown in FIG. 27 is considered typical or standard for an upright piano. However, other "upright" pianos have shortened key actions or drop key actions designed to decrease the overall height of a piano. Therefore, this standard key action is referred to as a tall key action. As with the earlier described grand piano, an upright piano with a tall key action includes a key 260 which is pivotally supported so that action end 270 of the key 260 rises when the front or playing end 268 of the key 260 is struck. The action end 270 of the key 260 pushes up on a sticker 262 which in turn pushes up on a wippen or action lever 276 which is supported by a wippen flange rail 274. This in turn pushes up on a jack 278 which flicks the hammer 280 into the string 282 causing a note to be played. As stated previously, the action lever or wippen 276 is pivotally supported by the wippen flange rail 274. As the wippen 276 pivots, the end of the wippen 276 opposite where the sticker 262 attaches actuates a damper lever 290 which in turn lifts a damper 296 off of the string 282 allowing it to resonate.

Figure 28:
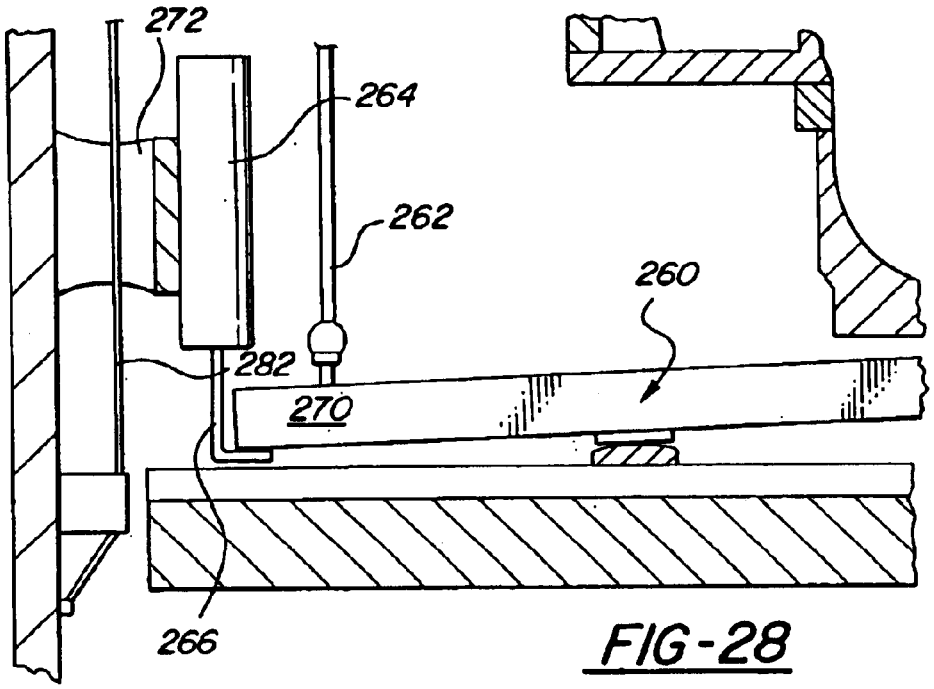
FIG. 28 is a cross-sectional detailed view of a portion of the piano shown in FIG. 27, illustrating an alternative embodiment of an actuator for lifting the rear of the key.

Referring now to FIG. 28, a first embodiment of an actuation mechanism for a tall upright key action is shown. In this embodiment, a solenoid 264 is mounted between the string 282 and the sticker 262 with an L-shaped piston 266 extending downwardly and forwardly under the action end 270 of the key 260. The solenoid 264 is mounted to the piano case by means of brackets 272 or a rail fixed to each side of the piano case. Actuation of the solenoid 264 causes the action end 270 of the key 260 to lift thereby actuating the key action in a normal manner.

Referring again to FIG. 27, another embodiment of an actuator mechanism for a standard upright piano with a tall action is shown. In this embodiment, a solenoid 284 is mounted just forward of the position in FIG. 28 so that the piston 286 is located directly above the action end 270 of the key 260 and behind the sticker 262. Piston 286 extends downwardly from the solenoid 284 and interconnects with the action end 270 of the key 260. The solenoid 286 is mounted to the piano case via brackets 288.

Figure 29:
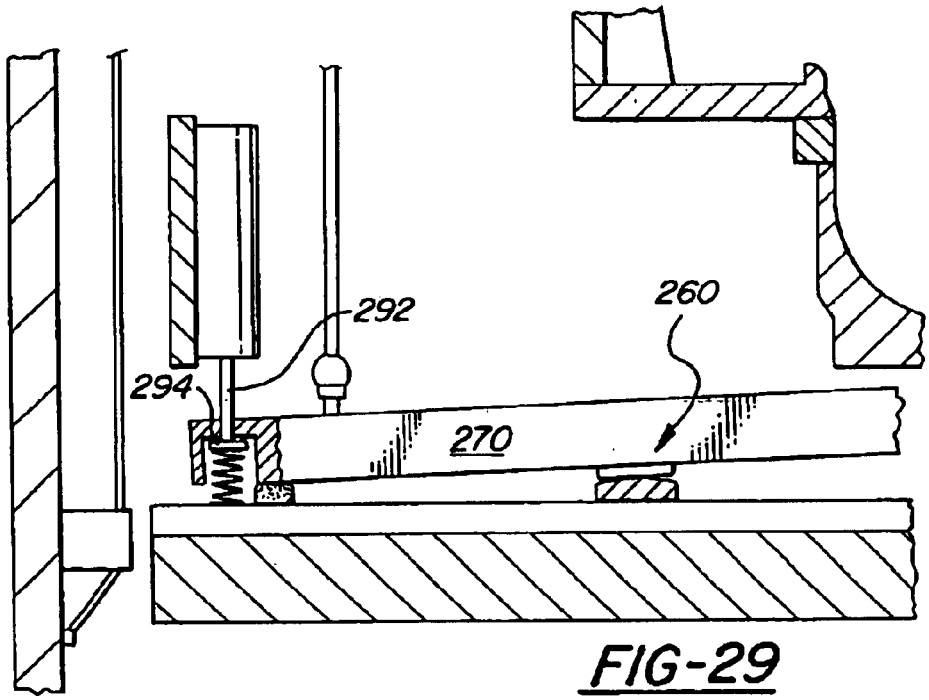
FIG. 29 is a view similar to FIG. 28 showing yet another alternative embodiment of an actuator for lifting the rear of the key.

FIG. 29 shows yet another embodiment. In this embodiment, the piston 292 passes through the action end 270 of the key 260 and terminates in a fixed washer in a recess in the underside of the key. This interconnection is similar to the interconnection discussed previously for grand pianos.

Figure 30:
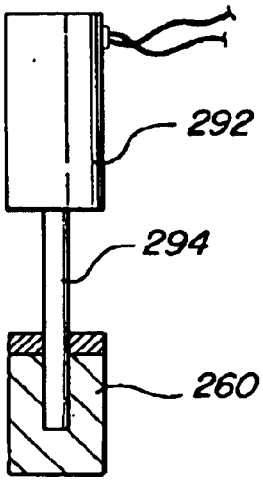
FIG. 30 is a cross-sectional view of a key and a piston and coil of an actuator showing one approach to interconnecting the piston with the key.
Figure 31:
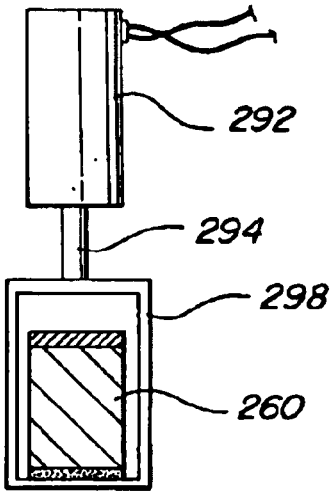
FIG. 31 is a cross-sectional view of a key and a piston and coil of an actuator showing another approach to interconnecting the piston with the key.
Figure 32:
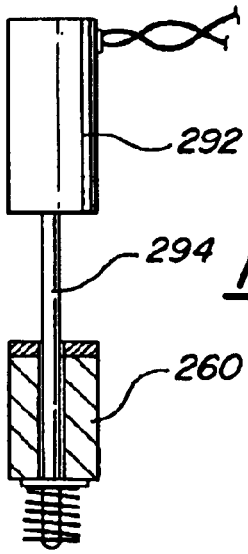
FIG. 32 is a cross-sectional view of a key and a piston and coil of an actuator showing yet another approach to interconnecting the piston with the key.

Referring now to FIGS. 30–32, the various interconnection approaches are shown for use with the previous embodiments. As before, a solenoid 292 and the key 260 may be interconnected in one of a number of ways. In FIG. 30, the piston 294 is embedded in the key 260 so that the key moves with the piston. In FIG. 31, the piston 294 includes a loop 298 which surrounds the key 260 so that it may lift the key 260. In FIG. 32, the piston 294 passes through a hole and out through the bottom of the key 260 where it terminates. A spring and a fixed washer are positioned between the key frame to take up play and to prevent noise.

As another alternative, a solenoid may be mounted forward of the sticker 262 above the action end 270 of the key 260 with the piston extending downwardly to the key 260. Solenoids would be mounted to the case or the wippen flange rail 274 via an offset rail. Also, the solenoid may be moved up or down or changed in size.

Referring again to FIG. 27, yet another embodiment of an actuator for an upright piano is shown. A small solenoid body 298 is shown surrounding a portion of the sticker 262. In this embodiment, a portion of the sticker 262 would be made from ferromagnetic material such that when the solenoid body 298 is energized, the sticker 262 is moved upwardly. Obviously, the solenoid 184, also shown in FIG. 27, would not be used in the embodiment using the solenoid body 298. As will be clear to those of skill in the art, the sticker 262 does not move linearly upwardly and downwardly, but instead exhibits a complex motion. Therefore, the bore through the center of the solenoid body 298 is preferably ovalized to accommodate the complex motion of the sticker 262. It should also be noted that movement of the sticker 262 does not necessarily move the key 260. In some upright pianos, the sticker 262 merely rests atop the rear end 270 of the key 260. Therefore, lifting the sticker 262 upwardly may not necessarily lift the rear end 270 of the key 260. However, the lower end of the sticker 262 may be interconnected with the rear end 270 of the key 260 so that they move together.

Figure 34:
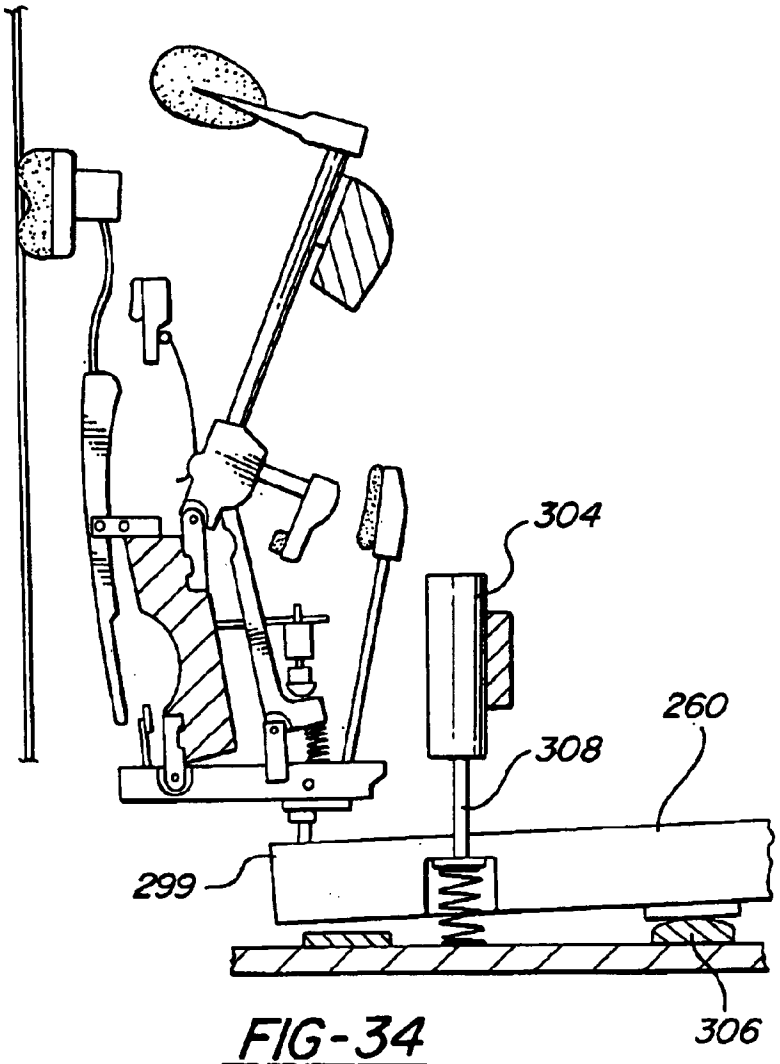
FIG. 34 is a view similar to FIG. 33 showing an alternative actuator for lifting the rear of the key.
Figure 33:
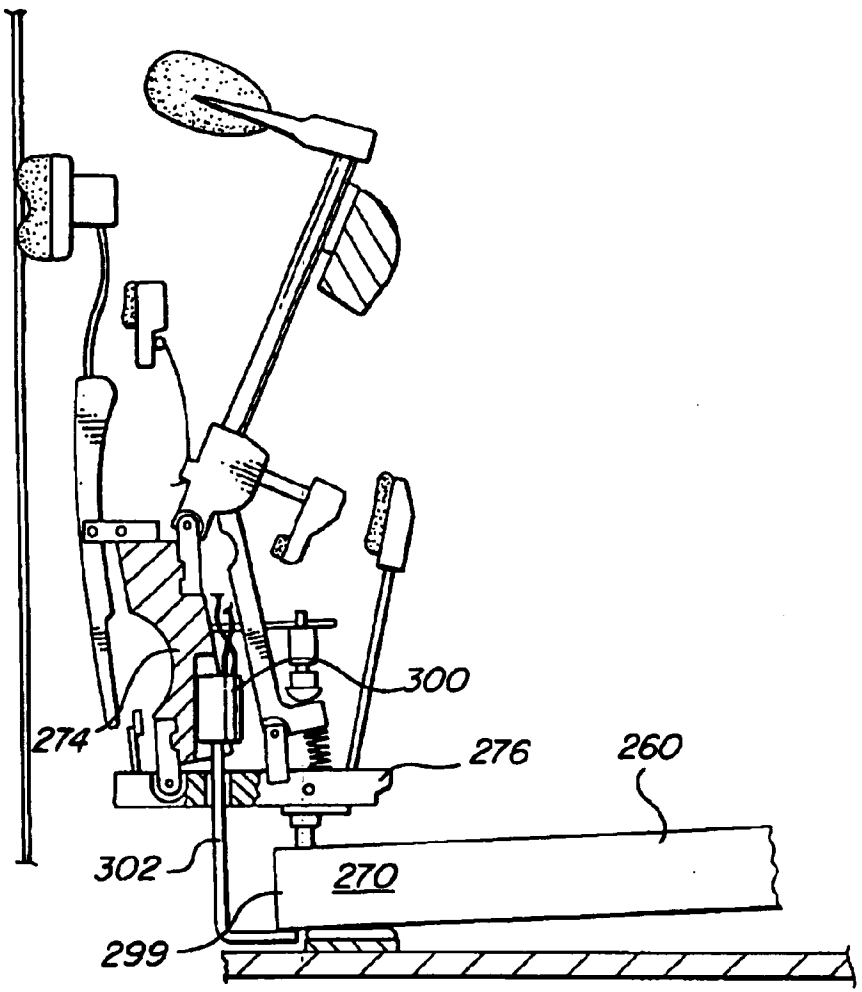
FIG. 33 is a cross-sectional side elevational view of a portion of a key, key action and damper action from a standard upright piano having a shortened key action, showing an actuator installed above the key and having a piston lifting the key from below.

In order to reduce the overall height of standard upright pianos, console and spinet pianos were developed. These pianos have a lower overall height which reduces the amount of room available for the key action. Therefore, shortened key actions were developed. Referring to FIGS. 33 and 34, a typical shortened key action is shown. Comparing this figure with FIG. 27, it can be seen that a shortened key action is very similar to the tall key action except that the sticker 262 does not appear. Instead, a capstan button transfers movement from the key 260 to the action lever or wippen 274. Otherwise, the shortened key action operates in the same manner and therefore will not be described in detail. It should be noted that the rear edge 299 of the key 260 may be positioned differently relative to the remainder of the key action depending on the make and model of the piano.

Referring now to FIG. 33, a first embodiment of an actuator mechanism for a short action upright is shown. In this embodiment a solenoid 300 is mounted to the wippen flange rail 274 with a piston 302 that extends downwardly to engage the key 260. As shown in FIG. 33, the piston 302 is L-shaped and extends downwardly through the wippen 276 and then forwardly to a position under the back or action end 270 of the key 260. Alternatively, if the key 260 is longer than shown in FIG. 33, the piston 302 may engage the key 260 in other ways, as shown in FIGS. 30–32. Though not shown, the solenoid 300 could be positioned forward of the strings 282 but behind the wippen 276 with an L-shaped piston 302 extending downwardly and forwardly therefrom to a position beneath the rear of the key 260.

Referring now to FIG. 34, another embodiment of an actuator mechanism for a short key action upright piano is shown. In this embodiment, a solenoid 304 is mounted forward of the key action and behind the fulcrum 306 with a piston 308 extending downwardly therefrom. Solenoid 304 may be mounted to the hammer rail, the wippen flange rail, the piano case, or any other stationary part of the piano. The piston may be interconnected to the key 260 in any of the ways shown in FIGS. 30–32.

Figure 35:
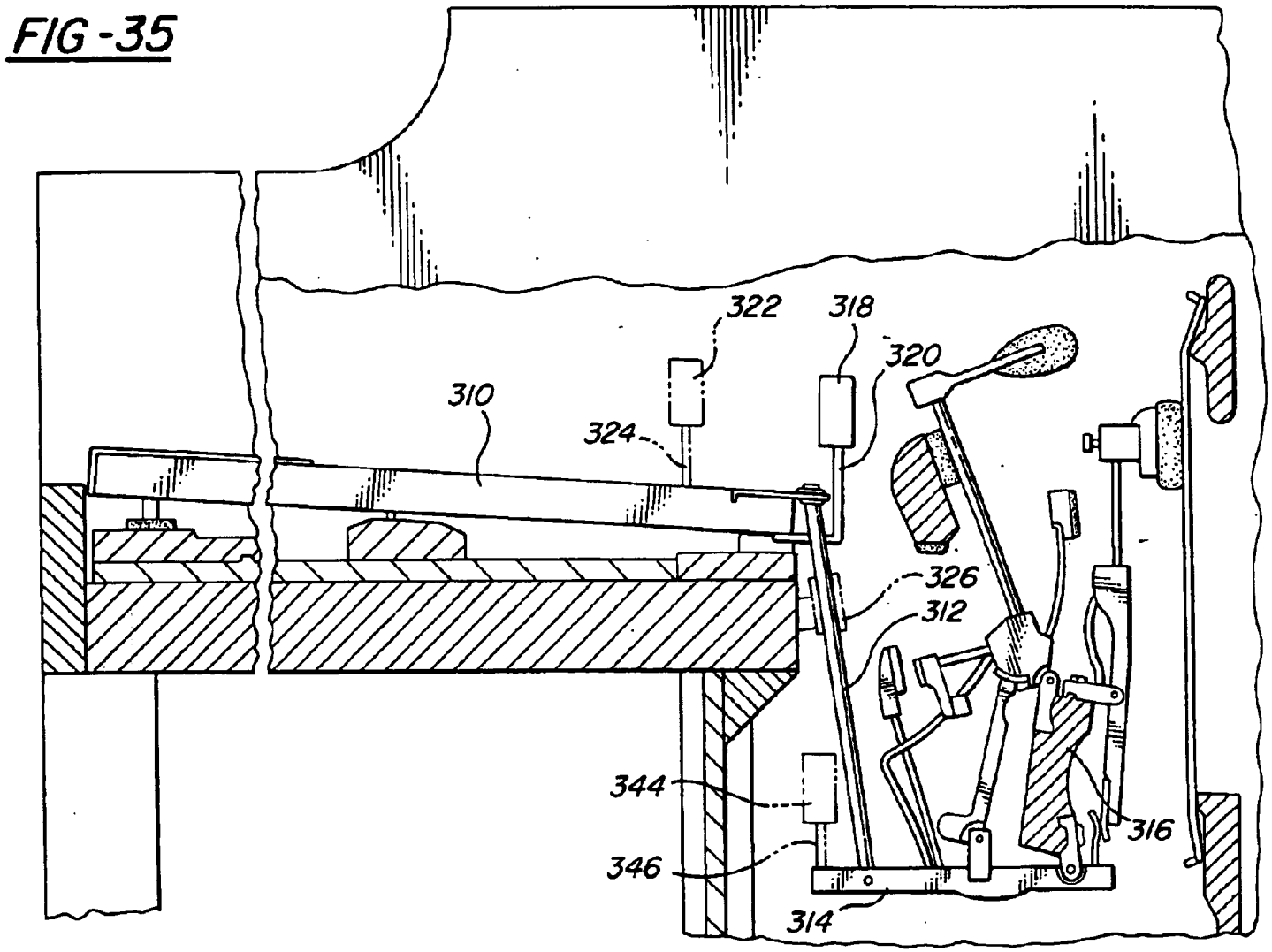
FIG. 35 is a cross-sectional side elevational view of a typical drop action piano showing four alternative approaches to using actuators to move the key or key action.

Referring now to FIG. 35, a third type of upright piano is shown. This type of piano is known as a drop action piano because a portion of the key action is "dropped" below the level of the key bed. In this type of piano, the rear of the key 310 is connected to a sticker or absract 312 which extends downwardly therefrom. The abstact 312 is in turn connected to a wippen 314 which is pivotally supported by a wippen flange rail 316. Beyond this point, the key action of the drop action piano is similar to the other types of uprights.

It should be noted that each of the previous embodiments shown in FIGS. 13–35, a pull type solenoid is used. Pull solenoids should only provide the advantage that they produce additional force as the piston is drawn into the coil. This is the opposite of a push type solenoid wherein the force output of the solenoid falls off as the piston is pushed out of the coil. The use of pull type solenoids is especially beneficial for the application of player pianos because the force curve of a pull type solenoid more closely matches the force profile necessary to properly play the keys. Also, pull type solenoids tend to be stronger than similarly sized push type solenoids. It should also be noted that in each of the embodiments shown in FIGS. 13–35, that at least a portion of the solenoid body or coil is mounted above the key which it actuates. By above the key, it is meant that at least a portion of the solenoid body or coil is disposed above the lowest portion of the key in its rest position. This differs from the prior art wherein solenoids are mounted below the keys. As shown in the figures, the solenoid coil or body in some embodiments is mounted much higher than any portion of the key while in others, especially the embodiment of FIG. 22, only a portion of the solenoid coil or body is above the key.

Referring again to FIG. 35, several embodiments of actuating mechanisms for drop action pianos are shown. In the first embodiment, a solenoid 318 is mounted above the level of the key frame to the rear of the rear end of the keys 310 with an L-shaped piston 320 extending downwardly and forwardly therefrom. The L-shaped piston 320 terminates below the rear end of the key 310 and when the solenoid 318 is actuated, it lifts the rear end of the key 310.

In another embodiment, shown in phantom, a solenoid 322 is mounted forward of the position of solenoid 318 with a piston 324 extending downwardly therefrom. The piston 324 may interconnect with the key 310 in any of the ways shown in FIGS. 30–32. The solenoids 318 or 322 may be mounted to the piano case or may be mounted to offset rails suspended from the hammer rail or wippen flange rail. It is preferred to mount the solenoids in some manner to a portion of the key action, such as the hammer rail or wippen flange rail, so that removal of the key action leads to removal of the player piano mechanism. This simplifies servicing of the piano.

In yet another embodiment, also shown in phantom, a solenoid 326 surrounds the sticker or abstact 312 for direct actuation thereof.

Figure 36:
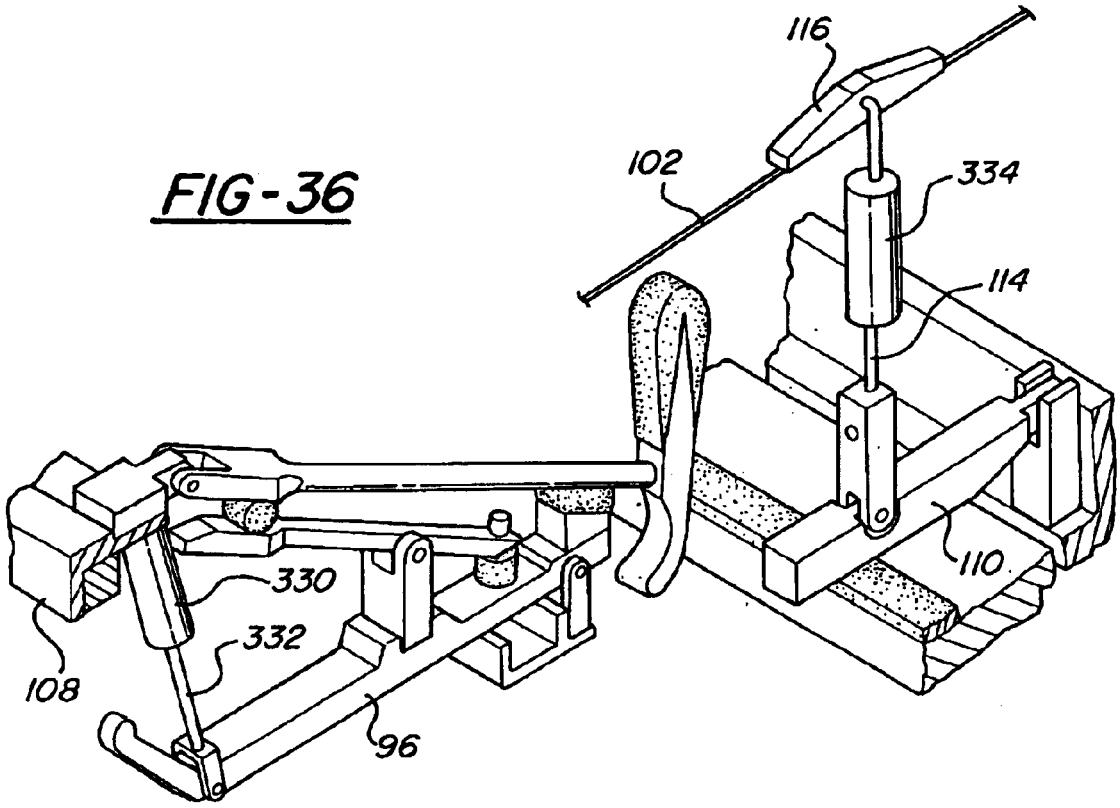
FIG. 36 is a perspective view of a single key action for a typical grand piano and a portion of a damper action showing actuators used to directly actuate a wippen and the damper rod.

Referring now to FIG. 36, an alternative approach to using to using an actuator to "play" a piano is shown. Specifically, FIG. 36 shows an approach for a grand piano. In this embodiment a solenoid 330 directly actuates the wippen 96. Solenoid 330 is mounted to the hammer rail 108 and has a piston 332 which extends downwardly and engages the free end of the wippen 96. Piston 332 may be interconnected with the free end of the wippen 96 in any of a number of ways, as will be clear to one of skill in the art. Also, the piston 332 connect to the wippen 96 in a different location, rather than at its extreme far end. Because the solenoid 330 directly actuates the wippen 96, the key is not moved. This has the advantage that the solenoid 330 is required to move less mass in order to strike the string 102. However, it would be desirable to also move the piano key so that an observer can see what keys are being "played". In this case, an additional solenoid may be used to move the key or an interconnection may be made between the key and the wippen 96 so that the key moves as if played in a normal manner. It also may be necessary to move the key to raise the back check into position. The back check prevents the hammer from rebounding back into the string. Also, because the key is not automatically moved, the damper underlever 110 is not lifted in its normal way. However, it is still necessary to lift the damper 116 from the string 102 when a note is struck. Therefore, a second solenoid 334 may be mounted in the back action of the piano for directly actuating the damper underlever 110. The solenoid 334 may be interconnected with the damper underlever in one of several ways. As shown, the solenoid 334 surrounds the damper rod 114. Actuation of the solenoid 334 causes the damper rod 114 to be lifted thereby lifting the damper 116.

Figure 37:
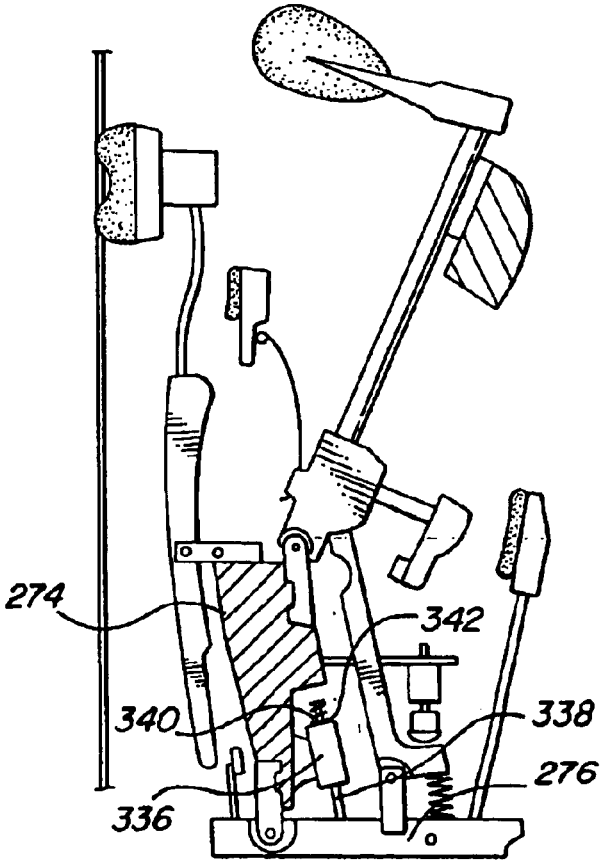
FIG. 37 is a cross-sectional side elevational view of a key and damper action from a typical upright piano with shortened key action showing an actuator disposed so as to directly actuate the wippen.

Referring now to FIG. 37, a similar approach may be taken for a tall key action in an upright piano. In this embodiment, a solenoid 336 is mounted to the wippen flange rail 274 above the action lever or wippen 276. A piston 338 extends from the solenoid and engages the action lever or wippen 276 in any of several ways. A spring 340 and washer 342 may be positioned above the top of the solenoid 336 to preload the piston 338. This configuration allows the solenoid 336 to directly actuate the key action without moving the key, thereby reducing the moving mass the solenoid 336 is required to move. As discussed with grand pianos, a separate solenoid may be used to move the keys or the wippen 276 may be interconnected with the key if key movement is desired.

A similar approach may also be applied to drop action pianos, as shown in FIG. 35. In FIG. 35, a solenoid 344 is shown in phantom with the piston 346 engaging the wippen 314 for direct actuation thereof.

Figure 38:
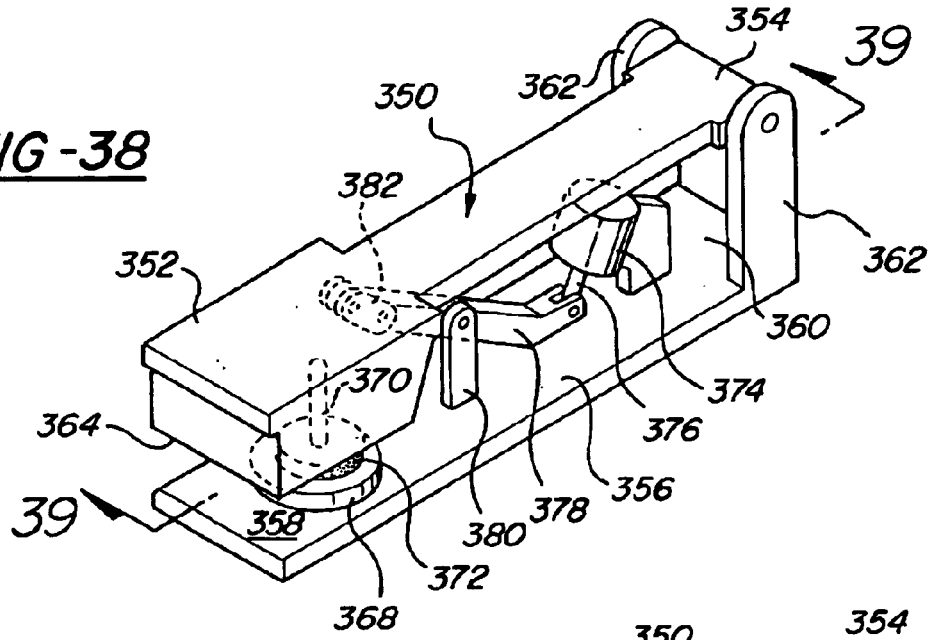
FIG. 38 is a perspective view of a single key and a portion of the key frame for a keyboard instrument showing an actuator and interconnection mechanism for moving the key.
Figure 39:
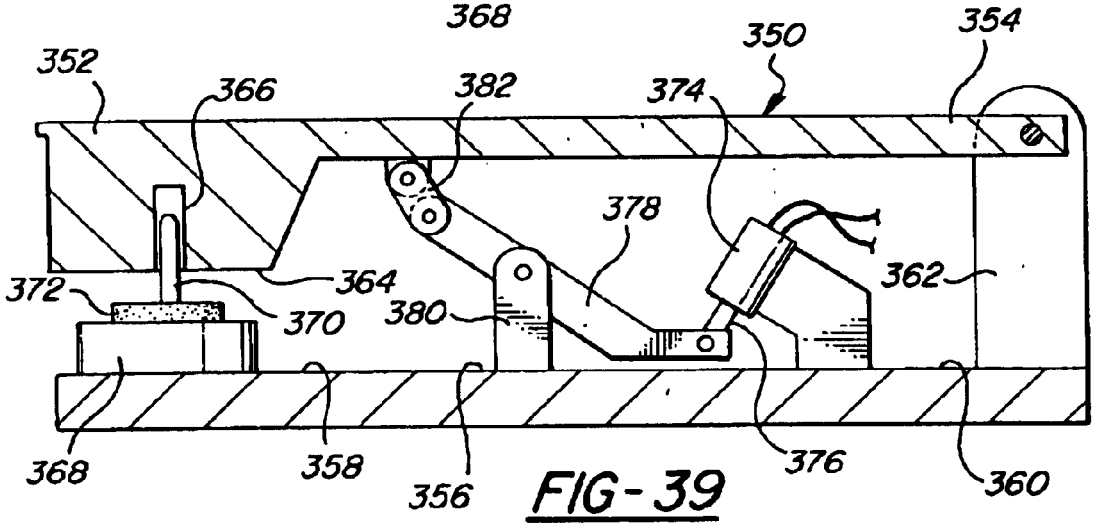
FIG. 39 is a cross-sectional view of the key and key frame of FIG. 38 taken along lines 39—39.

As discussed previously, it is sometimes desirable to provide key movement for non-acoustic keyboard instruments. Additional embodiments of the present invention directed towards this application will now be discussed. FIGS. 38 and 39 show a portion of a typical non-acoustic keyboard instrument with one type of actuator according to the present invention mounted below the key. Each key 350 of the keyboard instrument includes a front end 352 on which a musician typically presses to play a note, and a rear end 354. As is known to one of skill in the art, the configuration of keys 350 varies depending on the type of keyboard instrument. In the version illustrated, the key 350 is pivotally supported at its rear end 354.

As shown in FIGS. 38 and 39, the keyboard instrument includes a key frame 356 below the key 350. Only a portion of the key frame 356 is shown because these Figures show only a portion of the keyboard instrument. In a keyboard instrument, the key frame 356 would extend the entire width of the keyboard thereby extending beneath all of the keys 350. Alternatively, the keyboard instrument may be designed such that each key 350 includes its own small key frame 356, much as is shown in FIG. 38. This variation does not affect the application of the present invention. The key frame 356 has a front portion 358 residing below the front end 352 of the key 350 and a rear portion 360 residing below the rear end 354 of the key 350. The rear portion includes a pair of support arms 362 extending upwardly from the key frame 356 and pivotally supporting the rear end 354 of the key 350.

Referring now to both FIGS. 38 and 39, the front end 352 of the key 350 is thickened as compared to the remainder of the key. This arrangement is often used with non-acoustical keyboard instruments to minimize the material required to form the key. However, this arrangement is not required for application of the present invention. The thickened front portion of the key 350 has an underside 364 with a bore 366 extending upwardly from the underside into the front end 352 of the key 350. The bore 366 is usually "race track" or oval shaped. The bore 366 extends only partway through the key 350 and therefore does not extend through its upper side. A bushing 368 is positioned below the front end 352 of the key 350 and supported on the front portion 358 of the key frame 356. A key pin 370 extends upwardly from the bushing 358 so as to be disposed within the bore 366. A felt washer 372 may be positioned around the base of the key pin 370. The key pin 370 acts to help guide the key 350 as the front end moves downwardly when the key 350 is depressed. The felt washer 372 and/or bushing 368 stop the key 350 at the bottom of its travel and prevent unwanted noises.

In order to make a keyboard instrument into a player version, some system must be provided for playing the instrument automatically. Obviously, this may be provided electronically if the keyboard is electronic and produces sound electronically. However, many keyboard owners prefer that the keys 350 move as if they were being actually played by a musician. In order to accomplish this, some system must be provided for moving the keys 350 downwardly in order to play a note. According to one embodiment of the present invention, as shown in FIGS. 38 and 39, a pull-type electromechanical actuator 374 is mounted below the key 350 with its piston 376 extending downwardly towards the key frame 356. When the electromechanical actuator 374 is energized, the piston 376 is retracted upwardly. A lever arm 378 is pivotally supported near its midpoint by a support 380 with one end of the lever 378 being connected to the piston 376 of the actuator 374 and the other end of the lever interconnected with the underside of the key 350. Preferably, the lever 378 is interconnected with the underside of the key 350 by an intermediate link 382. This arrangement causes the key 350 to move downwardly when the electromagnetic actuator 374 is energized, thereby pulling the piston 376 upwardly into the actuator 374. As shown, this arrangement is particularly beneficial with keys shaped as shown, wherein the key 350 is less thick behind the front end 352. This thinned-out area leaves space for mounting the actuator 374 and the linkage for interconnecting it with the key 350.

Figure 40:
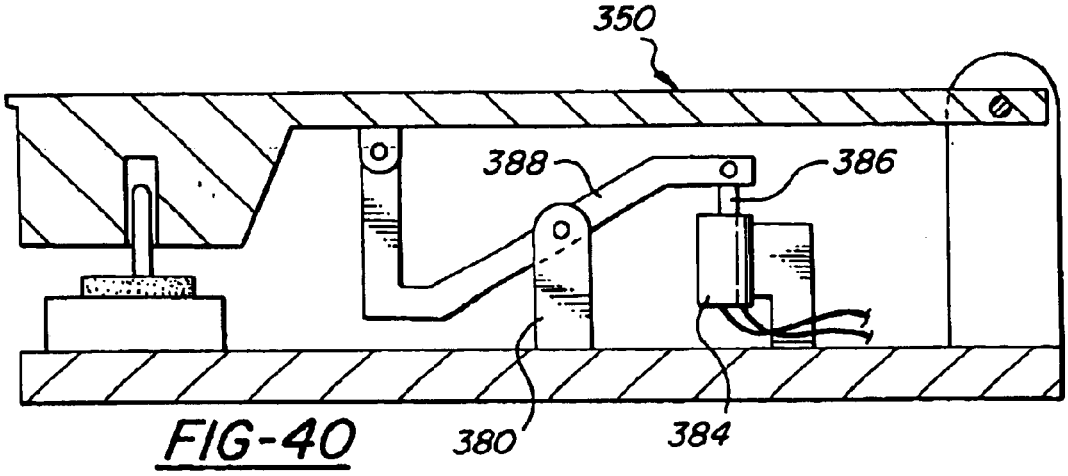
FIG. 40 is a cross-sectional side elevational view of a key similar to FIG. 39 but with an alternative actuator and mechanism for moving the key.

Referring now to FIG. 40, another embodiment of the present invention is shown. In this embodiment, a push-type electromechanical actuator 384 is mounted to the key frame 356 below the key 350 with its piston 386 extending upwardly towards the underside of the key 350. When the actuator 384 is energized, the piston 386 extends upwardly. As shown, the piston 386 is interconnected with one end of a lever 388 with its other end interconnected with the underside of the key 350 such that when the actuator 384 is energized, and the piston 386 pushes upwardly, the key 350 is pulled downwardly causing a note to be played.

Some non-acoustical keyboard instruments are simple using a plurality of modules similar to those depicted in FIGS. 38–40, but without the actuators. Each module includes its own miniature key frame and key and a sensor to sense when the key is moved. Keyboard manufacturers assemble their keyboard instruments by installing a plurality of these modules into a housing. As a particularly preferred embodiment of the present invention, modules such as depicted in FIGS. 38–40 may be provided to these manufacturers in order to assemble player keyboard instruments. As shown, each module includes its own individual key frame along with a key that is pivotally mounted thereto. The actuator is preinstalled and mounted to the key bed. Further it is interconnected with the key via a linkage mechanism. Because the piston actuator and the key are interconnected, they always move together. Therefore, these modules can provide double duty as sensors and drivers. That is, when the keyboard is being played by a player, movement of the key may be sensed by sensing the movement of the piston relative to the coil of the solenoid by measuring current induced into the windings. When the instrument is being played electronically, the actuators can actively drive the keys thereby moving them as if they were actually being played.

Figure 41:
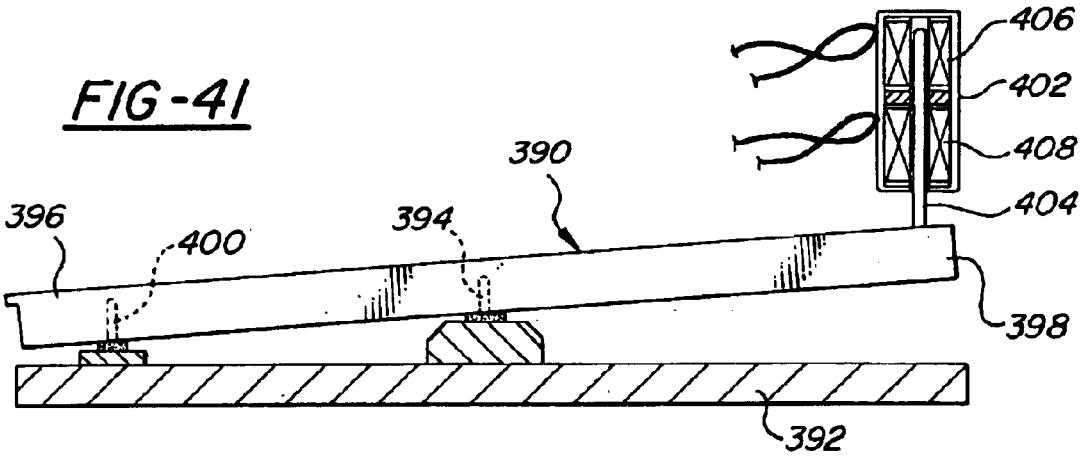
FIG. 41 is an elevational side view of a single key showing a dual coil actuator interconnected therewith.

As mentioned earlier, acoustic pianos, as well some non-acoustic keyboard instruments use "full size" keys that are pivotally supported near their midpoint. FIG. 41 shows a cross-sectional sketch of such a key 390 pivotally supported on a key frame 392. The key 390 is pivotally supported near its midpoint and a pivot pin 394 extends upwardly through a slot in the key 390. The key 390 is shown in the depressed position wherein its front end 396 is pushed downwardly and its rear end 398 is raised upwardly. The front end 396 of the key 390 is guided by a key pin 400 which extends upwardly from the key frame 392 into the underside of the key 390. In an acoustic piano, the rear end 398 of the key 390 will operate a mechanism which causes the striking of a note, while in a non-acoustical keyboard instrument the movement of the key 390 will actuate the playing of a note in some other way. A pull-type electromechanical actuator 402 is shown mounted above the rear end 398 of the key 390 with its piston 404 extending downwardly and interconnected with the rear end 398 of the key 390. When the actuator 402 is energized, it pulls the piston 404 upwardly thereby moving the key 390 as if its being played. The actuator 402 is shown having two coils 406 and 408 that are one above the other. These two coils may be used together to provide increased power, or in other ways as will be described. As shown, the piston 404 is interconnected with the key 390 such that they move together. This differs from some of the earlier embodiments wherein the movement of the key by a player does not necessarily move the actuator. Obviously, some of the embodiments previously discussed also move a portion of the actuator when the key is moved. Also, each of the embodiments may be modified such that movement of the key necessarily causes movement of the actuator.

As discussed, there is a need for improving the feel of non-acoustic keyboard instruments to mimic the feel of the piano. In embodiments wherein the piston of an actuator moves with the key, the actuators may be altered or energized such that they resist the movement of the keys. According to a further aspect of the present invention, the actuators in a non-acoustic keyboard instrument may be energized so as to slightly resist movement thereby increasing the perceived weight of the keys. When each key is depressed, the corresponding piston of an actuator must also move. By energizing the piston to resist this movement, the movement of the key is also resisted. A significant advantage to the present invention is that the feel of the keyboard may be altered without making physical modifications to the keys. That is, a switch may be provided such that movement resistance may be turned on and off or increased or decreased using a potentiometer. In this way, a weak player may use the normally light keys while a more experience or stronger player may select some resistance so as to mimic the feel of a piano.

As will be clear to those of skill in the keyboard art, the relationship between key movement and resistance is not simple. Instead, the keys on a piano exhibit a dynamic resistance curve throughout their range of motion, that may also be partially dependent on the speed with which the key is being moved. In the simplest version of the present invention, the actuators are energized at a low level to give some resistance to the motion of the keys. This will present a generally linear resistance and will improve the feel of the non-acoustical keyboard instrument, though not exactly replicating the feel of a piano. The linkage interconnecting the actuator and the key may be designed such that the resistance curve is other than linear thereby improving the match between electromechanical resistance and normal piano feel. However, in an improved version of the present invention, the resistance to key movement may be dynamically altered depending on the position of the key and/or the rate it is being depressed, as well as other factors. In this way, the feel of a traditional piano may be more closely mimicked. In order to accomplish this dynamic variation of resistance, it is necessary that the position of the key and/or the speed at which it is being depressed be measured. Obviously, if the position is accurately measured, the speed can be determined mathematically. In the simplest version of the present invention, in which the resistance is not dynamically varied, only a single coil is required to provide resistance to each key. The same coil may double as an actuator for playing the key. In the improved version, with dynamically variable resistance, a sensor is preferably also provided for sensing the key position. There are many ways in which this may be accomplished.

Figure 42:
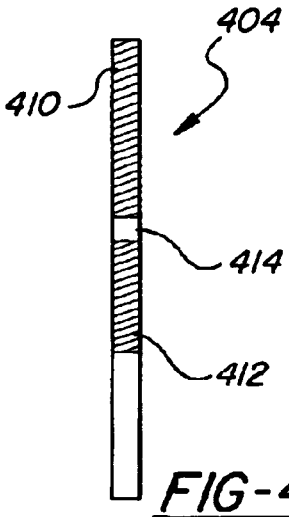
FIG. 42 is a detailed view of the piston for the actuator of FIG. 41.

Referring again to FIG. 41, one approach to providing both resistance and sensing will be described. In this embodiment of the present invention, the actuator 402 includes an upper coil 406 and a lower coil 408, both surrounding a piston 404 which passes through the center of the coils. Referring now to FIG. 42, a magnified view of the piston 404 is shown. The pin 404 includes an upper magnetic section 410, a lower magnetic section 412 and a central non-magnetic section 414 separating the upper 410 and lower 412 sections. The magnetic sections are formed from some type of magnetic material such as iron while the center section 414 is formed from a non-magnetic material which provides magnetic isolation between the upper 410 and lower 412 sections. The upper section 410 of the piston 404 resides within the upper coil 406 of the actuator 402 while the lower section 412 of the piston 404 resides within the lower coil 408 of the actuator 402. As known to those of skill in the art, when a piece of magnetic material is moved within or near a winding, a small current is induced in that winding. This current may be measured thereby determining the movement of the magnetic material relative to the winding. The dual coil actuator 402 takes advantage of this effect. The upper coil 406 and section 410 may be used to sense movement of the key 390 since the piston 404 moves relative to the coil 406 as the key 390 is moved. At the same time, the lower coil 408 and lower section 412 may be used to resist key movement thereby enhancing the feel of the key 390. Obviously, all of the actuators discussed in the other embodiments of the present invention may be designed as just discussed and shown in FIGS. 41 and 42 thereby providing for both sensing as well as resistance. Alternatively, the double coil can also be used to both sense and actuate a key so that a feedback system may be used to accurately control the motion of the keys.

As discussed actuators may be used to either drive key movement or resist key movement, thereby either playing an instrument or increasing the resistance to key movement and altering the feel of the key movement. According to another aspect of the present invention, the feel also may be lightened. Students and musicians with reduced hand strength may wish that both acoustical and non-acoustical keyboard instruments have a lighter feel than is typical for a piano. There are techniques by which the keys on a normal piano may be altered such that they have a very light feel. However, this requires a costly modification to an existing piano and the modification is costly to reverse. Using the actuators shown in this application movement of the keys may be assisted such that less effort is required on the part of the musician or student. To accomplish this, the actuators are lightly energized such that they are trying, but not quite achieving movement of the keys. Then, with a very light touch, the musician or student may depress the key with the movement being assisted by the actuator. The actuators may provide a constant amount of assistance at all times both during key depression and key return. Or, as with resistance to movement, it may be desirable to dynamically alter the amount of assistance as the key moves. For this purpose, sensing may be required and may be achieved in the many ways discussed herein. Also, accurate reproduction of the feel of piano keys may require that movement is actually assisted during part of the motion of the key and resisted during other parts. Therefore, actuators may be controlled such that they resist and/or assist movement of the keys depending upon the key positions in order to achieve a desired effect. These effects may be turned on and off as well as changed. For example, a non-acoustical keyboard instrument may be provided with a switch such that it plays as it normally would without a player system, or so that it plays like one or more different types of pianos or organs. Likewise, a switch may also provide assistance so that a weaker player may operate the keys. Obviously, the assistance in key movement is most desirable for acoustical instruments wherein the normal key movement is rather heavy. Therefore, the assistance aspect of the present invention is preferably applied to pianos to lighten the normal feel of the piano keys.

A further aspect of the present invention seeks to overcome the limitations of prior art key movement sensing systems by using a portion of the electromechanical actuator already required for key movement as part of the sensing system. According to the present invention, a small piece of magnetic material is added to a piano key near a solenoid piston used for key actuation so that movement of the key causes the piece of magnetic material to move relative to the solenoid piston thereby causing a voltage to be generated in the solenoid coil which may be sensed to determine the movement of the key. A very small piece of magnetic material may be used thereby minimizing any effect on key weight. In some applications, no magnetic material may need to be added. The metal portion of the piston will create a signal. In addition, the solenoid coils serve double-duty, both actuating the keys and measuring movement of the keys, thereby reducing the amount of wiring and installation required.

Figure 43:
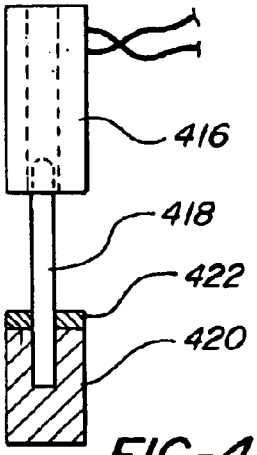
FIG. 43 is a cross-sectional view of a key along with a piston and coil of an actuator, showing a piece of magnetic material disposed atop the key.

Referring to FIG. 43, a solenoid coil 416, solenoid piston 418, and piano key 420 are shown in cross section. These elements normally are part of an actuation mechanism wherein the piano key 420 is actuated by the solenoid piston 418 pulling the piano key 420 upwardly when the solenoid coil 416 has power applied to it. Obviously, the portion of the key 420 shown is located behind the pivot fulcrum of the key so that pulling up on the key 420 causes a note to be played. In the embodiment of FIG. 43, the solenoid piston 418 is embedded in the piano key 420 so that they move together. A piece of magnetic material 422 is shown attached to the piano key 420 so that it moves with the piano key 416. As the magnetized piston 418 moves relative to the solenoid coil 416, a voltage proportional to the velocity of the key 420 is generated in the solenoid coil 416. By measuring the voltage created across the solenoid coil 416, the motion of the key 420 can be determined. As will be clear to one of skill in the art, the piece of magnetic material 422 may be made very small such that its size and weight do not adversely affect the weight of the key 420 or the packaging of the actuation system for the player piano. In some embodiments, the piece of magnetic material 422 may be a piece of magnetic tape.

Figure 44:
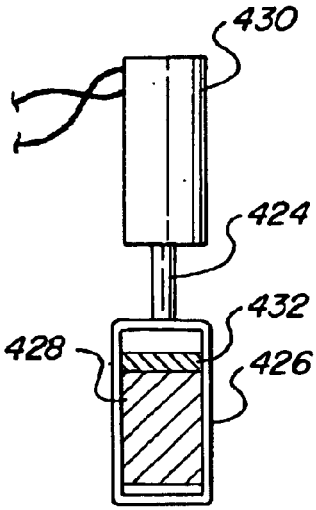
FIG. 44 is a cross-sectional view of a key along with a piston and coil of an actuator showing a piece of magnetic material disposed atop the key.

Referring now to FIG. 44, a different embodiment of an actuation mechanism is shown. In this embodiment, the solenoid piston 424 includes a loop 426 that surrounds the piano key 428 so that the bottom of the loop 426 lifts the key 428 when power is applied to the solenoid coil 430. This embodiment avoids the necessity of embedding the solenoid piston in the key 428 as was required in the embodiment of FIG. 43. Like in the previous embodiment, a piece of magnetic material 432 is affixed to the top of the piano key 428 so that it moves therewith. Once again, movement of the magnetic material 432 creates a voltage in the solenoid coil 430 allowing the motion of the key 428 to be determined.

Figure 45:
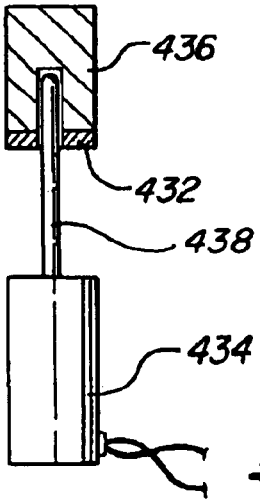
FIG. 45 is a cross-sectional view of a key along with a coil and piston of a typical push-type solenoid showing a piece of magnetic material disposed on the bottom of the key.

Turning now to FIG. 45, an actuation system using a push-type solenoid is shown in cross section. This is the type of system typically used in currently available player pianos. In this embodiment, a solenoid coil 434 is positioned below a piano key 436 with a solenoid piston 438 pushing upwardly on the underside of the piano key 436. According to the present invention, a piece of magnetic material 432 is affixed to the underside of the key 436 for movement therewith. Movement of the key 436 causes the magnetic material 440 to move relative to the solenoid coil 434 thereby creating a voltage across the solenoid coil 434.

Figure 46:
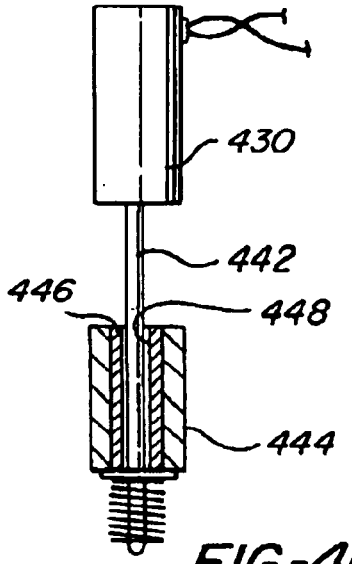
FIG. 46 is a cross-sectional view of a key along with a piston and coil of an actuator showing a piece of magnetic material disposed in a hole in the key.

Turning now to FIG. 46, an actuation mechanism similar to the embodiment of FIG. 32 is shown wherein a solenoid piston 442 passes through a piano key 444 to lift the piano key 444 when power is applied to the solenoid coil 430. In this embodiment, magnetic material 446 is positioned in the hole 448 in the key 444 rather than being affixed to the top or bottom of the key as in the prior embodiments. As will be clear to one of skill in the art, magnetic material may be positioned in any of a number of ways on or in the piano key without departing from the scope of the present invention. Also as will be clear to one of skill in the art, other types of sensing may be used other than magnetic. For example, inductive, reactive, or Hall effect type sensing may be used. Other types of electromechanical actuators may also be used other than solenoids, and sensing may still be accomplished in accordance with the present invention.

People with player type keyboards often also desire that the keyboard be able to record their playing so that it may be later played back. This also requires that the key motion be sensed. The use of magnetic material will work. In the simplest versions of the present invention, having only a single coil and no sensor, the coil may be used to sense key movement when it is not being used to drive the key or resist key movement. In this way, a very simple actuator can be used to play the key, resist key movement, and sense key movement. However, the same coil would typically not be used to provide more than one of functions at the same time. A single coil may be used both to create a force and to sense movement using a technology, known to those of skill in the art of power electronics, called Vector-type or sensorless controls. Currently, the electronics required to provide both functions within a single coil is cost prohibitive and it would be cheaper to provide two coils, one of which senses and one of which creates force. However, this technology may become less expensive over time and the present invention can take advantage of this technology as well. That is, a very simple single coil actuator may be provided that is capable, through vector-type control, of creating a force and sensing movement at the same time. Alternatively, in a simpler approach, a shunt type resistor may be placed either in series or in parallel to the solenoid coil. In this way, a voltage will appear across the resistor proportional to key movement even when the solenoid is being used for driving or resisting. Alternatively, with a shunt resistor, a change in resistance can be measured instead of a voltage or current change.

Figure 47:
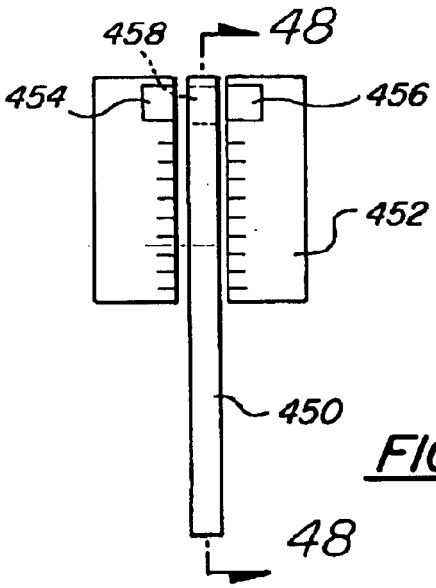
FIG. 47 is a cross-sectional view of an actuator coil and piston with an optical sensor integral therewith.
Figure 48:
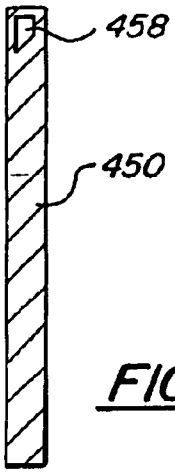
FIG. 48 is a cross-sectional view of the piston of FIG. 47 taken along lines 48—48.

As we have been discussing, it is desirable to be able to measure key movement as well as to move the key or resist its movement. A single actuator may include a sensor or a separate sensor may be provided. Currently, optical type sensors are very popular and often used to sense key movement. Typically, the optical type sensors include a light source and a light sensor. A member with some type of window or windows in it is moved between the light source and sensor as the key is moved. The member may have a single window with an angled cut such that, as it moves, the amount of light passing through the window is reduced thereby allowing the sensor to determine the position of the key. Alternatively, the member may have a series of small windows or reflectors such that key movement causes a flashing light which may be used to determine the position and speed of the key. Turning to another aspect of the present invention, an optical sensor may be provided as part of an actuator so that two functions, sensing and force creation, are provided by the same actuator. As explained earlier, electromechanical actuators typically include a piston which moves relative to the surrounding coil as the key is moved. According to the present invention, it is envisioned to incorporate an optical sensor by creating windows in a portion of the piston of the actuator and providing a light source and a light receiver for the actuator to measure movement of the windows relative to the source and receiver. As will be clear to those of skill in the art, this may be achieved in a number of ways. FIG. 47 shows a sketch of one possible approach. A piston 450 is shown positioned within an actuator body 452, shown in cross-section. The actuator body includes windings for creating a force to move the piston 450 relative to the body 452. The body 452 also includes a light source 454 and a light receiver 456 embedded within the body 452 on opposite sides of the piston 450. Referring now to FIG. 48, the piston 450 is shown in cross-section. The upper part of the piston 450 includes a window 458 with a slanted bottom section. As the piston 450 moves relative to the body 452, the amount of light which may pass from the source 454 to the receiver 456 through the window 458 is altered thereby allowing the position of the piston 450 to be determined. Sensing may also be provided along with an actuator in a variety of other ways. For example, a hall effect sensor may be embedded within the actuator for determining the position of the piston.

Figure 49:
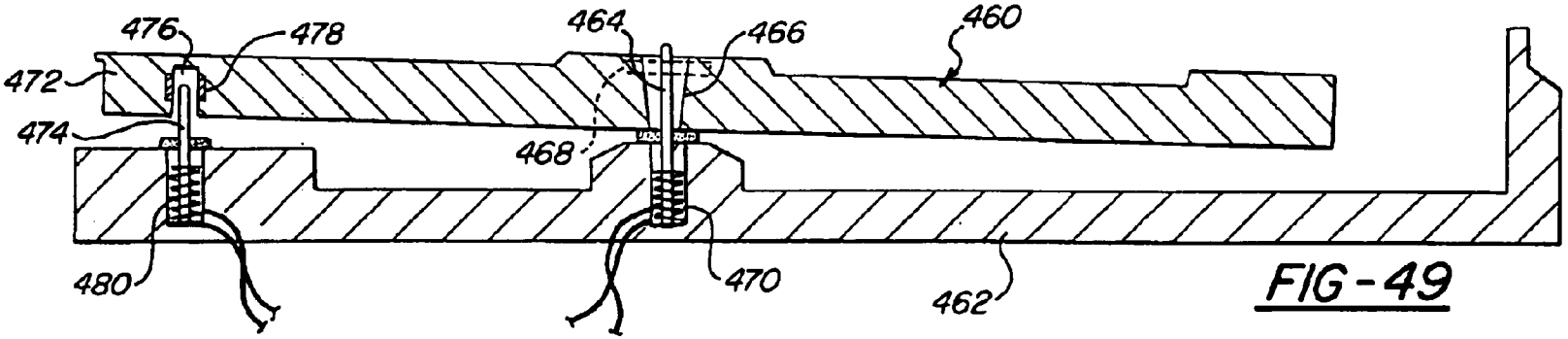
FIG. 49 is a cross-sectional view of a single key resting on a key frame showing two embodiments of sensing systems utilizing magnetic materials disposed in a key with coils surrounding pins which extend upwardly through the key from the key bed.
Figure 50:
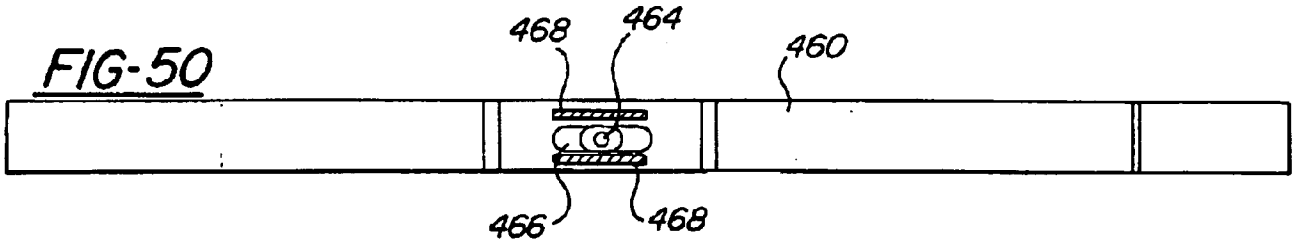
FIG. 50 is a top view of the key of FIG. 49.

We turn now to another aspect of the present invention which addresses yet another novel approach to key movement sensing. FIG. 49 shows a cross-sectional side view of a key 460, as part of a traditional piano, supported on a key frame 462. FIG. 50 is a top view of the same key 460. As the key is depressed, it pivots about a pivot pin 464 located in a slot 466 in the center of the key 460. According to the present invention, one or more pieces of magnetic material 468 are located adjacent to the slot 466. When the key 460 is depressed, the magnetic material 468 moves with the key 460 relative to the pin 464. A coil 470 is disposed about the base of the pin 464. The pin 464 is preferably of a magnetic material so that the coil 470 is influenced by the movement of the magnetic material 468 disposed within the key 460. By measuring the current or voltage induced in the coil 470, the movement of the key 460 may be determined. An alternative sensing approach is shown in the front end 472 of the key 460. As discussed previously, key such as 460 include a key or guide pin 474 which extends upwardly from the front of the key frame 462 into a recess 476 on the underside of the front end 472 of the key 460. The pin is traditionally made of metal. By embedding small pieces of magnetic material 478 to the edges of the recess 476, and by wrapping a coil 480 around the base of pin 474, motion of the key 460 can be sensed.

Figure 51:
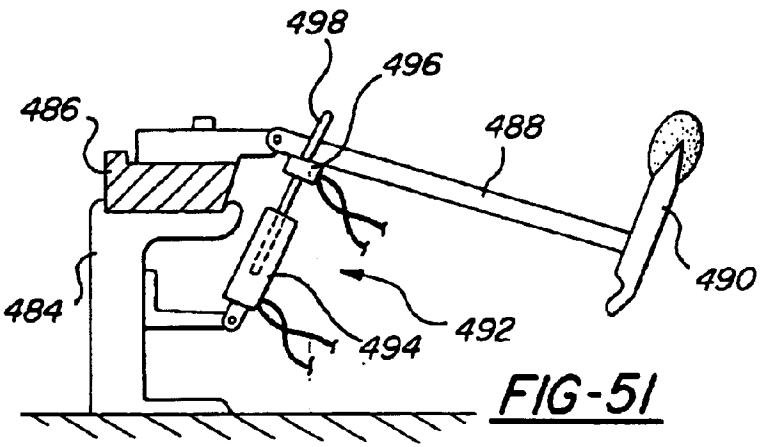
FIG. 51 is a side elevational view of a hammer rail and hammer along with an actuator designed to directly actuate the hammer.

In some applications, it is desirable to directly control the motion of a hammer for striking a string to produce a sound. For example, a piano could be constructed wherein the keys are not mechanically interconnected with a striking system for the strings. Instead, sensors could detect motion of the keys causing an actuator to directly actuate the hammers. This eliminates the complicated key action typically used in a piano. It also allows interesting variations on packaging. However, it necessitates a system for directly actuating a hammer. Referring to FIG. 51, a first embodiment of an actuator for a hammer is illustrated. In this figure, a tower 484 supports a hammer rail 486 which in turn supports a hammer 488. The hammer 488 is pivotally supported so that the head 490 of the hammer can swing upwardly to strike a string, not shown. An actuator 492 extends between the tower 484 and the hammer 488. The actuator 492 includes a solenoid coil or body 494 is pivotally mounted to the tower 484. A guide rail 498 extends upwardly from the solenoid body 494 through a hole in the shaft of the hammer 488. A secondary coil 496 is mounted to the shaft of the hammer 488 and surrounds the guide rail 498. The coils 496 and 494 are designed such that when they are energized they repel one another thereby propelling the hammer 488 upwardly to strike a string. Because the guide rail 498 passes through the shaft of the hammer 488, the guide rail 498 stays engaged with the hammer 488 during the hammer's travel. This helps to control the motion of the hammer 488. As an alternative, the secondary coil 496 may be replaced with a piece of permanent magnetic material which will also be repelled when the primary coil 494 is energized. Obviously, the illustrated embodiment in FIG. 51 may be modified to work with an upright piano wherein the hammer would be positioned differently. Also, coil 494 may be omitted, leaving only the ferromagnetic pin 498.

Figure 52:
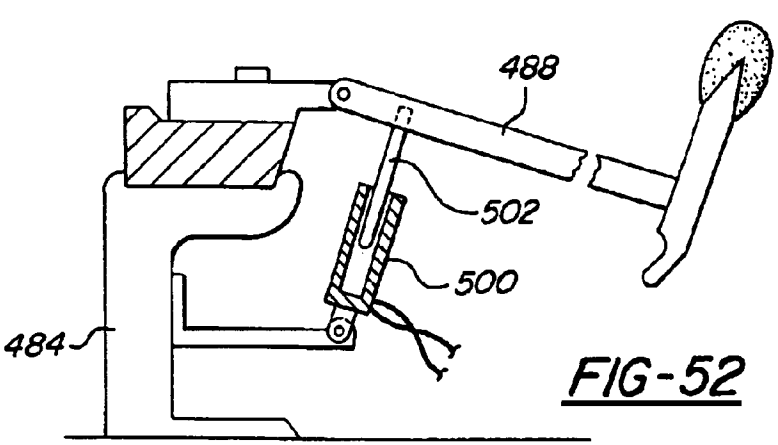
FIG. 52 is a side elevational view of a hammer and hammer rail similar to FIG. 51 showing an alternative actuator for directly actuating the hammer.

FIG. 52 shows an alternative embodiment of an electric hammer actuator. In this embodiment, a primary solenoid coil or body 500 is mounted to the tower 484 and its corresponding magnetic piston 502 is mounted to the shaft of the hammer 488. The piston 500 may be solidly and pivotally mounted to the shaft of the hammer 488, depending on the application. Once again, when the coil 500 is energized, the piston 502 is driven out thereby causing the hammer 488 to be flicked upwardly.

Figure 53:
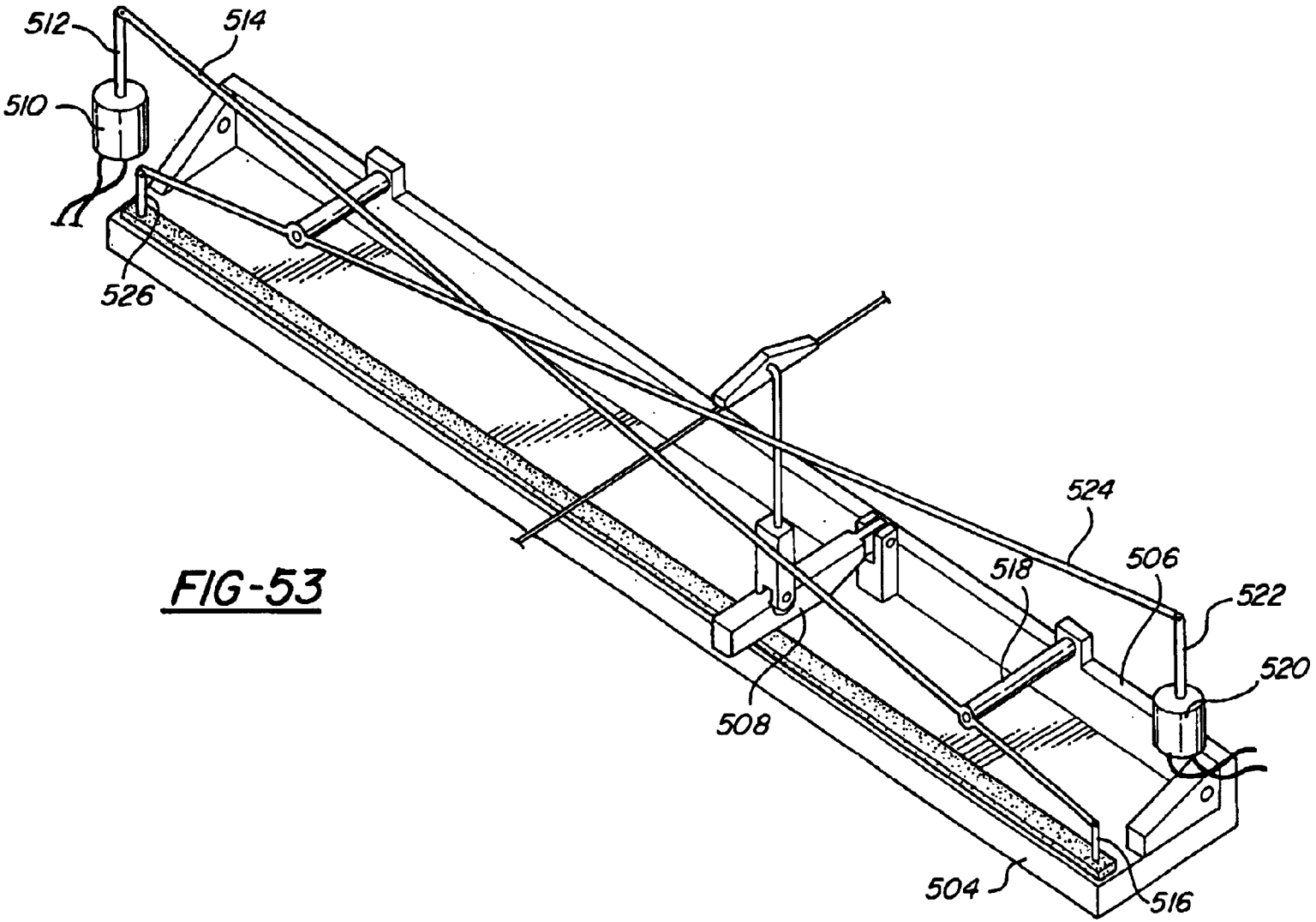
FIG. 53 is a perspective view of a damper lift lever and an actuator system therefore.

Besides the key action, pianos typically also have three pedals. The pedals perform such actions as lifting all the dampers allowing struck notes to continue to resonate or to adjust the key action such that the loudness of the piano is reduced. A player piano mechanism also generally needs to operate the pedal functions to accurately reproduce piano playing. In addition to the previously described parts, a damper lift lever runs side to side in the back action of the piano below the damper underlevers. This portion of a piano is illustrated in FIG. 53. The lift lever 504 is pivotally supported by the damper rail 506 such that it can move upwardly thereby lifting all of the damper underlevers 508 allowing all the strings to resonate. The lift lever 504 is moved upwardly by one of the pedals of the grand piano via a linkage mechanism.

Because the damper lift lever 504 lifts a large number of damper underlevers 508, a significant amount of force is required. Referring to FIG. 53, a first solenoid 510 is mounted adjacent one end of the damper lift lever. The solenoid's piston 512 extends upwardly and interconnects with the end of an elongated lever arm 514 which runs diagonally to the other end of the damper lift lever where it attaches to the damper lift lever 504 via a small link 516. The elongated lever arm 514 is pivotally supported near its midpoint by a pivot support 518. Likewise, a second solenoid 520 is mounted adjacent the other end of the damper lift lever 504 and is connected to the tab 504 by a piston 522, lever arm 524 and a link 526 that are mirror images of the earlier described components. By energizing the solenoids 510 and 520, the damper lift lever 504 is lifted. Alternatively, the elongated lever arms 514 and 524 may be pivotally supported by pivot supports located in different locations than shown. For example, by pivotally supporting each lever arm 514 and 524 nearer to their respective links 516 and 526, the mechanism can provide significant mechanical advantage allowing the use of less powerful solenoids.

As is known to those of skill in the art, many purchasers of player pianos wish to hear the sound of more than just the piano playing. Specifically, many owners wish to hear the sound of accompanying instruments while their player piano plays. There are currently available systems which include externally mounted or integrally provided speakers so that the sound of the accompanying instruments may be produced as the player piano plays. However, the use of externally mounted speakers is considered unsightly by some users and the currently available integrally mounted speakers have poor sonic performance.

Figure 54:
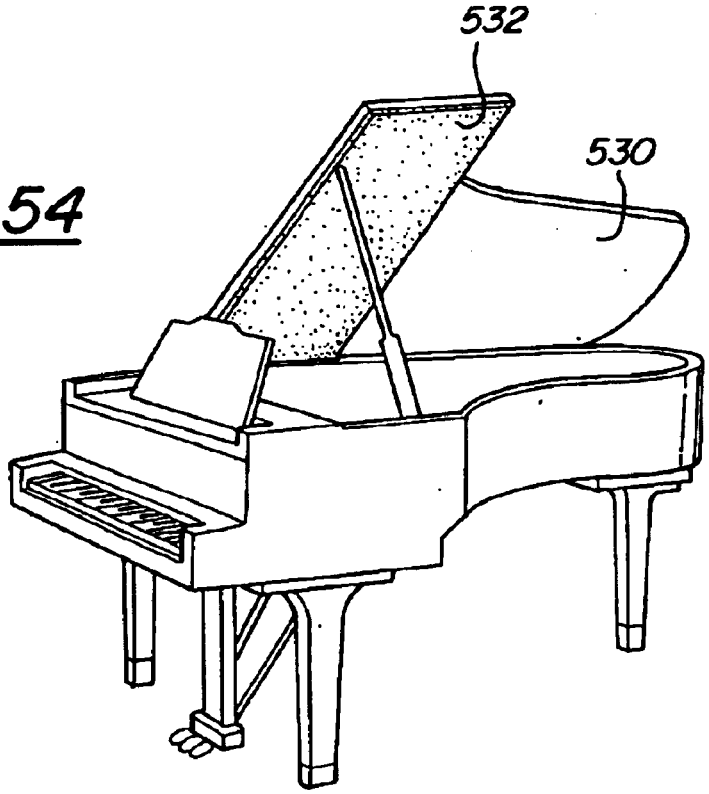
FIG. 54 is a perspective view of a grand piano with a thin film speaker disposed in the lid thereof.

Referring now to FIG. 54, a preferred solution to this problem is illustrated. Specifically, a thin panel speaker, such as a mylar dipole or electrostatic speaker, may be made as part of the grand piano lid 530. 532 indicates a piece of cloth covering the thin panel speaker. Thin panel speakers may be made incredibly thin such that the dimensions of the lid 530 of the piano are not altered, thereby giving a pleasing aesthetic appearance. A portion of the lid 530 may be thinned with a thin panel speaker grafted onto that portion of the lid and covered with cloth 532. It is sometimes desirable to provide ventilation to the rear of a thin panel speaker. Such ventilation may be provided along the edges of the panel so as not to disturb the appearance of the top side of the lid 530. Obviously, different portions of the lid 530 may be made into a thin panel speaker rather than the portion illustrated. Thin panel speakers are generally accepted as providing very high quality sound and therefore would overcome the sonic limitations of currently available embedded speakers without providing the unacceptable appearance of free standing speakers.

Figure 55:
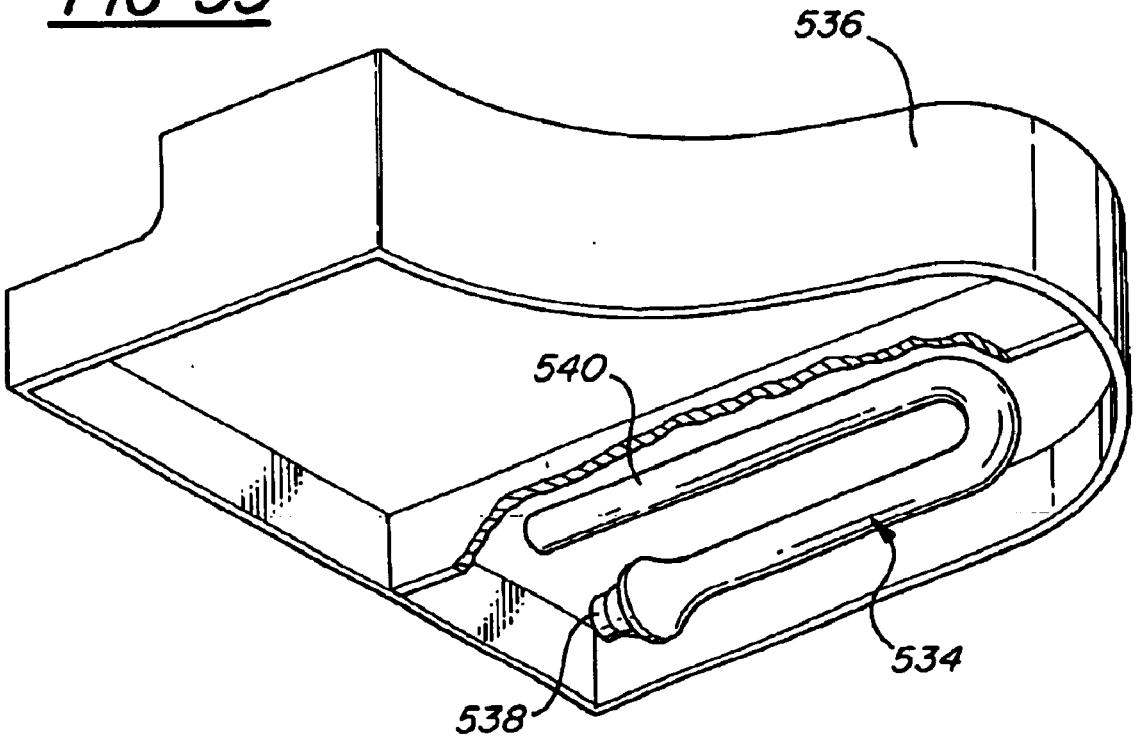
FIG. 55 is a bottom view of a piano case showing a transmission line subwoofer installed thereon.

Referring now to FIG. 55, a transmission line subwoofer 534 is shown for use with the thin panel speaker of FIG. 54. Thin panel speakers are sometimes deficient with lower frequencies. Therefore, preferably, a transmission line subwoofer 534 is provided and mounted to the underside of the piano case 536. Preferably, the subwoofer 534 includes a driver 538 and a duct 540 which tapers, preferably constantly, from the driver to the outlet end. That is, the duct 540 is largest at the driver end and tapers downwardly at a constant rate. Alternatively, a coupled cavity subwoofer can be used.

Throughout this application, numerous applications for electromechanical actuators, such as solenoids, have been discussed. It is desirable to avoid overheating of these electromechanical actuators. For this purpose, some embodiments of the present invention may include a bimetallic contact inside the individual solenoids which opens the circuit if the solenoid or actuator overheats. This simple approach provides an additional level of safety and helps assure product longevity.

Figure 56:
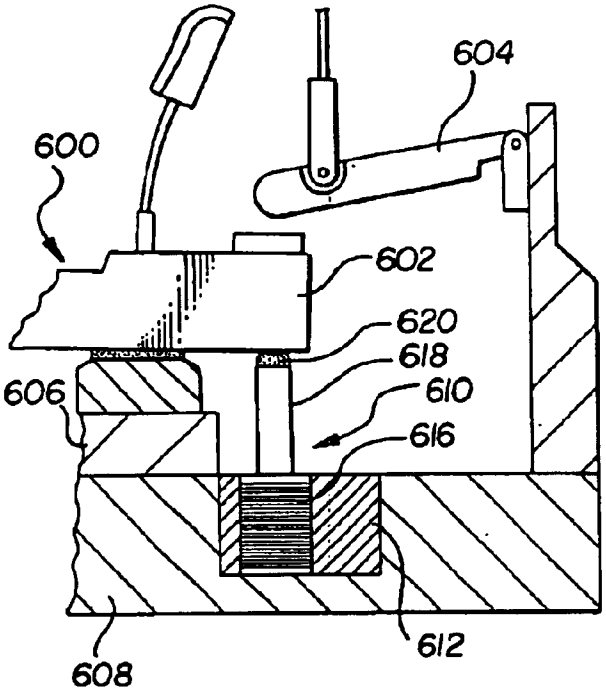
FIG. 56 is a cross-sectional elevational view of a portion of a key along with an actuator therefore.

Referring now to FIG. 56, an additional embodiment of a key actuation system will be described. As known to those of skill in the art, some currently available key actuation systems use push-type solenoids positioned in the key bed between the fulcrum or balance rail and the back end of the key. These push solenoids push up on the key behind the fulcrum, causing the key to pivot as if played. A disadvantage to these systems is that a large section of the key bed is cut out to make room for the various actuators. The actuators are then individually supported by a bracketry system to be held in the correct position. In FIG. 56, an improved version of such a push type system is shown. Specifically, the rear end 602 of the key 600 is shown along with a damper underlever 604 and a portion of the damper rod. The rearmost portion of the key frame 606, which supports the key 600, is shown supported on a portion of the key bed 608. A portion of the key bed 608 has been removed to make room for push-type actuators, one of which is shown generally at 610. Typical push and pull solenoids are provided as individual units, each with a central piston and a surrounding actuator body. The actuator body includes a ferromagnetic outer body and an inner coil winding. According to the present invention, a larger piece of ferromagnetic material, such as rectangular bar stock 612 is machined so as to act as the outer body for a plurality of solenoid coils. This may be referred to as a solenoid block. The bar stock material 612 runs side-to-side (into and out of the plane of FIG. 56) in the piano. The bar stock may be one continuous piece, or several shorter pieces may be used. For each actuator, such as 610, a bore 614 is provided in the bar stock material 612. An outer coil winding 616 is placed in the bore 614 to form the outer part of the actuator 610. In one preferred embodiment, the outer winding 616 is formed by winding wire about a bobbin or spool. The bobbin or spool preferably is plastic, such as nylon, and has an inner cooper sleeve. The bobbin or spool has a central bore sized to accept the piston 618.

As will be clear to those of skill in the art, when the coil 616 is energized, the piston 618 is pushed upwardly. Because of its positioning, this causes the rear end 602 of the key 600 to be lifted upwardly, thereby playing a note. Preferably, a pad 620 is provided on the upper end of the piston 618. One preferred material for the pad 620 is silicone.

In the embodiment illustrated in FIG. 56, the bar stock material 612 displaces only a portion of the thickness of the key bed 608. The bore 614 may be drilled from the top of the bar stock material 612. Alternatively, the bar stock 612 may be thicker so that the slot in the key bed 608 to accommodate the bar stock 612 passes entirely through the key bed. This exposes the underside of the bar stock 612 to the air below the underside of the key bed and provides some cooling benefits. Also, in another preferred embodiment, the bores in the bar stock material are bored from the underside of the bar stock material and a narrow hole is left between this large bore and the top of the bar stock. The windings are then placed into the bores from the underside and the pistons are shaped so as to have an upper part that will pass through the small holes. The pistons may be shaped so that they have a larger lower portion that is retained by this hole so that the pistons cannot pass entirely out the top of the bar stock. This limits their travel.

The use of bar stock to form the outer bodies for each of the actuators provides numerous benefits. First, the bar stock is a solid and stiff piece of metal and therefore is self-supporting and accurately locates each of the actuators. Also, the bar stock can be tightly glued or otherwise fastened into the key bed, providing a quick installation as well as restoring structure in an otherwise weakened key bed. The use of the bar stock also provides benefits related to an improved flux pad and provides a large heat sink for heat being produced by the individual actuators. Machining a single piece of bar stock with multiple bores may also be simpler and more cost effective than machining multiple individual coil outer bodies. This is especially true when it is considered that the finished bar stock does not require the addition of multiple brackets and other support structure for multiple independent actuators.

The use of bar stock to form the outer bodies for a plurality of actuators can also be applied to other embodiments of the present invention. For example, the embodiment of the present invention shown in FIGS. 20 and 21 may be modified such that each of the solenoid bodies is part of a piece of bar stock. The term bar stock should not be interpreted as limiting, but instead is defined herein as referring to any larger piece of ferromagnetic material used to form the outer portions of a plurality of actuators. It may also be referred to as a block, independent of its shape. The "bar stock," with or without the bores, may actually be formed by casting, forging, or other approaches. Materials other than metal may also be used if suitable to the application, or a plastic frame may be molded to hold typical solenoids.

Figure 57:
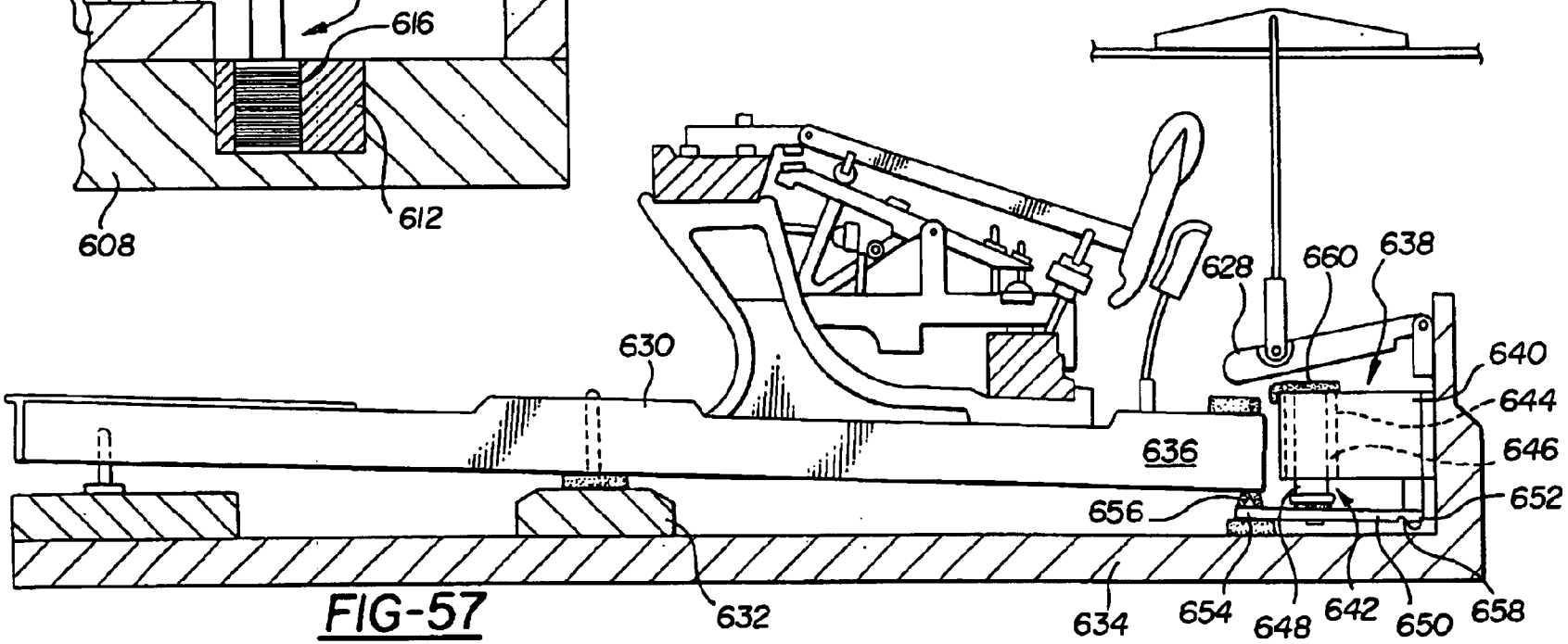
FIG. 57 is a side elevational view of a single key in key action along with an actuator system therefore.

Referring now to FIG. 57, a preferred embodiment of the present invention utilizing pull solenoids positioned behind the rear end of the keys and actuating the keys using lift underlevers, is illustrated. This embodiment is similar to several earlier embodiments of the present invention, but utilizes bar stock material to hold multiple actuators. Also, the system is sized such that it may be positioned below the damper underlevers in their standard position. A key 630 is shown resting on a fulcrum or balance rail 632 which is supported on a key bed 634. The key 630 has a rearmost end 636 which moves upwardly to play a note.

The actuator mechanism is generally shown at 638, and includes a piece of bar stock 640 supported rearwardly of the rear end 636 of the key 630 and spaced above the key bed 634. The bar stock 640 may be supported in this position in any of a variety of ways, including brackets interconnecting it with the key bed 634. A single actuator 642 is shown. However, as will be clear to those of skill in the art, and as with earlier embodiments of the present invention, multiple actuators are provided and may be alternated forwardly and backwardly of each other so as to interdigitate them. The bar stock 640 has a bore 644 with windings 646 provided therein. A piston 648 is disposed in the inner bore of the windings 646 and has a lower end interconnected with a flexible lift underlever 650.

The lift underlever 650 has a rear end 652 which is supported relative to the key bed and the bar stock 640. A forward end 654 of the underlever 650 is positioned under the rearmost end 636 of the key 630 and has a pad 656 on its upper side for contact with the key. As shown, the lift underlever 650 has a recess 658 cut into its under side so as to make a thinner portion adjacent its rearward end 652. The lift lever 650 is preferably made out of a flexible material such as Nylatron®. According to a further aspect of the present invention, damper underlevers 628 may also be provided as flexible levers similar to the lift levers 650.

When the actuator 642 is energized, the piston 648 is pulled upwardly into the coil 646, thereby lifting upwardly on the underlever 650. This causes the underlever 650 to flex upwardly causing the pad 656 to lift the rear end 636 of the key, thereby playing a note. A circuit board 660 is provided on the upper side of the bar stock 640. With multiple inter-digitated actuators, the circuit board would likely extend further to the rear than shown. The positioning of the circuit board 660 allows for very accurate control of the solenoid 642. This provides various benefits, as will be clear to those of skill in the art. In one embodiment, the actuators are driven with a pulse width modulated (PWM) signal. By monitoring the current rise time, changes in the piston position may be determined. Further, monitoring of the temperature of the coils allow a more accurate determination of actual piston position. A more advanced embodiment of the present invention allows use of this position information for even more accurate control.

Referring now to FIG. 58, another embodiment of an actuator system according to the present invention is generally shown at 680. This system is essentially a reverse version of the system of FIG. 57. Specifically, instead of pull type solenoids positioned above a lift underlever, push type solenoids are positioned under a similar lift underlever. The push type solenoids may be individually provided or, preferably, multiple actuators may be provided housed in a piece of bar stock 682. The piston 684 of one actuator is shown extended from the bar stock 682. As with earlier embodiments, the bar stock 682 has a bore 686 with an outer coil 688 provided therein. A lift underlever 690 is provided, having a rear end 692 connected to the bar stock 682 by a bracket 694. As shown, the bar stock 682 is positioned in a cutout 696 in the key bed 698 to the rear of the fulcrum or balance rail 700. As shown, the cutout 696 may be to the rear of the rear end 702 of the key 704. Therefore, in the illustrated embodiment, the lift underlever 690 extends forward from its rear end 692, which is attached to the bracket 694, to a front end 706 that is positioned under the rear end 702 of the key 704. When energized, the actuator causes the piston 684 to move upwardly, thereby flexing the lift lever 690 upwardly so as to lift the rear end 702 of the key to play a note.

Alternatively, the system as illustrated in FIG. 58 may be moved to a different position in the key bed, such as closer to the balance rail 700. As one example, the bar stock 682 may be moved forwardly towards the balance rail with the lift lever and actuators reversed such that the lift lever extends rearwardly to a position under the key. Alternatively, the actuator system, as shown, may be just moved forwardly while retaining its current orientation, such that the front end of the lift lever is positioned closer to the balance rail 700. Also, the length of the lift lever may be different than shown, so as to provide different movement profiles.

Figure 59:
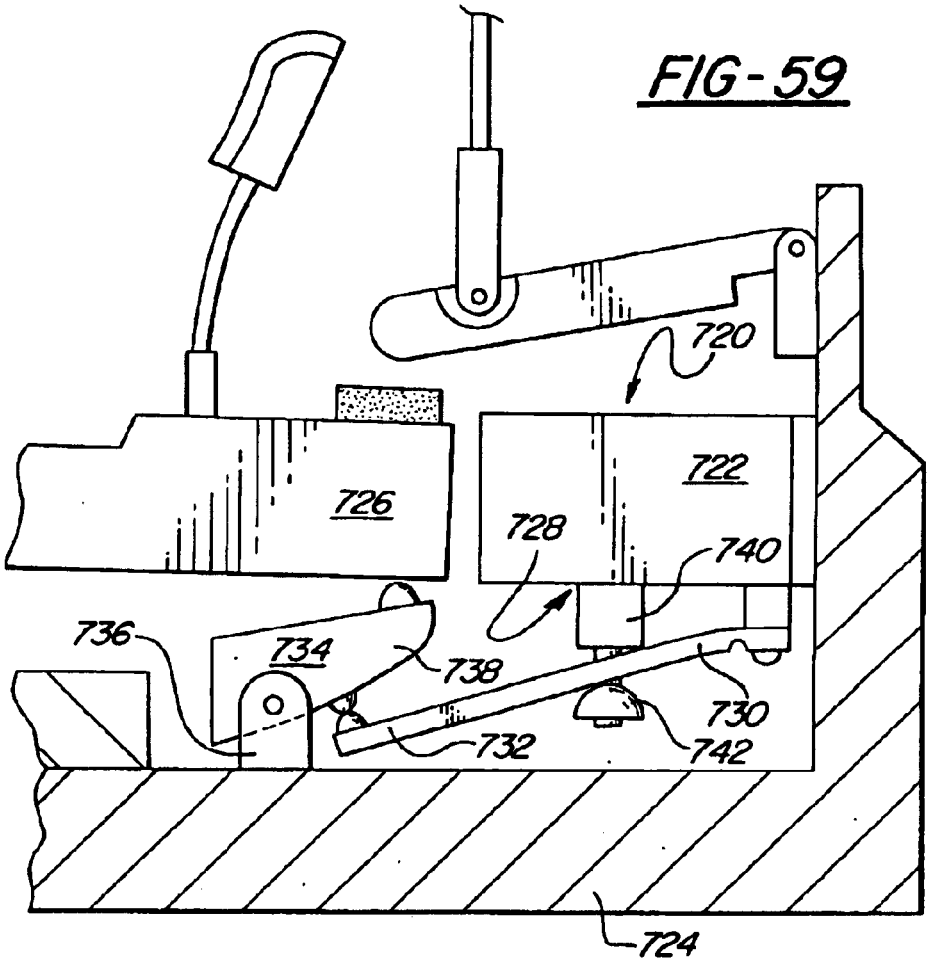
FIG. 59 is a side elevational view of a rear portion of a key along with yet another embodiment of an actuation system therefore.

Referring now to FIG. 59, an actuator system utilizing a flip-type double lift lever system is generally shown at 720. This system is similar to the system of FIG. 57 in that a piece of bar stock 722 is mounted above the key bed 724 behind the rear end 726 of the key. Also, pull type actuators 728 are provided to pull upwardly on a mid-portion of a flexible underlever 730. However, rather than having the front end 732 of the lift lever 730 directly contact the rear end 726 of the key, a secondary lift lever 734 is provided for transferring motion between the primary lift lever 730 and the rear of the key 726. The secondary lift lever 734 is supported by a pivotal support 736 forwardly of the front end 732 of the lift lever 730. From there, the secondary lift lever 734 extends rearwardly to a contact end 738 that is positioned under the rear end of the key 726. The forward end 732 of the primary lift lever 730 contacts the secondary lift lever 734 between the pivotal support 736 and the contact end 738. Therefore, when the actuator 728 is energized, causing it to flex the primary lift lever 730 upwardly, the front end 732 of the primary lift lever presses upwardly on the secondary lift lever 734 causing the contact end 738 to pivot upwardly and to push upwardly on the rear end 726 of the key. As shown, the actuator 728 is a pull type solenoid. Also shown, is a preferred interconnection between the piston 740 of the actuator 728 and the primary lift lever 730. Specifically, the piston 740 extends downwardly and terminates in an upwardly directed curved lifting surface 742 that is positioned under the underside of the primary lift lever 730. This curved lifting surface 742 avoids direct interconnection between the piston 740 and the lift lever 730, thereby allowing more flexibility during actuation. As one alternative, the secondary lift lever 734 may be a flexible lift lever, rather than having a mechanical pivot. Also, if desired, the primary lift lever may be a mechanically pivoted lift lever instead of a flexible lift lever. The length and positioning of the primary 730 and secondary 734 lift levers may be altered to change the movement profiles.

Figure 60:
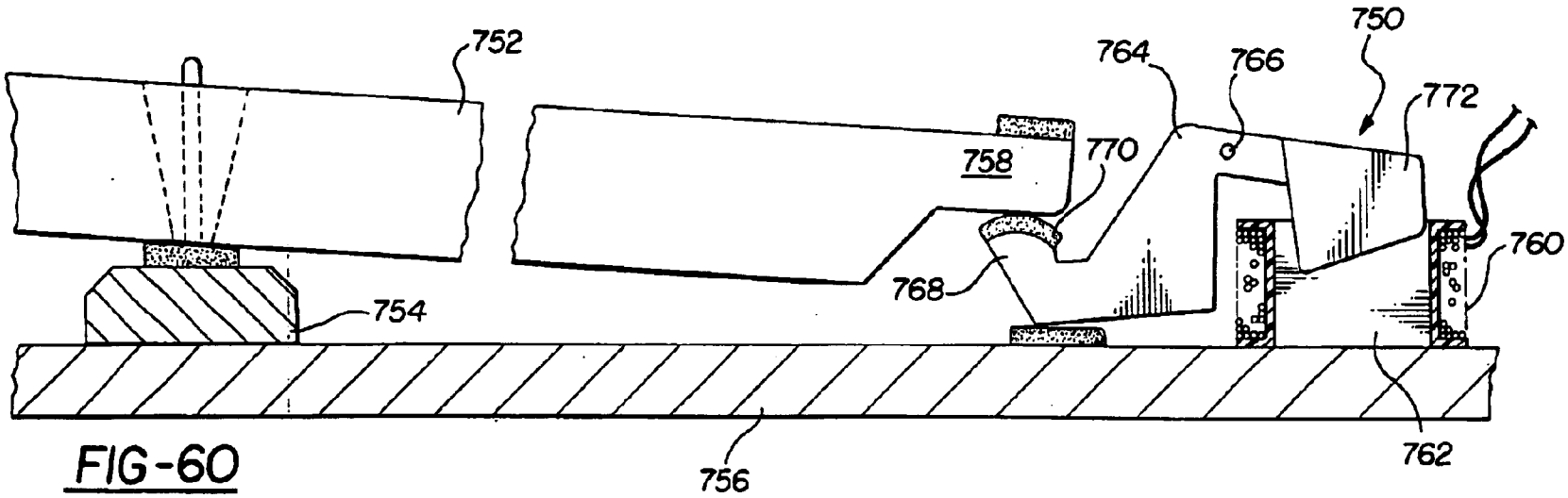
FIG. 60 is a side elevational view of a portion of a key along with a rocking actuator system according to the present invention.
Figure 61:
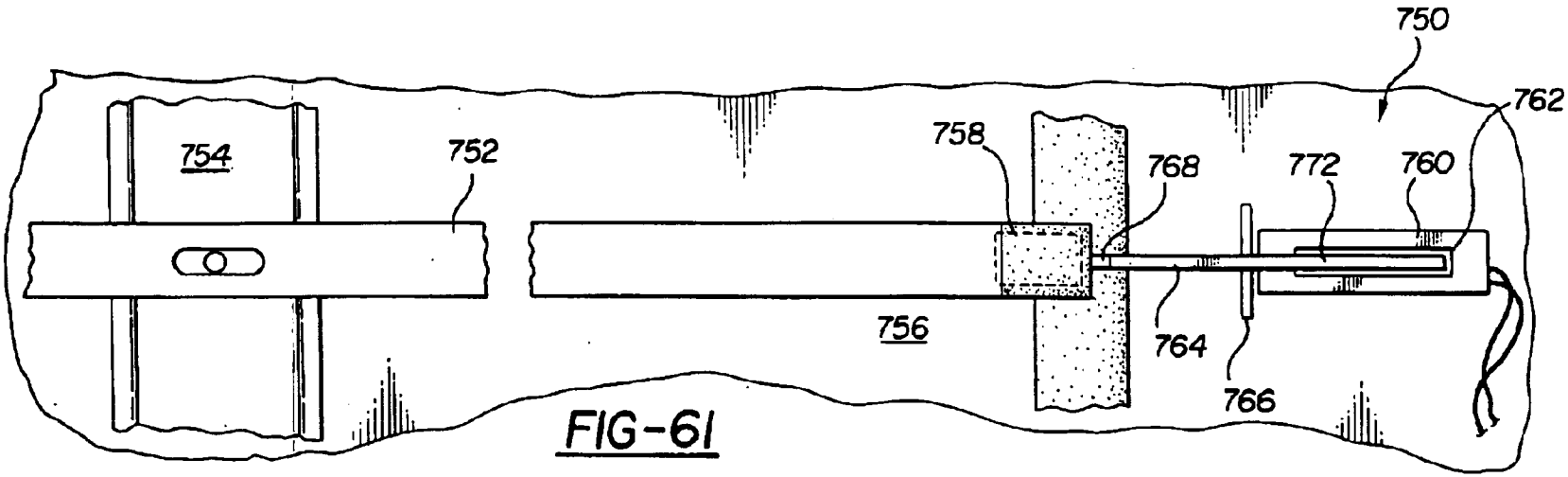
FIG. 61 is a top view of the key and actuator of FIG. 60.

Referring now to FIGS. 60 and 61, an actuator system according to the present invention using a pivotal solenoid design is generally shown at 750. As with previous embodiments, a key 752 is shown supported by a balance rail 754 on a key bed 756. Only a single key 752, having a rear end 758 is shown for clarity of description. However, the system preferably includes multiple actuators and multiple keys. The actuator 752 includes a generally rectangular coil 760 having a central, generally rectangular slot 762 therein. The coil 760 is shown mounted in the key bed 756 rearwardly of the rear end 758 of the key 752, though may be supported and positioned in other ways. A rocking lever 764 is providing for transferring motion from the coil 760 to the rear end 758 of the key 752. Specifically, the rocking lever 764 is pivotally supported by a pivot 766 in a central portion of the lever 764. A portion of the rocking lever 764 extends forwardly of the pivot 766, and a portion extends rearwardly. The frontwardly extending portion extends downwardly and forwardly to terminate in a contact end 768 positioned under the rear end 758 of the key 752. A pad 770 may be provided on the contact end 768. The rear end 758 of the key 752 is shown with a raised lower surface to make more room for the contact end 768 of the rocking lever 764. However, as will be clear to those of skill in the art, the rear end 758 of the key may have other shapes with the contact end 768 of the lever 764 being reshaped to accommodate the shape of the key. The rearwardly extending portion of the rocking lever 764 forms a blade-shaped piston 772 that is shaped and positioned so as to be pulled into the coil 760 when the coil 760 is energized. That is, the piston 772 is shaped so as to fit into the slot 762 in the coil 760 when the rocking lever 764 pivots such that the rearward end moves downwardly. This piston portion 772 of the rocking lever 764 is formed of or includes ferromagnetic material so as to magnetically react with the coil 760. When the coil 760 is energized, the piston portion 772 is pulled downwardly, causing the rocking lever 764 to pivot. This in turn causes the contact end 768 of the rocking lever 764 to move upwardly, which lifts the rear end 758 and the key 752 and plays a note. Preferably, the contact end 768 of the rocking lever 764 is heavier than the piston end 772 so that the lever self-returns to the position shown in FIG. 60. Other return assists may be used. As shown, the rectangular coil 760 has approximately the same width as the key 752. Therefore, multiple coils can be positioned side-by-side to actuate keys that are positioned side-by-side. However, it is preferred to provide larger coils that can be accommodated in this manner so as to provide more actuation power. This may be accomplished in a variety of ways. According to one embodiment, the rectangular coils are interdigitated forwardly and backwardly of each other so as to provide more room for each coil. In this embodiment, longer and shorter rocking lever arms are provided so as to accommodate the variation in position of the coils. As a further alternative, the coils may be alternated above and below one another so as to give more width for each coil. Then, the rocking levers may have tall and short versions to accommodate the variation in vertical positioning of the coils. As an alternative approach to providing additional actuation power, a rectangular push type actuator may be integrated with the contact end 768 of the rocking lever so as to cooperate with the illustrated rectangular pull type actuator. Basically, the contact end 768 of the rocking lever would include a blade-shape piston with a rectangular coil surrounding this piston. When energized, the forward coil would push upwardly on the blade-shaped piston so as to assist in lifting of the contact end to pivot the key 752.

As will be clear to those of skill in the art, a problem encountered with some actuation systems that push or pull upwardly on the rear end of the key is that the key is sometimes lifted upwardly off the balance rail by this actuation. As shown in FIG. 62, a hold down clip may be provided for holding the key downwardly. Specifically, keys typically rest on a balance rail and have a pin 780 extending upwardly through a felt lined slot 782 in the key 784. According to the present invention, the pin 780 has a clip 786 which interconnects therewith for holding the key 784 downwardly on the pin 780. Preferably, a hemispherical washer 788 is provided between the clip 786 and the upper surface of the key 784 so that the clip 786 does not interfere with pivotal movement of the key 784. Other shapes and designs of clips will be clear to those of skill in the art. As one alternative, an acorn nut may be provided that pushes onto the top end of the pin 780 to hold the key downwardly.

Figure 63:
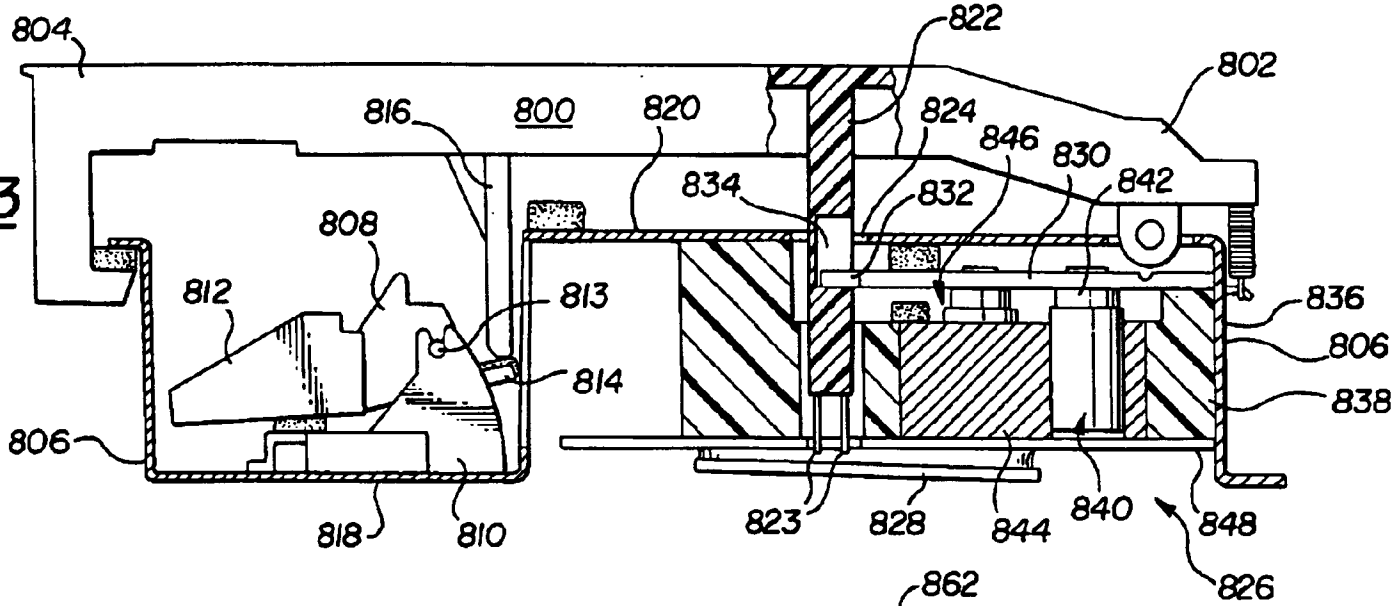
FIG. 63 is a partially cutaway side elevational view of a key from an electronic keyboard with a counterweight system, along with an embodiment of an actuation system according to the present invention.

As discussed previously, a variety of non-acoustic, or electronic, keyboards are available. Some of the embodiments of actuation systems disclosed throughout the specification may be used with some of these non-acoustic keyboards to provide key movement during playback. One type of non-acoustic keyboard, along with an actuation system according to the present invention designed specifically for the keyboard, is shown in FIG. 63. A single key 800 is shown in cross-section. However, as will be clear to those of skill in the art, multiple keys are provided side-by-side to form a complete keyboard. The specific keyboard design illustrated in FIG. 63 is one design produced by Fatar of Italy. The actuation system illustrated, and described hereinbelow, is designed for this keyboard design. It may be suitable for other applications as well. The key 800 is considered to be a half-length key having a rearward end 802 that is pivotally supported, and a front end 804 that is depressed to play a note.

One problem associated with some non-acoustic keyboards is that the keys do not feel the same as the keys on a traditional piano that mechanically produces a sound. Many keyboard players prefer the more traditional feel, and non-acoustic keyboard manufacturers have attempted to provide systems that mimic this feel. The keyboard illustrated in FIG. 63 uses a counterweight system to improve the feel of key movement. As shown, a support member 806 is provided below the key 800. The support member 806 supports all components of the keyboard and is designed to mount on the keyboard of a non-acoustic keyboard instrument. A counterweight 808 is supported by a pivot support 810 extending upwardly from the support member 806. The counterweight 808 consists of a lever having one heavy end 812 on one side of the pivot 813 and an actuation end 814 positioned on the other side of the pivot 813. A counterweight post 816 extends downwardly from the underside of the key a short distance rearwardly of the front end 804. The counterweight post 816 rests against the actuation end 814 of the counterweight 808. When the key 800 is pressed downwardly, the counterweight post 816 presses downwardly on the actuation end 814 of counterweight 808, causing the counterweight 808 to pivot and lift the heavy end 812. This is believed to improve the feel of the keys.

As shown, the support member 806 has a low portion 818 in the area of the counterweight 808 so that the counterweight 808 may be mounted above this low portion 818. Rearwardly of the counterweight system the support member 806 bends upwardly to a position much closer to the underside of the keyboard to define a raised portion 820. In a non-player version of this keyboard, a circuit board is mounted on the upper side of the raised portion 820. Short fingers extend downwardly to communicate motion of the key to the circuit board so that notes may be produced. In the system illustrated in FIG. 63, these short fingers have been replaced with a larger and longer downwardly extending shaft 822 that extends through an opening 824 in the raised portion 820 of the support member 806. The actuation system 826 is mounted under the raised portion 820 with the sensor board 828 mounted on the underside of the actuation system 826 and receiving key movement input from fingers 823 extending from the bottom end of the shaft 822.

The actuation system 826 basically consists of a underlever 830 that has a front end 832 positioned in a pocket 834 in the shaft 822, and a rear end 836 that is mounted to the support member 806 by a block of material 838. A pull-type actuator 840 is mounted below the underlever 830 between the rear end 836 and the front end 832. The piston 842 of the actuator 840 is interconnected with the underlever 830. When actuated, the piston 842 is pulled downwardly causing the underlever 830 to flex downwardly. The front end 832 of the underlever 830 then pulls downwardly on the bottom edge of the pocket 834 in the shaft 822 causing the key 800 to move downwardly as if played. Preferably, the outer coil of the actuator 840 is part of a piece of bar stock 842, as previously described. A second actuator 846 is also shown in FIG. 63. This illustrates the actuator for the adjacent key and that the actuators may be interdigitated. The driver board 648 for driving the actuators is mounted to the underside of the solenoid block 844. As will be clear to those of skill in the art, the actuation system that is illustrated may be modified in various ways. For example, the shaft 822 may be moved forwardly allowing more room for the actuation system or for the actuation system to be moved forwardly. Also, the actuation system could be moved to a position forwardly of the shaft 822 with the underlever extending rearwardly. In this case, the shaft 822 may be moved rearwardly. As another alternative, the underlever may be moved downwardly with the actuators positioned above and pushing downwardly on the underlevers. This actuation system and the alternatives may be used with some other designs of keyboards.

Figure 64:
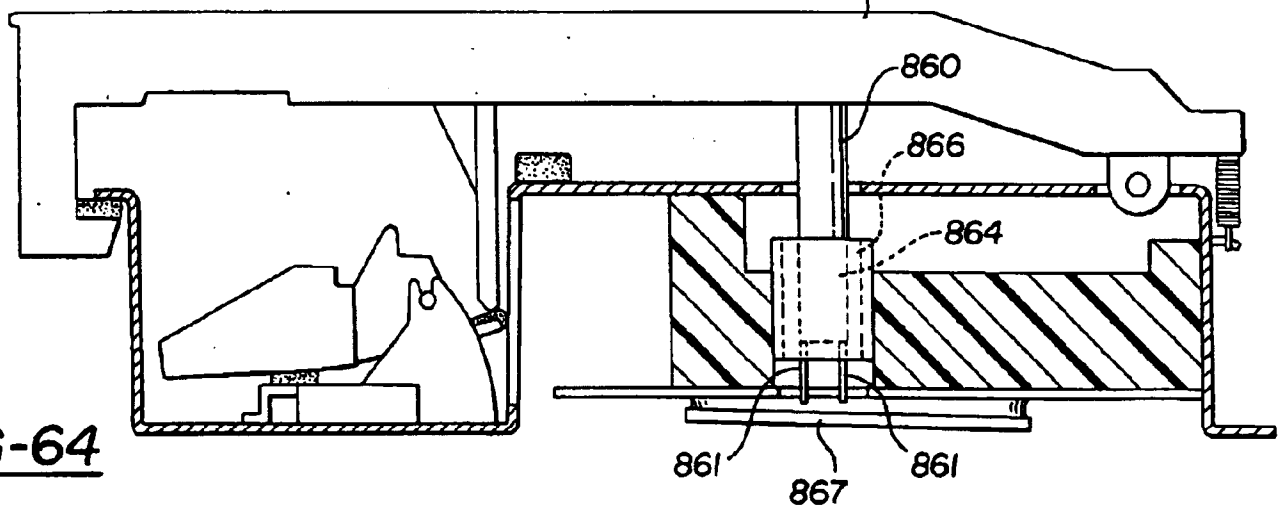
FIG. 64 is a side elevational view of a key and counterweight similar to FIG. 63 with an alternative embodiment of an actuator system therefore.

Referring now to FIG. 64, a keyboard similar to FIG. 63 is shown with a different actuator system. Once again, a shaft 860 extends downwardly from a midportion of the key 862. However, instead of an underlever system pulling downwardly on the shaft 860, a portion of the shaft forms a piston 864 and a coil 866 surrounds this piston. Preferably, the coil is ovalized to accommodate the shaft as it moves. Alternatively, the piston portion 864 could be blade shaped with the coil 866 being more rectangular in shape. When energized, the coil 866 pulls downwardly on the piston portion 864 of the shaft 860 causing the key 862 to move downwardly as if played. Fingers 861 extend from the lower end of the shaft 860 and communicate key motion to the sensor board 867. As discussed previously, a coil or winding may be used to sense movement of a nearby piece of magnetic material. This approach can be used to sense key movement in many of the embodiments of the present invention. This is particularly applicable to the embodiment of FIG. 64. The coil 866 may be used for moving the keys as well as sensing movement, allowing the original key movement sensing system to be eliminated. The other approaches to sensing key motion discussed herein may also be used with any embodiment.

Figure 65:
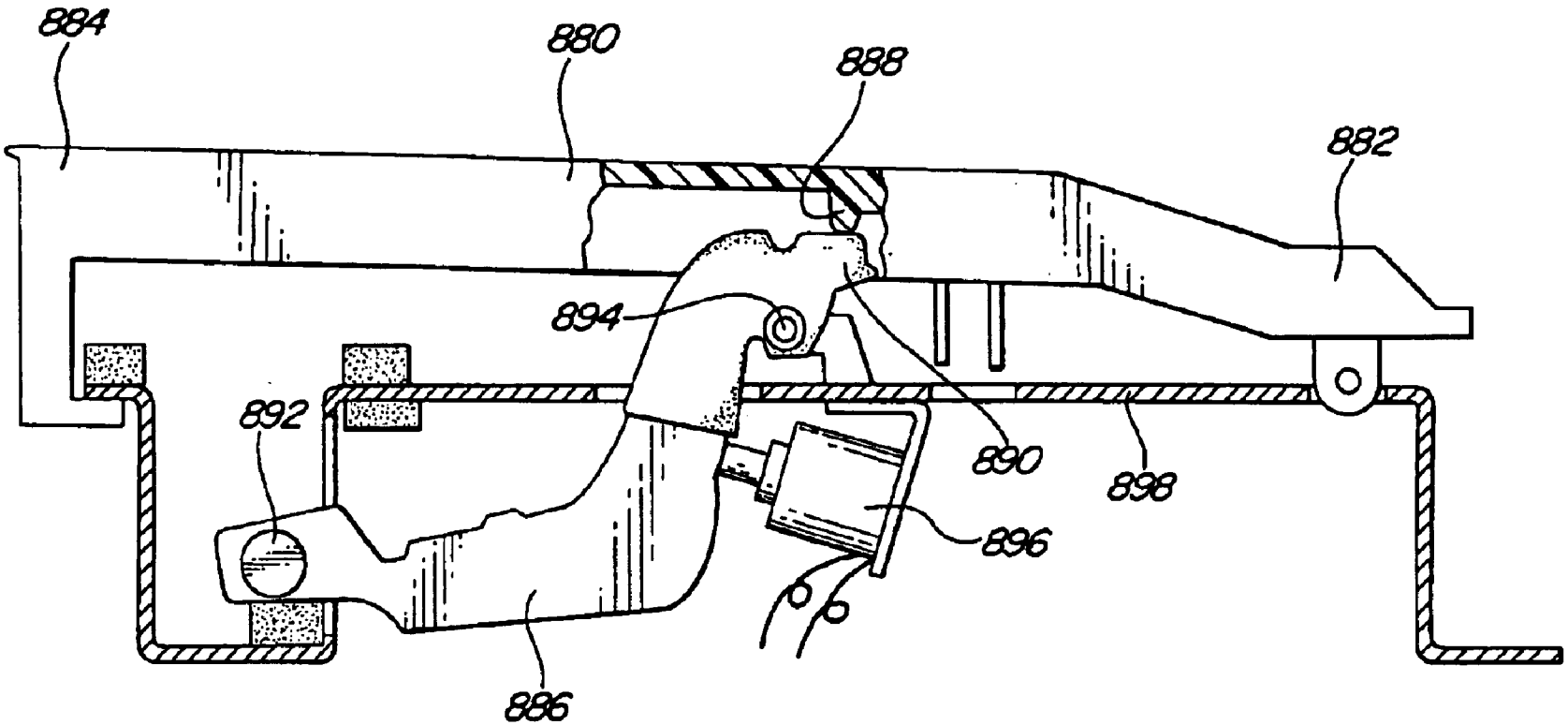
FIG. 65 is a side elevational view of another design of an electronic keyboard key along with a counterweight system and an actuator for moving the counterweight.

Referring now to FIG. 65, a different design of a keyboard is shown, along with an actuation system according to the present invention. The illustrated keyboard design is another design produced by Fatar of Italy. The design is similar to the design of FIGS. 63 and 64 in that a half-length key 880 is used with a rear end 882 that is pivotally supported and a front end 884 that is pressed downwardly. In this keyboard, a pivoting counterweight 886 is also provided, though its shape differs substantially from the previous design. The key 880 has a very short counterweight actuation post 888 extending downwardly. The counterweight 886 has an actuation end 890 positioned under the post 888 and a weighted end 892 extending forwardly. A pivot 894 supports the counterweight near the actuation end 890. As will be clear from the drawing, when the key 880 is pressed downwardly, the post 888 pushes downwardly on the actuation end 890 of the counterweight 886 causing the counterweight to pivot and lift the weighted end 892. Once again, this counterweight design is intended to provide for an improved keyboard feel. According to the present invention, movement of the key 880 may be achieved by moving an actuator to move the counterweight 886. In the embodiment of FIG. 65, a push-type solenoid 896 is provided and positioned so as to push forwardly and/or upwardly on the portion of the counterweight 886 forward of the pivot 894. The solenoid or actuator 896 may be positioned in a variety of places, with the illustrated position providing packaging benefits. Specifically, the actuator 896 is mounted just below the raised portion of the support member 898 in an empty area. When the actuator 896 is energized, the counterweight 886 is pivoted as if moved during playing. This removes the upward force on the post 888 on the underside of the key 880, allowing the key to move downwardly as if played. As will be clear to those of skill in the art, it is not necessary to move the keys of a non-acoustic keyboard instrument in order to cause the instrument to produce a note. Instead, the playback system may directly communicate with a playback system such that no key movement is actually required. Instead, key movement is primarily for aesthetic and entertainment purposes.

Figure 66:
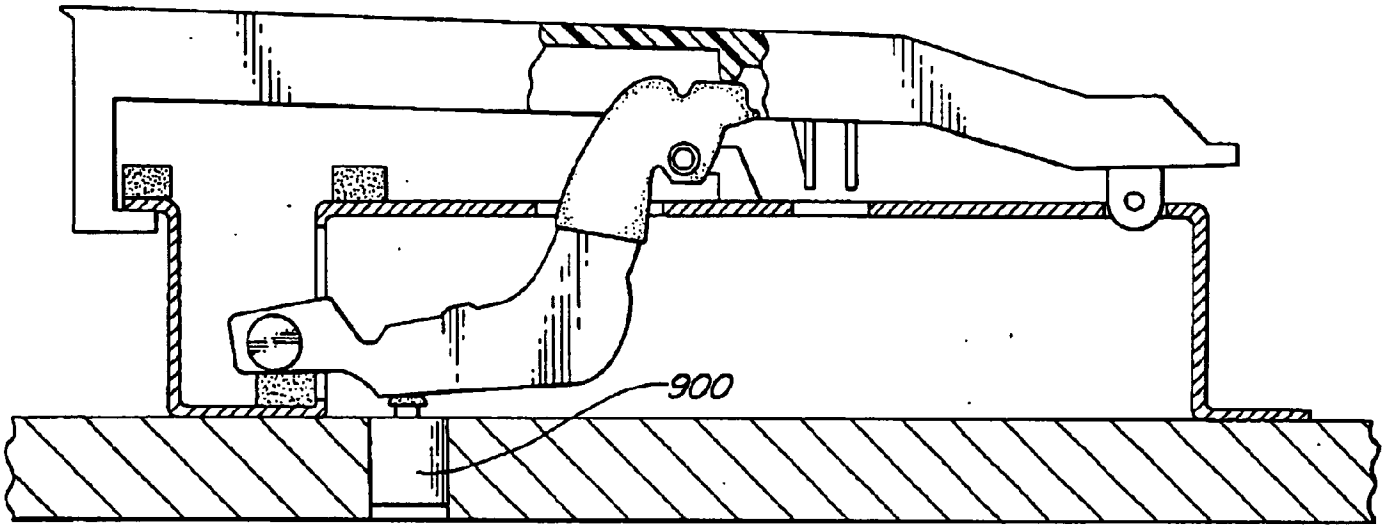
FIG. 66 is a side elevational view of a key and counterweight similar to FIG. 65 along with an alternative actuator therefore.

Referring now to FIG. 66, an alternative positioning of a push-type solenoid is illustrated. Specifically, the push-type solenoid 900 is positioned more forwardly and pushes more upwardly on the front end of the counterweight. Once again, this causes pivoting of the counterweight and the key to move downwardly as it played.

Figure 67:
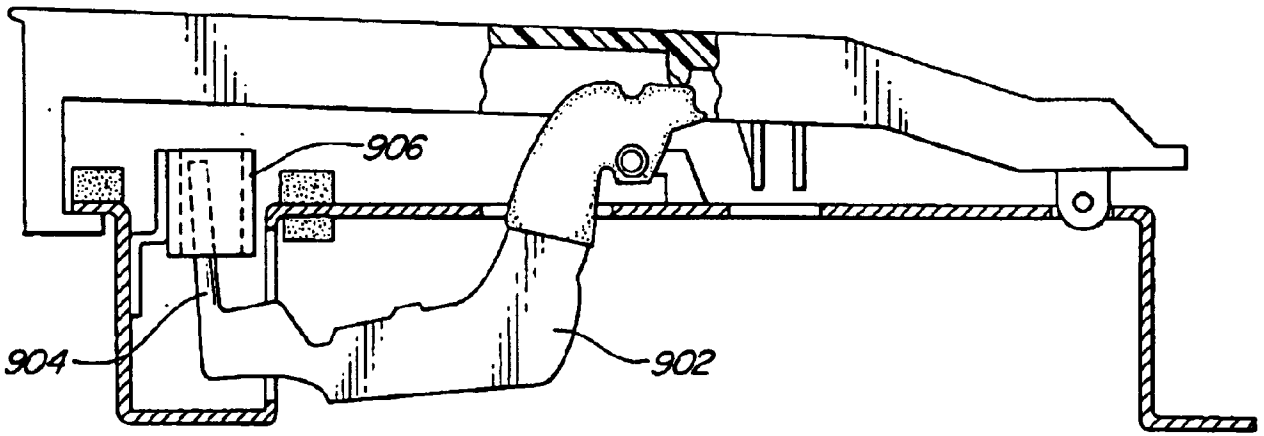
FIG. 67 is a side elevational view of a key and counterweight similar to FIG. 65 along with another alternative actuator therefore.

FIG. 67 shows yet another approach to moving the counterweight 902. In this embodiment, the forwardmost end of the counterweight 902 includes a piston portion 904 that is surrounded by a coil 906. When the coil 906 is energized, the piston portion 904 is moved upwardly causing the counterweight 902 to pivot. The coil may be ovalized with a generally round piston, or generally rectangular with a blade-shaped piston.

Figure 68:
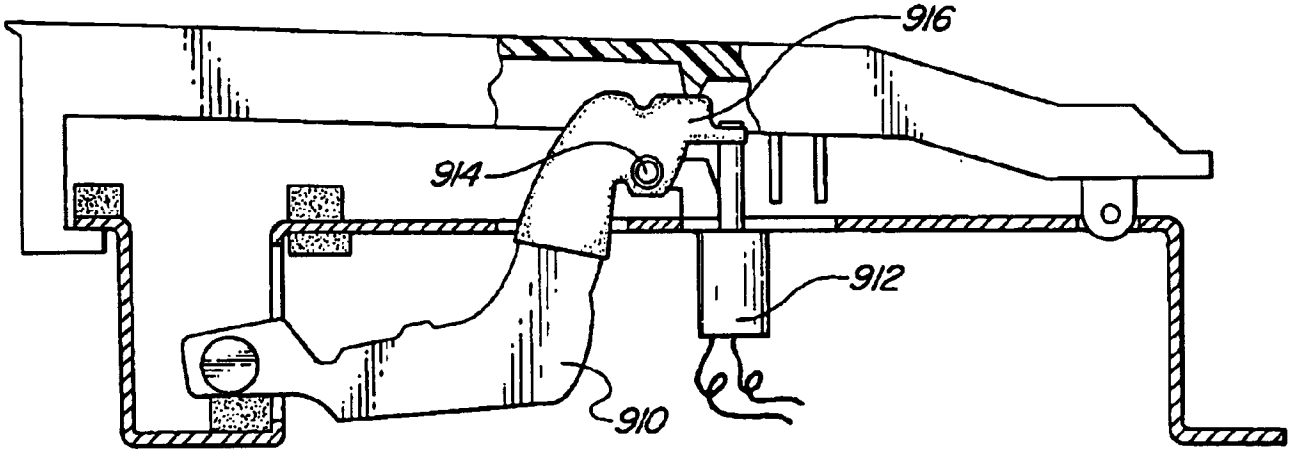
FIG. 68 is a side elevational view of a key and counterweight similar to FIG. 65 along with yet another embodiment of an actuator therefore.

FIG. 68 shows yet another approach to moving the counterweight 910. A pull-type actuator 912 is provided rearwardly of the pivot 914 and interconnects with the actuation end 916 of the counterweight 910. Actuation of the pull-type actuator 912 causes the actuation end 916 of the counterweight to be pulled downwardly, causing the key to move as if played. As will be clear to those of skill in the art, the embodiments of FIGS. 65–68 may be modified in various ways without departing from the scope of the invention. For example, the counterweight system could differ from the system illustrated. Alternatively, the actuation system of FIGS. 63 and 64 may be applied to the keyboard design of FIGS. 65–68. Likewise, the actuation system of FIGS. 65–68, wherein the counterweight is directly moved, may be applied to the keyboard design of FIGS. 63 and 64. Also, any of these approaches to actuation may be applied to other keyboard designs. As discussed earlier, it is sometimes desirable to reduce or increase resistance to key movement to change the feel of a keyboard. All embodiments of the present invention, including the embodiments of FIGS. 63–68 may be used for this purpose.

Figure 69:
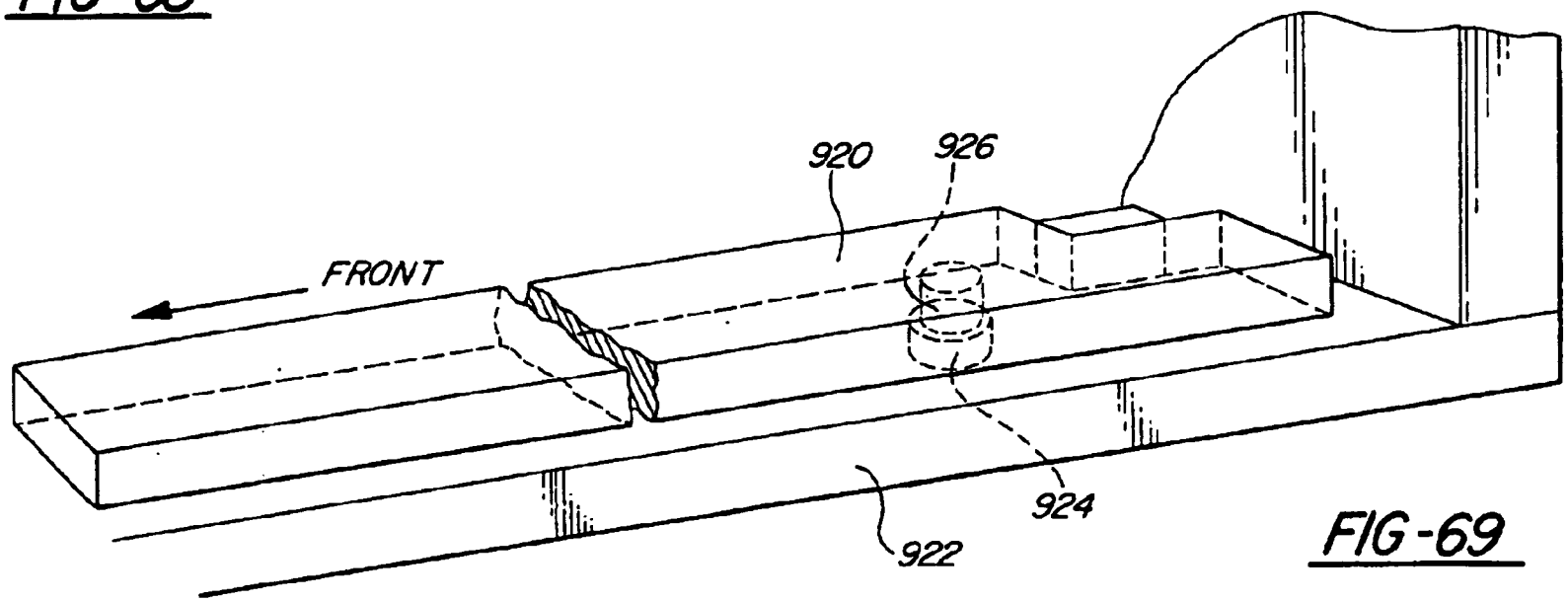
FIG. 69 is a partial view of a key bed and key frame showing the end interconnection system according to the present invention.

When a key action is installed into a keyboard instrument such as a piano, it is preferred that the key action be held securely downwardly so that it does not move unintentionally. Typically, the key frame is held in the key bed by some type of hold down bracket. However, for some of the actuation systems according to the present invention, this hold down bracket is in the way and is preferably removed. In this case, some other approach to holding down the rear of the key frame is preferred. FIG. 69 shows one such approach. A portion of the key frame 920 is shown resting on a portion of the key bed 922, with an arrow indicating the front of the key frame and key bed. According to the present invention, a magnet 924 is embedded in the key bed 922 and a steel target 926 is embedded in the key frame. When the key frame is installed on the key bed, the target 926 aligns with the magnet 924 and the magnet 924 holds the target 926 downwardly in position. As will be clear to those of skill in the art, the combination of the magnet and target can provide significant downward force to retain the key frame in position. Also, as will be clear to those of skill in the art, it is necessary that a key frame be capable of moving side-to-side in response to pedal usage. The magnet and steel target will slide relative to one another with very little resistance, but will continue to resist being spread apart. The sliding distance is very short and the magnet 924 is preferably larger than the target to accommodate the sliding. For example, the magnet may be ¾ inch in diameter and ½ inch thick and the target may be ½ inch diameter. If necessary, a very strong magnet may be used in this application.

As discussed previously, non-acoustic keyboard instruments and electronic keyboards are widely available and popular. Many of these keyboard instruments use electronic circuitry and speakers to synthesize various sounds as the keyboard is being played. In this way, the keyboard instruments can mimic a variety of instruments, including keyboard instruments such as pianos and organs, as well as non-keyboard instruments. However, it is very difficult to accurately reproduce the sound qualities associated with an acoustical piano. Therefore, there is a need for improved approaches to producing sound from electronic keyboards.

Figure 70:
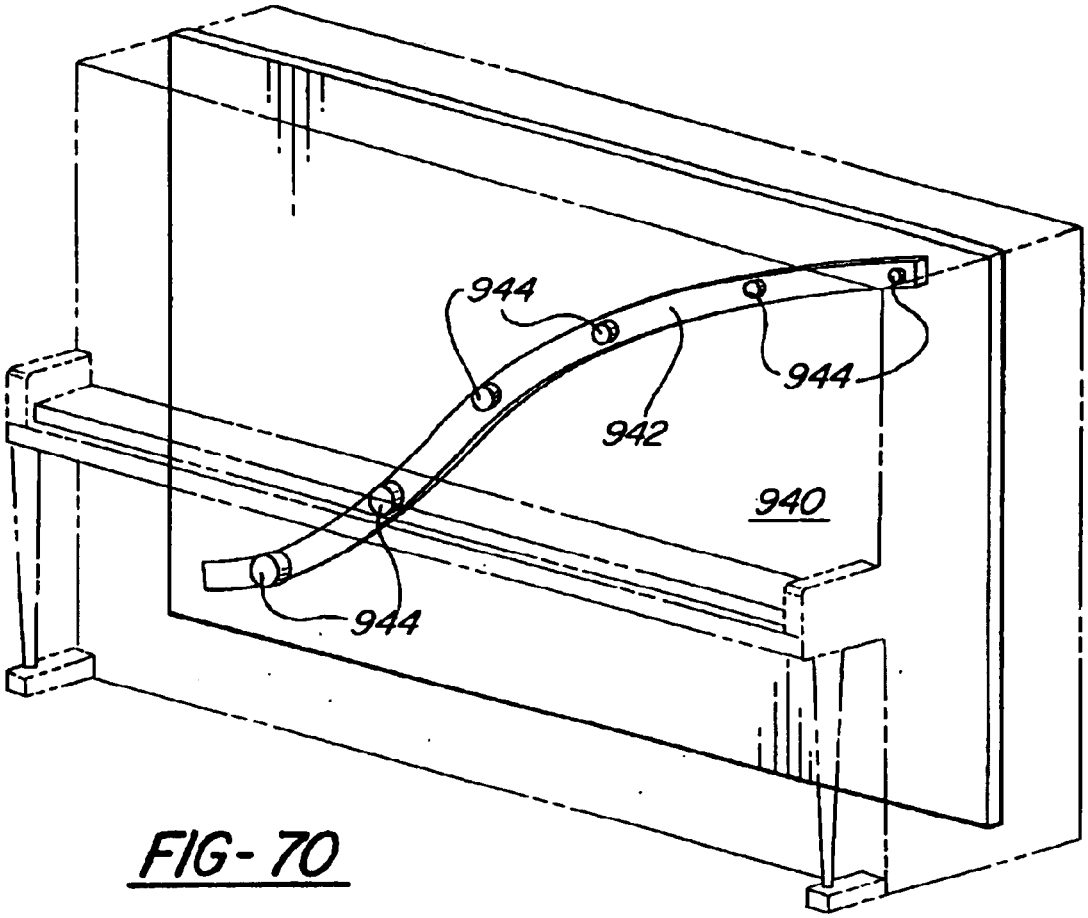
FIG. 70 is a perspective view of a portion of a system for producing sound from a sound board.

Referring to FIG. 70, one approach to providing improved sound is generally illustrated in an upright piano-style instrument. Instead of the typical electronic speaker system, or in addition thereto, the keyboard instrument is provided with a large sound 940 with a bridge 942 similar to a traditional acoustic piano. On the bridge 942 are positioned six voice coils 944 of various sizes. The voice coils are similar to voice coils used in loudspeakers and have an outer section consisting of a magnet and an inner section that is a wound coil. These could be reversed in the present application. By feeding various signals to the winding in the outer section, the inner section can be subjected to various forces. In a loudspeaker, the outer section is connected to a support frame and the inner section is connected to the cone of the speaker. The cone is then caused to move by the electromagnetic forces exerted on the inner section. In the present invention, either the inner section or outer section is supported by a support frame and the other piece of the voice coil is connected to the bridge 942 on the sound board 940. Then, the voice coils may be used to impart various forces and vibrations into the bridge and sound board causing sounds to be produced. This is similar to the way sound is produced in a piano by a vibrating string. Specifically, the vibrating strings extend across the bridge and transmit vibrations into the sound board. Likewise, the voice coils can transmit vibration into the sound board. Such a system may also be provided in a grand piano style instrument.

Figure 72:
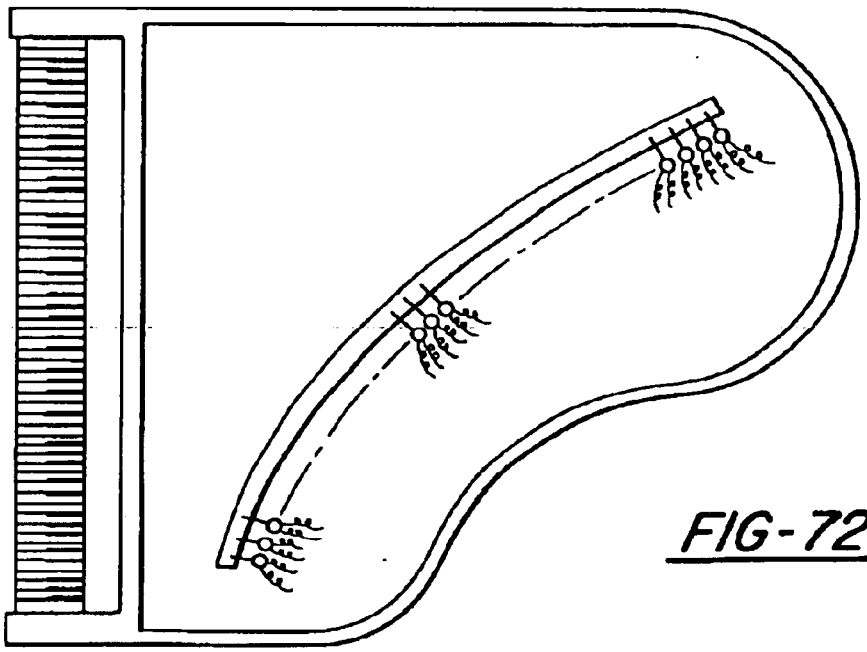
FIG. 72 is a top plan view of a sound board of a grand piano-style instrument with vibration sources similar to FIG. 71.
Figure 71:
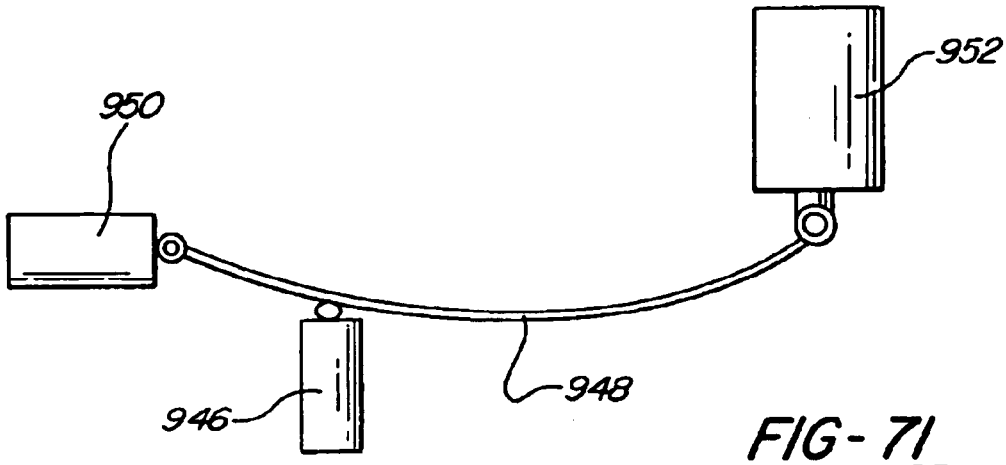
FIG. 71 is a sketch of a force and vibration creation system for transmitting vibrations into a sound board.

Other approaches may be used for transmitting forces into the sound bridge of a piano-type instrument. FIG. 71 shows a portion of a sound bridge 946 that would be supported on a sound board in a keyboard instrument. A stressed member 948, such as a spring, is connected at one of its ends to a support 950, and is hooked to the other end to the piston portion of an actuator 952. The stressed member 948 rests against the bridge 946 between its two ends. By energizing the actuator 952, various forces may be transmitted into the bridge 946. FIG. 72 shows a grand piano-style instrument using the stressed member actuator system of FIG. 71. As shown, multiple actuators may be provided. In this embodiment, as well as with the use of voice coils, various actuators may be dedicated to different frequency ranges, or multiple actuators may be used when more force is required.

Figure 73:
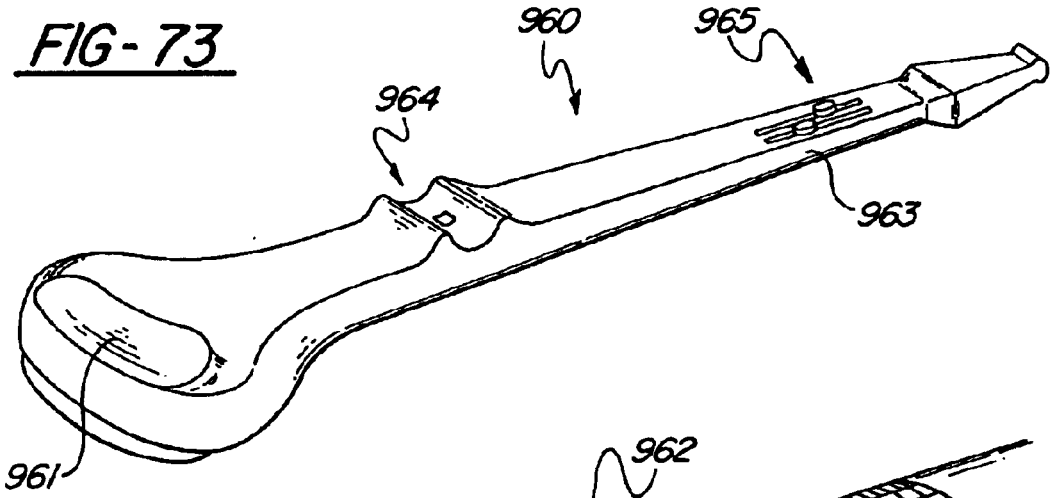
FIG. 73 is a perspective view of an electric violin according to the present invention.
Figure 74:
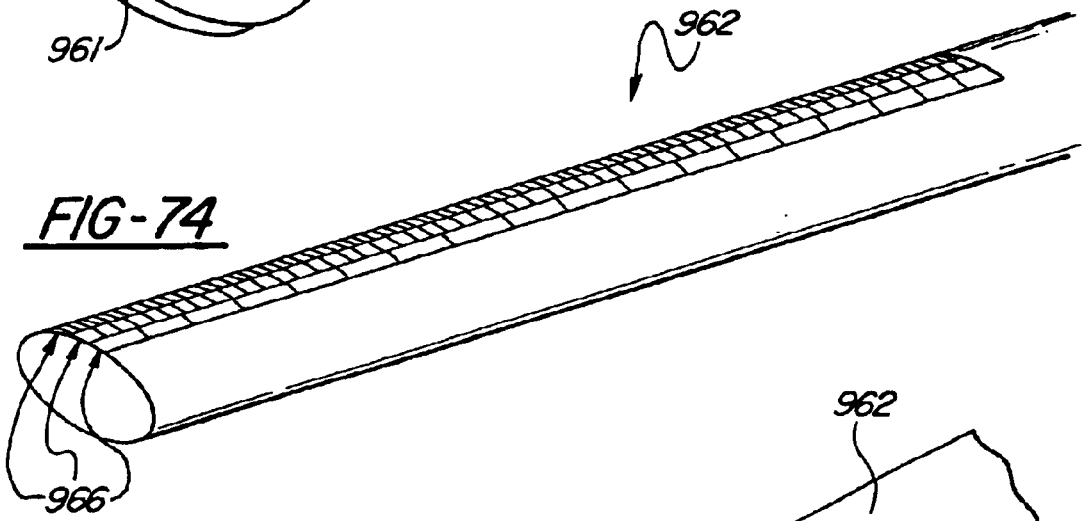
FIG. 74 is a perspective view of a portion of a bow for use with the electric violin of FIG. 73.
Figure 75:
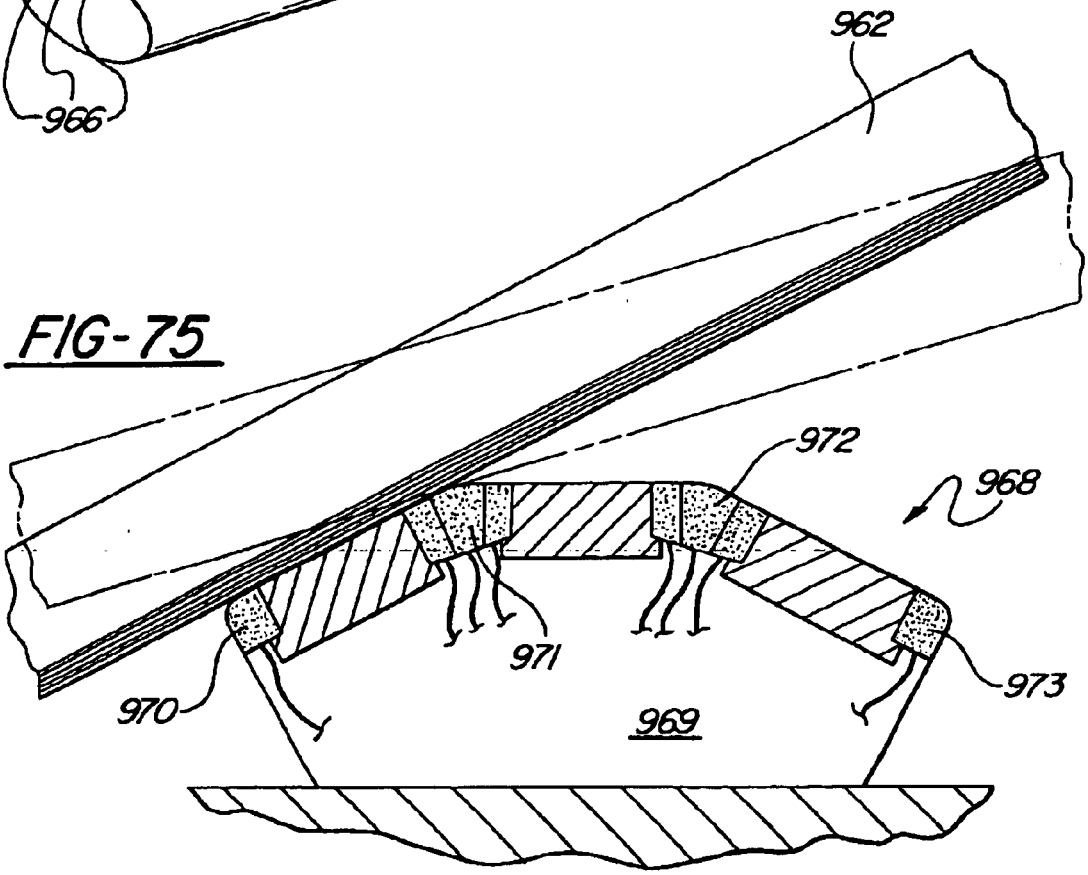
FIG. 75 is a detailed view of one embodiment of a sensor for use with the electric violin of FIG. 73.

Referring now to FIGS. 73 and 74, an embodiment on an electronic violin-type instrument will be described. In FIG. 73 an electric violin is generally shown at 960 and the bow is shown in FIG. 74 generally at 962. The violin 960 has a chin rest 961 at one end and a neck 963 at the other. Between these ends is a sensor saddle 964. A pair of sliding switches 965 are provided on the neck 963. The bow 962 has one or more strips of magnetic or optical encoded pulses. Three strips 966 are shown with various densities of encoded pulses. Cross-hatches on drawn on the strips 966 to represent encoded pulses. However, the encoding may or may not be visible. To play the instrument, the bow 962 is pulled across the sensor saddle 964 so that the sensor in the sensing sensor saddle can read the encoded pulses in the strips 966. As will be clear by reference to the drawing, the bow 962 may be rotated so that different sensing strips are read by the sensor in the sensor saddle 964. The speed and angle of the bow 962 may also be varied by the player. The player may also manipulate the sliding switches 965, as well as other controls and switches which may be alternatively provided. FIG. 75 shows one embodiment of a sensor for the sensor saddle, generally at 968. The sensor 968 includes a support bridge 969 with sensors 970, 971, 972, and 973 disposed thereon. The sensors 970–973 are distributed similar to the positioning of strings on a violin bridge and allow different sensors to be contacted depending on the position of the bow 962. The sensors 970–973 may be optical or magnetic sensors operable to read the pulses off of the bow. Also, the sensors may be multi-part sensors such as shown by 971 and 972. Each of these sensors includes three parts so that the angle of the bow may be determined. This helps a determination of whether the bow is in a position that would mimic contacting two violin strings in an acoustic violin. As will be clear to those of skill in the art, playing the electric violin illustrated herein creates an output of a significant amount of electronic information. For example, the player may alter the speed of pulses read by any or all sensors and manipulate the sliding switches. In one embodiment, changing the speed that pulses are received by the sensors changes the loudness of sound produced by the electric violin and the sliding switches change the frequency or tone of the sounds. Cords may be created by drawing the bow across two sensors at the same time. In another embodiment, the tone or frequency of the sound may be altered by the frequency of the pulses read by the sensors. Therefore, speeding up or rotating the bow causes changes in frequency. The sliders may then be used to control volume or other aspects of the sound. Consequently, the electric violin provides for great flexibility in the production and the manipulation of sound.

Having described my invention, however, many modifications thereto will become apparent to those of skill in the art to which it pertains without deviation from the spirit of the invention.

I claim:

1. A key actuation system for a keyboard instrument of the type having a plurality of keys, each key having an upper surface and a lower surface and being pivotally supported above a key bed, each key further having a front end that is depressed by a player to play a note, the key bed extending under and spaced from the lower surface of the key, the actuation system comprising:

an underlever disposed in the space between the lower surface of the key and the key bed and between the front end of the key and the pivotal support, the underlever having a first end that is supported in a stationary position relative to the key bed, a second end that is movable towards and away from the key bed, and a midportion therebetween, the second end of the underlever being in mechanical communication with the key such that movement of the second end of the underlever towards the key bed causes the key to move as if depressed by a player;

an actuator in mechanical communication with the underlever and operable to move the second end of the underlever towards the key bed.

2. The key actuation system according to claim 1, wherein the actuator comprises a pull solenoid having a coil portion and a piston, the solenoid operative when the coil portion is energized to draw the piston into the coil portion, the solenoid mounted such that the coil portion is disposed below the midportion of the underlever, the piston being in mechanical communication with the midportion of the underlever such that when the coil portion of the solenoid is energized, the piston pulls the midportion of the underlever downwardly causing the second end of the underlever to move towards the key bed.

3. The key actuation system according to claim 1, wherein the actuator comprises a push solenoid having a coil portion and a piston, the solenoid operative when the coil portion is energized to push the piston out of the coil portion, the solenoid mounted such that the coil portion is disposed above the midportion of the underlever, the piston being in mechanical communication with the midportion of the underlever such that when the coil portion of the solenoid is energized, the piston pushes the midportion of the underlever downwardly causing the second end of the underlever to move towards the key bed.

4. The key actuation system according to claim 1, wherein the underlever is a flexible underlever that flexes when the actuator moves the underlever.

5. An actuation system for a keyboard instrument of the type having a plurality of pivotally supported keys having front ends that are depressed by a player to play a note, the keyboard instrument further having a counterweight system comprising a counterweight that is supported separate from the keys, the counterweight being in mechanical communication with one of the keys such that depression of the front end of the key causes the counterweight to move in a first direction, the actuation system comprising:

an actuator operable to move the counterweight in the first direction.

6. The actuator system according to claim 5, wherein the counterweight is pivotally supported and pivots when the key is depressed, the first direction being a rotational direction and the actuator being operable to pivot the counterweight in the first rotational direction.

7. The actuator system according to claim 5, wherein the actuator is a push solenoid having a coil portion and a piston, the actuator operable when the coil portion is energized to push the piston at least partially out of the coil portion, the solenoid being mounted such that the piston is in mechanical communication with part of the counterweight and is operable to push on the part of the counterweight when the coil portion is energized to cause the counterweight to move in the first direction.

8. The actuator system according to claim 5, wherein the actuator is a pull solenoid having a coil portion and a piston, the actuator operable when the coil portion is energized to draw the piston into the coil portion, the solenoid being mounted such that the piston is in mechanical communication with part of the counterweight and is operable to pull on the part of the counterweight when the coil portion is energized to cause the counterweight to move in the first direction.

9. The actuator system according to claim 5, wherein a portion of the counterweight comprises a ferromagnetic material and the actuator is operable to electromechanically move the ferromagnetic material to cause the counterweight to move in the first direction.

10. An actuation system for a keyboard instrument of the type having a plurality of pivotally supported keys having front ends that are depressed by a player to play a note, the keyboard instrument further having a counterweight system comprising a counterweight that is in mechanical communication with one of the keys such that depression of the front end of the key causes the counterweight to move in a first direction, the actuation system comprising:

an actuator overable to move the counterweight in the first direction, the actuator being a push solenoid having a coil portion and a piston, the actuator operable when the coil portion is energized to push the piston at least partially out of the coil portion, the solenoid being mounted such that the piston is in mechanical communication with part of the counterweight and is operable to push on the part of the counterweight when the coil portion is energized to cause the counterweight to move in the first direction.

11. An actuation system for a keyboard instrument of the type having a plurality of pivotally supported keys having front ends that are depressed by a player to play a note, the keyboard instrument further having a counterweight system comprising a counterweight that is in mechanical communication with one of the keys such that depression of the front end of the key causes the counterweight to move in a first direction, the actuation system comprising:

an actuator operable to move the counterweight in the first direction, the actuator is being a pull solenoid having a coil portion and a piston, the actuator operable when the coil portion is energized to draw the piston into the coil portion, the solenoid being mounted such that the piston is in mechanical communication with part of the counterweight and is operable to pull on the part of the counterweight when the coil portion is energized to cause the counterweight to move in the first direction.

12. An actuation system for a keyboard instrument of the type having a plurality of pivotally supported keys having front ends that are depressed by a player to play a note, the keyboard instrument further having a counterweight system comprising a counterweight that is in mechanical communication with one of the keys such that depression of the front end of the key causes the counterweight to move in a first direction, the actuation system comprising:

an actuator operable to move the counterweight in the first direction, a portion of the counterweight comprising a ferromagnetic material and the actuator being operable to electromechanically move the ferromagnetic material to cause the counterweight to move in the first direction.

13. A player keyboard instrument for producing notes and actuating the keys to simulate being played by an operator, the keyboard instrument comprising:

a key bed;

a plurality of keys, each key having an upper surface and a lower surface and being pivotally supported above the key bed, each key further having a front end that is depressed by a player to play a note, the key bed extending under and spaced from the lower surface of the key, each key having a post extending downwardly from the lower surface of the key towards the key bed, the post including a portion of ferromagnetic material;

a counterweight system comprising a plurality of counterweights, one of the counterweights being in mechanical communication with each of the keys such that depression of the front end of each key causes the corresponding counterweight to move in a first direction;

a plurality of actuator coils disposed in the space between the lower surface of the keys and the key bed, one of the actuator coils being disposed about each of the posts, each actuator coil operable to electromechanically move the ferromagnetic portion of the corresponding post downwardly so as ta move the corresponding key.

14. A key actuation system for a keyboard instrument of the type having a plurality of keys, each key being pivotally supported and having a front end that is depressed by a player to play a note, the actuation system comprising:

a plurality of actuators operable to move at least some of the plurality of keys, the plurality of actuators together comprising:

a block of ferromagnetic material with a plurality of bores defined therein, a winding disposed in each of the bores, each of the windings having a hole defined therein, and a piston at least partially disposed in each of the holes, each piston being in mechanical communication with one of the keys such that movement of the piston causes movement of the key;

wherein energizing one of the windings causes the corresponding piston to move relative to the winding, thereby moving one of the keys.

15. The key actuation system according to claim 14, wherein each of the keys further has a rear end that moves upwardly when the front end is depressed, the actuation system further comprising a plurality of underlevers each having a movable end and a mounted end, the movable end being positioned under the rear end of one of the keys such that upward movement of the movable end causes the movable end to lift the rear end of the key upwardly, the underlevers providing the mechanical communication between the pistons and the keys.

16. The key actuation system according to claim 15, wherein the block is positioned rearwardly of the rear ends of the keys and the underlevers are disposed above the block, the plurality of actuators being push solenoids such that energizing the windings causes the pistons to move upwardly out of the holes in the windings and push on the underlevers.

17. The key actuation system according to claim 15, wherein the block is positioned rearwardly of the rear ends of the keys and the underlevers are disposed below the block, the plurality of actuators being pull solenoids such that energizing the windings causes the pistons to be drawn upwardly into the holes in the windings and to pull on the underlevers.

18. The key actuation system according to claim 14, further comprising a plurality of underlevers each having a movable end and a mounted end, the movable end being positioned under the one of the keys between the front end of the key and the pivotal support, the movable end being in mechanical communication with the key such that downward movement of the movable end causes the front end of the key to be moved downwardly, the underlevers providing the mechanical communication between the pistons and the keys.

19. The key actuation system according to claim 18, wherein the block is positioned below the underlevers, the plurality of actuators being pull solenoids such that energizing the windings causes the pistons to be drawn downwardly into the holes in the windings and to pull down on the underlevers.

20. The key actuation system according to claim 18, wherein the block is positioned below the keys and above the underlevers, the plurality of actuators being push solenoids such that energizing the windings causes the pistons to move downwardly out of the holes in the windings and to push down on the underlevers.

21. A key actuation system for a keyboard instrument of the type having a key fulcrum pivotally supporting a plurality of keys, each key having a front end disposed forward of the fulcrum which is depressed by a player, and a rear end disposed rearward of the fulcrum that pivots upwardly when the front end is depressed, said system comprising:

a pivotal support;

a rocking lever arm supported by the support and having a lifting end on one side of the support in mechanical communication with the rear end of one of the keys and a piston end on the other side of the support, the piston end including a portion of ferromagnetic material; and an actuator coil having a opening therein, the coil disposed such that the piston end of the lever arm is at least partially disposed in the opening, the actuator operable to electromechanically move the piston end of the lever arm.

22. The actuation system according to claim 21, wherein the piston end of the rocking lever arm is generally blade shaped and the coil is generally rectangular with a generally rectangular opening therein.

23. The actuation system according to claim 21, wherein the pivotal support is disposed rearward of the rear end of the key and the piston end of the lever arm is positioned rearward of the pivotal support.

24. A key actuation system for a keyboard instrument of the type having a plurality of pivotally supported keys each having a front end which is to be depressed by a player to pivot the key, said system comprising:

a primary underlever having a mounted end and a free end that is movable in at least a first direction;

an actuator operable to move the primary underlever such that the free end of the primary underlever moves in the first direction; and a secondary underlever having a mounted end and a free end that is movable in at least a second direction, the free end being in mechanical communication with one of the keys such that when the free end of the secondary underlever moves in the second direction, the key pivots as if depressed by a player, the secondary underlever further having a midportion defined between the mounted and free ends;

the free end of the primary underlever being in mechanical communication with the midportion of the secondary underlever such that when the free end of the primary underlever moves in the first direction, the free end of the secondary underlever is moved in the second direction.

25. A player keyboard instrument for producing notes and actuating the keys to simulate being played by an operator, the keyboard instrument comprising:

a plurality of pivotally supported keys, each key having an upper surface and a lower surface, each key further having a front end that is depressed by a player to play a note, each key having a post extending downwardly from the lower surface of the key, the post including a portion of ferromagnetic material;

a sensor operable to sense movement of the posts of each of the keys;

a sound reproduction system in communication with the sensor and operable to produce sound in response to movement of the posts; and a plurality of actuator coils, one of the actuator coils being disposed about each of the posts, each actuator coil operable to electromechanically move the corresponding post downwardly so as to move the corresponding key.

26. The keyboard according to wherein the claim 25, wherein the sensor comprises a plurality of individual sensors.

27. The keyboard instrument according to claim 25, wherein each of the posts includes a finger extending from a lower end thereof, the sensor being operable to sense movement of fingers.

* * * * *

UNITED STATES PATENT AND TRADEMARK OFFICE

CERTIFICATE OF CORRECTION

PATENT NO. : 6,781,046 B2
DATED : August 24, 2004
INVENTOR(S) : David Meisel

It is certified that error appears in the above-identified patent and that said Letters Patent is hereby corrected as shown below:

Column 17,
Line 63, "absract" should be replaced with -- abstact --.

Column 18,
Line 56, "connect" should be replaced with -- connects --.
Line 62, " "played"." should be replaced with -- "played." --.

Column 20,
Line 10, "stop" should be replaced with -- stops --.

Column 26,
Line 3, the second occurrence of "key" should be replaced with -- keys --.

Column 28,
Line 40, "cooper" should be replaced with -- copper --.

Column 31,
Line 34, "though may" should be replaced with -- though it may --.

Column 36,
Line 52, "on" should be replaced with -- are --.

Column 39,
Line 8, "actuator is being" should be replaced with -- actuator being --.
Line 53, "ta" should be replaced with -- to --.

Signed and Sealed this

Ninth Day of August, 2005

JON W. DUDAS
*Director of the United States Patent and Trademark Office*